US012402686B2

(12) United States Patent
Solana et al.

(10) Patent No.: US 12,402,686 B2
(45) Date of Patent: Sep. 2, 2025

(54) ARTICLES OF FOOTWEAR HAVING THERAPEUTIC ASSEMBLIES

(71) Applicant: Therabody, Inc., Los Angeles, CA (US)

(72) Inventors: Jaime Sanchez Solana, Los Angeles, CA (US); Eduardo Merino, Los Angeles, CA (US); Washington Alexander Silva Garces, Los Angeles, CA (US); Timothy Roberts, Sarasota, FL (US); Babak Baravarian, Santa Monica, CA (US)

(73) Assignee: Therabody, Inc., Los Angeles, CA (US)

( * ) Notice: Subject to any disclaimer, the term of this patent is extended or adjusted under 35 U.S.C. 154(b) by 0 days.

(21) Appl. No.: 18/737,898

(22) Filed: Jun. 7, 2024

(65) Prior Publication Data

US 2024/0415226 A1 Dec. 19, 2024

Related U.S. Application Data

(60) Provisional application No. 63/508,249, filed on Jun. 14, 2023.

(51) Int. Cl.

| | |
|---|---|
| ***A43B 3/36*** | (2022.01) |
| ***A43B 3/40*** | (2022.01) |
| ***A43B 13/02*** | (2022.01) |

(52) U.S. Cl.

CPC ..... *A43B 3/36* (2022.01); *A43B 3/40* (2022.01); *A43B 13/02* (2013.01)

(58) Field of Classification Search

CPC .. A43B 3/36; A43B 3/40; A43B 13/02; F21V 33/0008; F21W 2131/20

See application file for complete search history.

(56) References Cited

U.S. PATENT DOCUMENTS

| | | | |
|---|---|---|---|
| 657,765 | A | 9/1900 | Gibbs |
| 675,772 | A | 6/1901 | Ferguson |

(Continued)

FOREIGN PATENT DOCUMENTS

| | | | |
|---|---|---|---|
| AT | 510048 | A1 | 1/2012 |
| AU | 2019204770 | B1 | 10/2019 |

(Continued)

OTHER PUBLICATIONS alexnld.com: "Adjustable Waist Support Belt 3 Modes Heating Back Massage Band Lumbar Brace," Available at least as early as Dec. 6, 2021, 18 Pages, Retrieved from URL: https://alexnld.com/product/adjustable-waist-support-belt-3-modes-heating-back-massage-band-lumbar-brace/.

(Continued)

*Primary Examiner* — Robert J May

(74) *Attorney, Agent, or Firm* — Lowe Graham Jones PLLC

(57) ABSTRACT

An article of footwear for warm-up and active recovery includes a sole and a light therapy system coupled to the sole. The light therapy system includes a plurality of LEDs, The article of footwear also includes a battery configured to power the light therapy system and control circuitry configured to control the light therapy system. The article of footwear may also include a vibration therapy system that includes a plurality of vibrating motors. The battery may power the vibration therapy system and the control circuitry may power the vibration therapy system.

19 Claims, 23 Drawing Sheets

(56) References Cited

U.S. PATENT DOCUMENTS

| | | | |
|---|---|---|---|
| 1,545,027 | A | 7/1925 | Ashlock |
| 1,594,636 | A | 8/1926 | Smith |
| 1,657,765 | A | 1/1928 | Pasque |
| 1,784,301 | A | 12/1930 | Mekler |
| D91,454 | S | 2/1934 | Decker |
| D93,943 | S | 11/1934 | Rand |
| 2,179,594 | A | 11/1939 | Johnson |
| D118,980 | S | 2/1940 | Larson |
| D129,045 | S | 8/1941 | Wilhide |
| 2,391,671 | A | 12/1945 | Berg |
| D143,678 | S | 1/1946 | Snyder et al. |
| 2,475,861 | A | 7/1949 | Thalmann |
| D161,484 | S | 1/1951 | Mcquown |
| D163,324 | S | 5/1951 | Rittenhouse |
| D180,923 | S | 9/1957 | Anton |
| D181,742 | S | 12/1957 | Madl |
| 2,931,632 | A | 4/1960 | De Angelis |
| 2,987,334 | A | 6/1961 | Wendling |
| 3,053,559 | A | 9/1962 | Frick |
| 3,077,837 | A | 2/1963 | Dickinson |
| D195,145 | S | 4/1963 | Ernest |
| D197,142 | S | 12/1963 | Godrey et al. |
| 3,172,675 | A | 3/1965 | Gonzalez |
| D207,505 | S | 4/1967 | Whitman |
| 3,452,226 | A | 6/1969 | Hettich |
| 3,545,301 | A | 12/1970 | Richter |
| 3,557,781 | A | 1/1971 | Kay, Sr. |
| 3,626,934 | A | 12/1971 | Andis |
| 3,699,952 | A | 10/1972 | Waters |
| 3,705,579 | A | 12/1972 | Morini |
| D230,522 | S | 2/1974 | Rothman |
| D237,454 | S | 11/1975 | Adams et al. |
| D237,455 | S | 11/1975 | Schramm et al. |
| 3,942,251 | A | 3/1976 | Griffies |
| 3,968,789 | A | 7/1976 | Simoncini |
| 4,031,763 | A | 6/1977 | Eisenberg |
| 4,046,142 | A | 9/1977 | Whitney |
| 4,088,128 | A | 5/1978 | Mabuchi |
| 4,150,668 | A | 4/1979 | Johnston |
| 4,158,246 | A | 6/1979 | Meadows |
| 4,173,217 | A | 11/1979 | Johnston |
| 4,203,431 | A | 5/1980 | Abura |
| 4,257,408 | A | 3/1981 | Ramey |
| D265,985 | S | 8/1982 | House, II |
| 4,506,159 | A | 3/1985 | Reuter |
| 4,513,737 | A | 4/1985 | Mabuchi |
| 4,533,796 | A | 8/1985 | Engelmore |
| 4,549,535 | A | 10/1985 | Wing |
| 4,565,189 | A | 1/1986 | Mabuchi |
| 4,566,442 | A | 1/1986 | Mabuchi |
| 4,596,406 | A | 6/1986 | Van Vleet |
| D287,814 | S | 1/1987 | Hiraishi |
| 4,691,693 | A | 9/1987 | Sato |
| 4,692,958 | A | 9/1987 | McMakin |
| D292,368 | S | 10/1987 | Mikiya |
| 4,730,605 | A | 3/1988 | Noble |
| D300,132 | S | 3/1989 | Culbertson |
| 4,815,224 | A | 3/1989 | Miller |
| 4,841,955 | A | 6/1989 | Evans |
| D303,373 | S | 9/1989 | Ching |
| 4,935,972 | A | 6/1990 | Brady |
| D310,005 | S | 8/1990 | Precht |
| 4,979,502 | A | 12/1990 | Hunt |
| D314,320 | S | 2/1991 | Brosius |
| 4,989,613 | A | 2/1991 | Finkenberg |
| 4,991,298 | A | 2/1991 | Matre |
| 5,014,681 | A | 5/1991 | Heeman |
| D320,379 | S | 10/1991 | Culbertson |
| D321,338 | S | 11/1991 | Sakamoto |
| 5,085,207 | A | 2/1992 | Fiore |
| 5,088,474 | A | 2/1992 | Mabuchi |
| 5,092,317 | A | 3/1992 | Zelikovski |
| 5,103,809 | A | 4/1992 | Deluca |
| 5,123,139 | A | 6/1992 | Leppert |
| D329,166 | S | 9/1992 | Doggett |
| D329,291 | S | 9/1992 | Wollman |
| D329,292 | S | 9/1992 | Wollman |
| D331,467 | S | 12/1992 | Wollman |
| D334,012 | S | 3/1993 | Chen |
| 5,201,149 | A | 4/1993 | Eisenblaetter |
| 5,207,697 | A | 5/1993 | Carusillo |
| 5,212,887 | A | 5/1993 | Farmerie |
| D338,802 | S | 8/1993 | Maass, Jr. |
| D345,077 | S | 3/1994 | Maass, Jr. |
| D345,727 | S | 4/1994 | Flowers |
| D345,888 | S | 4/1994 | Joss |
| D349,029 | S | 7/1994 | Matsunaga |
| 5,334,131 | A | 8/1994 | Omandam |
| 5,417,644 | A | 5/1995 | Lee |
| D363,352 | S | 10/1995 | Huen |
| D367,712 | S | 3/1996 | Young |
| 5,501,657 | A | 3/1996 | Feero |
| 5,545,125 | A | 8/1996 | Tseng |
| D374,934 | S | 10/1996 | Lie |
| 5,569,168 | A | 10/1996 | Hartwig |
| 5,573,500 | A | 11/1996 | Katsunuma |
| 5,605,144 | A | 2/1997 | Simmons |
| 5,656,017 | A | 8/1997 | Keller |
| 5,656,018 | A | 8/1997 | Tseng |
| D383,366 | S | 9/1997 | Heck |
| D383,435 | S | 9/1997 | Svetlik |
| D384,639 | S | 10/1997 | Kawakami |
| D387,728 | S | 12/1997 | Kawakami |
| D388,175 | S | 12/1997 | Lie |
| D397,991 | S | 9/1998 | Kawakami |
| D400,161 | S | 10/1998 | Nagele |
| D400,758 | S | 11/1998 | Hippen |
| 5,860,669 | A | 1/1999 | Wass |
| D408,543 | S | 4/1999 | Back |
| 5,902,256 | A | 5/1999 | Benaron |
| 5,910,197 | A | 6/1999 | Chaconas |
| 5,925,002 | A | 7/1999 | Wollman |
| D412,485 | S | 8/1999 | Kato |
| 5,935,089 | A | 8/1999 | Shimizu |
| 5,951,501 | A | 9/1999 | Griner |
| D417,648 | S | 12/1999 | Clowers |
| 6,003,052 | A | 12/1999 | Yamagata |
| 6,006,631 | A | 12/1999 | Miner |
| D425,014 | S | 5/2000 | Willkens |
| 6,093,164 | A | 7/2000 | Davis |
| D430,774 | S | 9/2000 | Naft |
| D430,938 | S | 9/2000 | Lee |
| D432,077 | S | 10/2000 | Zurwelle |
| D433,300 | S | 11/2000 | Buck |
| 6,146,383 | A | 11/2000 | Studer |
| 6,165,145 | A | 12/2000 | Noble |
| D439,984 | S | 4/2001 | Thach |
| D440,136 | S | 4/2001 | Buck |
| 6,227,959 | B1 | 5/2001 | Beaudry |
| 6,228,042 | B1 | 5/2001 | Dungan |
| 6,228,120 | B1 | 5/2001 | Leonard |
| 6,245,031 | B1 | 6/2001 | Pearson |
| 6,254,554 | B1 | 7/2001 | Turtzo |
| 6,290,660 | B1 | 9/2001 | Epps |
| D448,852 | S | 10/2001 | Engelen |
| 6,401,289 | B1 | 6/2002 | Herbert |
| 6,406,445 | B1 | 6/2002 | Ben-Nun |
| 6,432,072 | B1 | 8/2002 | Harris |
| 6,479,752 | B1 | 11/2002 | Neuroth |
| 6,537,235 | B1 | 3/2003 | Connor |
| 6,537,236 | B2 | 3/2003 | Tucek |
| 6,539,328 | B1 | 3/2003 | Cremonese |
| D474,445 | S | 5/2003 | Matsuoka |
| 6,558,338 | B1 | 5/2003 | Wasserman |
| 6,568,089 | B1 | 5/2003 | Popik |
| D475,595 | S | 6/2003 | Hatch |
| D475,679 | S | 6/2003 | Cooper |
| D476,746 | S | 7/2003 | Harris |
| 6,599,250 | B2 | 7/2003 | Webb |
| 6,599,260 | B2 | 7/2003 | Tucek |
| D478,385 | S | 8/2003 | Dirks |
| D481,279 | S | 10/2003 | Buck |
| 6,663,657 | B1 | 12/2003 | Miller |
| 6,682,496 | B1 | 1/2004 | Pivaroff |

(56) References Cited

U.S. PATENT DOCUMENTS 6,715,781 B1 4/2004 Smith
6,723,050 B2 4/2004 Dow
6,723,060 B2 4/2004 Miller
6,758,826 B2 7/2004 Luettgen
6,805,700 B2 10/2004 Miller
6,823,762 B2 11/2004 Hu
6,833,639 B2 12/2004 Lau
6,846,295 B1 1/2005 Ben-Nun
D504,111 S 4/2005 Ozawa
6,895,261 B1 5/2005 Palamides
D510,317 S 10/2005 Sun
6,994,575 B1 2/2006 Clark
7,041,072 B2 5/2006 Calvert
7,085,585 B2 8/2006 Camarillo
D530,270 S 10/2006 Ozawa
7,128,721 B2 10/2006 Ferber
D531,733 S 11/2006 Burout, III
7,147,610 B2 12/2006 Maalouf
7,169,169 B2 1/2007 Tucek
7,223,250 B2 5/2007 Brattesani
D544,102 S 6/2007 Pivaroff
D544,436 S 6/2007 Kawahara
D547,264 S 7/2007 Kondo
7,242,118 B2 7/2007 Sakamoto
D553,252 S 10/2007 Masuda
D553,562 S 10/2007 Okada
7,279,814 B2 10/2007 Patt
7,384,405 B2 6/2008 Rhoades
D575,224 S 8/2008 Taniguchi
7,431,706 B2 10/2008 Louis
D579,868 S 11/2008 Harrison
D580,353 S 11/2008 Harrison
7,470,081 B2 12/2008 Miyahara
7,474,018 B2 1/2009 Shimizu
D587,977 S 3/2009 Waldron
7,497,639 B2 3/2009 Lebot
7,503,923 B2 3/2009 Miller
D593,204 S 5/2009 Manke
7,549,966 B2 6/2009 Fujii
D597,482 S 8/2009 Kondo
D604,235 S 11/2009 Tarter
D605,586 S 12/2009 Tong
D606,192 S 12/2009 Summerer
7,731,672 B2 6/2010 Chiang
7,732,951 B2 6/2010 Mukaide
7,740,249 B1 6/2010 Gao
D622,660 S 8/2010 Taniguchi
7,857,729 B2 12/2010 Sullivan
D631,315 S 1/2011 Xue
7,877,880 B2 2/2011 Royle
7,898,121 B2 3/2011 Ramsay
7,927,259 B1 4/2011 Rix
7,927,294 B2 4/2011 Kamimura
7,946,977 B2 5/2011 Klearman
7,963,717 B2 6/2011 Seger
7,996,996 B2 8/2011 Hirabayashi
D649,657 S 11/2011 Petersen
8,120,225 B2 2/2012 Thundat
D658,759 S 5/2012 Marescaux
D659,644 S 5/2012 Gretz
D666,303 S 8/2012 Ding
8,313,450 B2 11/2012 Ben-Nun
8,324,763 B2 12/2012 Gosvener
8,342,187 B2 1/2013 Kalman
8,344,560 B2 1/2013 Gosvener
8,356,430 B2 * 1/2013 Beers ..... A43B 13/20 36/137
8,415,839 B2 4/2013 Geng
D682,195 S 5/2013 Aglassinger
8,435,194 B2 5/2013 Dverin
8,479,616 B2 7/2013 Tsai
8,517,895 B2 8/2013 Shalev
8,523,793 B1 9/2013 Waldon, Sr.
8,587,163 B2 11/2013 Camacho
8,622,943 B2 1/2014 Ben-Nun
8,624,448 B2 1/2014 Kaiser
8,646,348 B2 2/2014 Hung
D703,337 S 4/2014 Fuhr
D703,480 S 4/2014 Lownds
8,695,461 B2 4/2014 Moss
D706,433 S 6/2014 Fuhr
D708,742 S 7/2014 Dallemagne
8,770,882 B2 7/2014 Ersoy
8,777,881 B2 7/2014 Tsai
8,786,143 B2 7/2014 Gosvener
8,864,143 B2 10/2014 Lin
D722,016 S 2/2015 Beukema
8,945,104 B2 2/2015 Boone, III
8,951,216 B2 2/2015 Yoo
D726,495 S 4/2015 Ryan
9,017,273 B2 4/2015 Burbank
D734,863 S 7/2015 Hennessey
D735,348 S 7/2015 Hennessey
9,107,486 B2 8/2015 Brewer
9,132,058 B2 9/2015 Imboden
9,138,257 B2 9/2015 Revivo
D740,222 S 10/2015 Tang
9,161,878 B1 10/2015 Pamplin
9,236,786 B1 1/2016 Geng
9,272,837 B2 3/2016 Linzell
D756,180 S 5/2016 Chen
D759,237 S 6/2016 Heath
D759,238 S 6/2016 Heath
9,364,385 B2 6/2016 Yang
D763,442 S 8/2016 Price
9,411,060 B2 8/2016 Coste
9,412,507 B2 8/2016 Blanding
9,416,805 B2 8/2016 Cascolan
D776,612 S 1/2017 Chen
D778,439 S 2/2017 Hakansson
9,597,256 B1 3/2017 Paul
9,677,901 B2 6/2017 Yamamoto
9,687,577 B2 * 6/2017 Dobrinsky ..... A43B 17/10
9,744,600 B2 8/2017 Yang
9,872,813 B2 1/2018 Giraud
9,889,066 B2 2/2018 Danby
D817,732 S 5/2018 Rettler
D817,869 S 5/2018 Lee
D819,221 S 5/2018 Lei
9,981,366 B2 5/2018 Todd
D823,478 S 7/2018 Park
10,034,813 B1 7/2018 Silver
D826,418 S 8/2018 Lad
10,159,623 B2 12/2018 Leftly
D837,395 S 1/2019 Gan
D838,378 S 1/2019 Cao
D840,547 S 2/2019 Harle
10,201,470 B2 2/2019 Griner
D842,489 S 3/2019 Spewock
D842,491 S 3/2019 Fleming
D843,656 S 3/2019 Zhang
D844,896 S 4/2019 Levi
D847,362 S 4/2019 Tang
D847,364 S 4/2019 Lee
10,252,051 B2 4/2019 Nichols
10,276,844 B2 4/2019 Wackwitz
D847,990 S 5/2019 Kimball
10,314,762 B1 6/2019 Marton
10,335,345 B2 7/2019 Choe
10,357,425 B2 7/2019 Wersland
D855,822 S 8/2019 Marton
D858,432 S 9/2019 Altenburger
D862,382 S 10/2019 Altenburger
D866,790 S 11/2019 Lee
D867,279 S 11/2019 Altenburger
10,492,985 B2 12/2019 Golan
10,557,490 B2 2/2020 Wersland
D877,351 S 3/2020 Wersland
10,601,293 B2 3/2020 Hutchins
D880,419 S 4/2020 Hernandez
D880,714 S 4/2020 Wersland
D880,715 S 4/2020 Wersland
D880,716 S 4/2020 Wersland
10,610,446 B2 4/2020 Shockley, Jr.

(56) References Cited

U.S. PATENT DOCUMENTS

D884,205 S 5/2020 Zhuang
10,702,448 B2 7/2020 Wersland
D893,738 S 8/2020 Zhuang
10,758,027 B2 9/2020 Skidmore
10,774,696 B2 9/2020 Hutchins
10,855,155 B2 12/2020 Huang
10,857,064 B2 12/2020 Wersland
10,918,565 B2 2/2021 Wersland
10,938,286 B1 3/2021 Liu
10,940,081 B2 3/2021 Nazarian
10,945,915 B2 3/2021 Wersland
10,959,674 B2 3/2021 Leaper
10,959,908 B2 3/2021 Lee
10,959,911 B2 3/2021 Wersland
D919,560 S 5/2021 Taniguchi
10,993,874 B1 5/2021 Marton
11,090,221 B1 8/2021 Haddock Dicarlo
11,160,721 B2 11/2021 Wersland
11,160,723 B2 11/2021 Wersland
11,357,697 B2 6/2022 Wersland
11,432,994 B2 9/2022 Wersland
11,452,670 B2 9/2022 Wersland
11,478,400 B1 10/2022 Marton
11,478,606 B1 10/2022 English
11,488,592 B2 11/2022 Kim
11,547,627 B2 1/2023 Merino
11,559,102 B2 1/2023 Tapper et al.
11,564,860 B2 1/2023 Wersland
11,751,627 B2 9/2023 Cho
2001/0016697 A1 8/2001 Gorsen
2001/0027280 A1 10/2001 Huang
2002/0057203 A1 5/2002 Borders
2002/0082532 A1 6/2002 Tucek
2002/0115947 A1 8/2002 Young
2002/0177795 A1 11/2002 Frye
2002/0183668 A1 12/2002 Huang
2002/0188233 A1 12/2002 Denyes
2003/0009116 A1 1/2003 Luettgen
2003/0014079 A1 1/2003 Tucek
2003/0028134 A1 2/2003 Lev
2003/0094356 A1 5/2003 Waldron
2003/0144615 A1 7/2003 Lin
2003/0195443 A1 10/2003 Miller
2004/0009731 A1 1/2004 Rabinowicz
2004/0176710 A1 9/2004 Kennedy
2005/0075591 A1 4/2005 Hafemann
2005/0109137 A1 5/2005 Hartmann
2005/0113870 A1 5/2005 Miller
2005/0126018 A1 6/2005 Haas
2005/0131461 A1 6/2005 Tucek
2005/0203445 A1 9/2005 Tsai
2005/0209545 A1 9/2005 Farrow
2005/0235988 A1 10/2005 Hansen
2005/0252011 A1 11/2005 Neumeier
2006/0025710 A1 2/2006 Schulz
2006/0047315 A1 3/2006 Colloca
2006/0064800 A1 3/2006 Freund
2006/0074455 A1 4/2006 Strandberg
2006/0116614 A1 6/2006 Jones
2006/0118841 A1 6/2006 Eliason
2006/0123941 A1 6/2006 Wadge
2006/0178603 A1 8/2006 Popescu
2006/0192527 A1 8/2006 Kageler
2006/0211961 A1 9/2006 Meyer
2006/0235346 A1* 10/2006 Prescott ..... A43B 3/36 602/2
2006/0238055 A1 10/2006 Danford
2006/0272664 A1 12/2006 O'Dwyer
2007/0055186 A1 3/2007 Hsieh
2007/0129220 A1 6/2007 Bardha
2007/0144310 A1 6/2007 Pozgay
2007/0150004 A1 6/2007 Colloca
2007/0173886 A1 7/2007 Rousso
2007/0179414 A1 8/2007 Imboden
2007/0179421 A1 8/2007 Farrow
2007/0245444 A1 10/2007 Brink
2007/0270727 A1 11/2007 Khorassani Zadeh
2007/0282228 A1 12/2007 Einav
2007/0299464 A1 12/2007 Cruise
2008/0001484 A1 1/2008 Fuller
2008/0077061 A1 3/2008 Dehli
2008/0097260 A1 4/2008 Tsukada
2008/0103419 A1 5/2008 Adamson
2008/0146980 A1 6/2008 Rousso
2008/0167588 A1 7/2008 Chen
2008/0169715 A1 7/2008 Mills
2008/0177207 A1 7/2008 Liao
2008/0185888 A1 8/2008 Beall
2008/0200849 A1 8/2008 Hollington
2008/0201818 A1 8/2008 Nilforushan
2008/0243041 A1 10/2008 Brenner
2008/0306417 A1 12/2008 Imboden
2008/0312568 A1 12/2008 Chen
2008/0314610 A1 12/2008 Meixner
2009/0005812 A1 1/2009 Fuhr
2009/0034236 A1* 2/2009 Reuben ..... A43B 3/35 362/103
2009/0112134 A1 4/2009 Avni
2009/0143706 A1 6/2009 Acosta
2009/0143707 A1 6/2009 Strahl
2009/0188119 A1 7/2009 Oberheim
2009/0234262 A1 9/2009 Reid, Jr.
2009/0270777 A1 10/2009 Wu
2009/0309313 A1 12/2009 Knorr
2009/0326540 A1 12/2009 Estes
2010/0100119 A1 4/2010 Herndon
2010/0137752 A1 6/2010 Heine
2010/0137907 A1 6/2010 Tsai
2010/0145242 A1 6/2010 Tsai
2010/0160841 A1 6/2010 Wu
2010/0162579 A1 7/2010 Naughton
2010/0176919 A1 7/2010 Myers
2010/0204694 A1 8/2010 Mehta
2010/0210194 A1 8/2010 Thomaschewski
2010/0249637 A1 9/2010 Walter
2010/0274162 A1 10/2010 Evans
2010/0286569 A1 11/2010 Nagano
2010/0298863 A1 11/2010 Hindinger
2011/0037431 A1 2/2011 Mackle
2011/0055720 A1 3/2011 Potter
2011/0098537 A1 4/2011 Justis
2011/0098615 A1 4/2011 Whalen
2011/0118637 A1 5/2011 Lev
2011/0201979 A1 8/2011 Voss
2011/0224580 A1 9/2011 Leathers
2011/0257575 A1 10/2011 Farrow
2011/0277204 A1 11/2011 Chan
2011/0314677 A1 12/2011 Meier
2012/0023785 A1 2/2012 Barnes
2012/0059294 A1 3/2012 Schubert
2012/0065556 A1 3/2012 Smith
2012/0078071 A1 3/2012 Bohm
2012/0119594 A1 5/2012 Gosvener
2012/0124758 A1 5/2012 Sabisch
2012/0161706 A1 6/2012 Zhou
2012/0185999 A1 7/2012 Raviv
2012/0186101 A1 7/2012 Sanchez
2012/0197357 A1 8/2012 Dewey
2012/0207147 A1 8/2012 Macdonald
2012/0222333 A1 9/2012 Short
2012/0232445 A1 9/2012 Lev
2012/0238922 A1 9/2012 Stemple
2012/0253245 A1 10/2012 Stanbridge
2012/0259255 A1 10/2012 Tomlinson
2013/0014968 A1 1/2013 Kehoe et
2013/0030506 A1 1/2013 Bartolone
2013/0046212 A1 2/2013 Nichols
2013/0052871 A1 2/2013 Eklind
2013/0085421 A1 4/2013 Gillespie
2013/0116503 A1 5/2013 Mertens
2013/0116606 A1 5/2013 Cordo
2013/0133210 A1 5/2013 Weir
2013/0138023 A1 5/2013 Lerro
2013/0218058 A1 8/2013 Ceoldo

(56) References Cited

U.S. PATENT DOCUMENTS

2013/0237751 A1 9/2013 Alexander
2013/0241470 A1 9/2013 Kim
2013/0261516 A1 10/2013 Cilea
2013/0261517 A1 10/2013 Rodgers
2013/0271067 A1 10/2013 Yu
2013/0281897 A1 10/2013 Hoffmann
2013/0304642 A1 11/2013 Campos
2014/0024982 A1 1/2014 Doyle
2014/0031866 A1 1/2014 Fuhr
2014/0097793 A1 4/2014 Wurtz
2014/0101872 A1 4/2014 Utsch
2014/0111034 A1 4/2014 Gosvener
2014/0111035 A1 4/2014 Gosvener
2014/0117786 A1 5/2014 Gosvener
2014/0144624 A1 5/2014 Camacho Cardenas
2014/0163443 A1 6/2014 Young
2014/0180331 A1 6/2014 Turner
2014/0190023 A1 7/2014 Vitantonio
2014/0194900 A1 7/2014 Sedic
2014/0200495 A1 7/2014 Jones
2014/0207032 A1 7/2014 Dematio
2014/0209594 A1 7/2014 Besner
2014/0221887 A1 8/2014 Wu
2014/0288473 A1 9/2014 Matsushita
2014/0303692 A1* 10/2014 Pignatelli ..... A61N 5/0613
607/90
2014/0305441 A1 10/2014 Porter
2014/0305747 A1 10/2014 Kumar
2014/0310900 A1 10/2014 Curry
2014/0316313 A1 10/2014 Mayer
2014/0317825 A1 10/2014 Silverberg
2014/0364778 A1 12/2014 Leftly
2015/0005682 A1 1/2015 Danby
2015/0042254 A1 2/2015 Kato
2015/0082562 A1 3/2015 Kamada
2015/0098184 A1 4/2015 Tsai
2015/0119771 A1 4/2015 Roberts
2015/0133833 A1 5/2015 Bradley
2015/0145297 A1 5/2015 Lee
2015/0148592 A1 5/2015 Kanbar
2015/0157528 A1 6/2015 Le
2015/0176674 A1 6/2015 Khan
2015/0214760 A1 7/2015 Chraime
2015/0216719 A1 8/2015 Debenedictis
2015/0217142 A1 8/2015 Schafer
2015/0257964 A1 9/2015 Ajiki
2015/0272815 A1 10/2015 Kitchens
2015/0290028 A1 10/2015 Isserow
2015/0305969 A1 10/2015 Giraud
2015/0320352 A1 11/2015 Ben Shalom
2015/0328081 A1 11/2015 Goldenberg
2015/0359704 A1 12/2015 Imboden
2015/0375315 A1 12/2015 Ukai
2016/0000642 A1 1/2016 Zipper
2016/0008217 A1 1/2016 Constantine
2016/0017905 A1 1/2016 Cascolan
2016/0022536 A1 1/2016 Nauman
2016/0030279 A1 2/2016 Driscoll
2016/0045661 A1 2/2016 Gray
2016/0074547 A1 3/2016 Dobrinsky
2016/0112841 A1 4/2016 Holland
2016/0113840 A1 4/2016 Crunick
2016/0113841 A1 4/2016 Godfrey
2016/0127129 A1 5/2016 Chee
2016/0129186 A1 5/2016 Douglas
2016/0136037 A1 5/2016 Cai
2016/0136040 A1 5/2016 Li
2016/0166464 A1 6/2016 Douglas
2016/0166833 A1 6/2016 Oh
2016/0170996 A1 6/2016 Frank
2016/0184171 A1 6/2016 Poole
2016/0192814 A1 7/2016 Kang
2016/0206502 A1 7/2016 Køltzow
2016/0243359 A1 8/2016 Sharma
2016/0263732 A1 9/2016 Lourenco
2016/0269486 A1 9/2016 Gupta
2016/0310353 A1 10/2016 Barasch
2016/0311091 A1 10/2016 Wang
2016/0324717 A1 11/2016 Burton
2016/0331308 A1 11/2016 Zhou
2016/0331620 A1 11/2016 Kazanchyan
2016/0338901 A1 11/2016 Cohen
2016/0346163 A1 12/2016 Konik
2016/0367425 A1 12/2016 Wersland
2017/0027798 A1 2/2017 Wersland
2017/0042754 A1 2/2017 Fowers
2017/0049278 A1 2/2017 Thomassen
2017/0069191 A1 3/2017 Erkkila
2017/0119620 A1 5/2017 Trapp
2017/0119623 A1 5/2017 Attarian
2017/0128320 A1 5/2017 Chen
2017/0156974 A1 6/2017 Griner
2017/0156975 A1 6/2017 Mills
2017/0189227 A1 7/2017 Brunson
2017/0216136 A1 8/2017 Gordon
2017/0233063 A1 8/2017 Zhao
2017/0246074 A1 8/2017 Wu
2017/0304144 A1 10/2017 Tucker
2017/0304145 A1 10/2017 Pepe
2017/0312161 A1 11/2017 Johnson
2017/0332706 A1 11/2017 Gellineau
2017/0360641 A1 12/2017 Nakata
2018/0008512 A1 1/2018 Goldstein
2018/0033437 A1 2/2018 Inada
2018/0036198 A1 2/2018 Mergl
2018/0038363 A1 2/2018 Trethewey
2018/0039478 A1 2/2018 Sung
2018/0050440 A1 2/2018 Chen
2018/0078449 A1 3/2018 Callow
2018/0133101 A1 5/2018 Inada
2018/0140100 A1 5/2018 Cribbs
2018/0140502 A1 5/2018 Shahoian
2018/0141188 A1 5/2018 Lai
2018/0154141 A1 6/2018 Ahn
2018/0185234 A1 7/2018 Ishiguro
2018/0199635 A1 7/2018 Longinotti-Buitoni
2018/0200141 A1 7/2018 Wersland
2018/0236572 A1 8/2018 Ukai
2018/0243158 A1 8/2018 Loghmani
2018/0263845 A1 9/2018 Wersland
2018/0271209 A1 9/2018 Zahrieh
2018/0279843 A1 10/2018 Paul
2018/0288160 A1 10/2018 Paul
2018/0296433 A1 10/2018 Danby
2018/0303704 A1 10/2018 Idris
2018/0315499 A1 11/2018 Appelbaum
2018/0315504 A1 11/2018 Inada
2019/0000709 A1 1/2019 Sone
2019/0015295 A1 1/2019 Marton
2019/0021929 A1 1/2019 Einav
2019/0029594 A1 1/2019 Jiang
2019/0038229 A1 2/2019 Perraut
2019/0060159 A1 2/2019 Seo
2019/0066833 A1 2/2019 Wicki
2019/0110945 A1 4/2019 Kawagoe
2019/0175434 A1 6/2019 Zhang
2019/0183724 A1 6/2019 Sifferlin
2019/0209424 A1 7/2019 Wersland
2019/0216677 A1 7/2019 Paul
2019/0232478 A1 8/2019 Zawisza
2019/0254921 A1 8/2019 Marton
2019/0254922 A1 8/2019 Marton
2019/0269880 A1 9/2019 Root
2019/0283247 A1 9/2019 Chang
2019/0297970 A1 10/2019 Gramlin
2019/0314239 A1 10/2019 Ci
2019/0337140 A1 11/2019 Shanklin
2019/0350793 A1 11/2019 Wersland
2019/0371136 A1 12/2019 Whitaker
2019/0381271 A1 12/2019 Jo
2020/0000237 A1 1/2020 Wu
2020/0000677 A1 1/2020 Pamplin
2020/0009010 A1 1/2020 Park
2020/0016027 A1 1/2020 Kim

(56) References Cited

U.S. PATENT DOCUMENTS

| | | | |
|---|---|---|---|
| 2020/0022864 | A1 | 1/2020 | Lee |
| 2020/0035237 | A1 | 1/2020 | Kim |
| 2020/0069510 | A1 | 3/2020 | Wersland |
| 2020/0085116 | A1 | 3/2020 | Harris |
| 2020/0085675 | A1 | 3/2020 | Lee |
| 2020/0090175 | A1 | 3/2020 | Davis |
| 2020/0100981 | A1 | 4/2020 | Bobey |
| 2020/0113777 | A1 | 4/2020 | Novak |
| 2020/0121550 | A1 | 4/2020 | Elliot |
| 2020/0179210 | A1 | 6/2020 | Barragan Gomez |
| 2020/0179215 | A1 | 6/2020 | Lerner |
| 2020/0214927 | A1 | 7/2020 | Clowney |
| 2020/0222276 | A1 | 7/2020 | Northen |
| 2020/0230012 | A1 | 7/2020 | Fuhr |
| 2020/0241683 | A1 | 7/2020 | Le |
| 2020/0261306 | A1 | 8/2020 | Pepe |
| 2020/0261307 | A1 | 8/2020 | Wersland |
| 2020/0268594 | A1 | 8/2020 | Pepe |
| 2020/0281813 | A1 | 9/2020 | Chao |
| 2020/0294423 | A1 | 9/2020 | Blain |
| 2020/0352821 | A1 | 11/2020 | Wersland |
| 2020/0357046 | A1 | 11/2020 | Mcgann |
| 2020/0390644 | A1 | 12/2020 | Yang |
| 2020/0397651 | A1 | 12/2020 | Park |
| 2020/0405570 | A1 | 12/2020 | Kodama |
| 2021/0000683 | A1 | 1/2021 | Cheng |
| 2021/0022951 | A1 | 1/2021 | Hu |
| 2021/0022955 | A1 | 1/2021 | Wersland |
| 2021/0059898 | A1 | 3/2021 | Wersland |
| 2021/0085555 | A1 | 3/2021 | Davis |
| 2021/0093023 | A1 | 4/2021 | Kuhner-Stout |
| 2021/0098651 | A1 | 4/2021 | Luo |
| 2021/0111591 | A1 | 4/2021 | Chaudhri |
| 2021/0128402 | A1 | 5/2021 | Dai |
| 2021/0137777 | A1 | 5/2021 | Bennett |
| 2021/0244610 | A1 | 8/2021 | Wersland |
| 2021/0244611 | A1 | 8/2021 | Wersland |
| 2021/0275390 | A1 | 9/2021 | Hsueh |
| 2021/0330539 | A1 | 10/2021 | Faussett |
| 2022/0000781 | A9 | 1/2022 | Leneweit |
| 2022/0007810 | A1 | 1/2022 | Paspatis |
| 2022/0023141 | A1 | 1/2022 | Buc |
| 2022/0054347 | A1 | 2/2022 | Tan |
| 2022/0054350 | A1 | 2/2022 | Merino |
| 2022/0087433 | A1 | 3/2022 | Mao |
| 2022/0241135 | A1 | 8/2022 | Wang |
| 2022/0257460 | A1 | 8/2022 | Wersland |
| 2022/0265507 | A1 | 8/2022 | Merino |
| 2022/0273173 | A1 | 9/2022 | Rodriguez Chapa |
| 2022/0323290 | A1 | 10/2022 | Sloan |
| 2022/0362097 | A1 | 11/2022 | Hart |
| 2023/0001131 | A1 | 1/2023 | English |
| 2023/0218035 | A1 | 7/2023 | Walker |
| 2023/0256258 | A1 | 8/2023 | Tapper et al. |
| 2023/0329902 | A1 | 10/2023 | Aguiar |

FOREIGN PATENT DOCUMENTS

| | | | | |
|---|---|---|---|---|
| CN | 86101310 | A | | 9/1986 |
| CN | 1432452 | A | | 7/2003 |
| CN | 2788807 | Y | | 6/2006 |
| CN | 201239336 | Y | | 5/2009 |
| CN | 201333160 | Y | | 10/2009 |
| CN | 201524220 | U | | 7/2010 |
| CN | 201595246 | | * | 10/2010 |
| CN | 101888050 | A | | 11/2010 |
| CN | 201743890 | U | | 2/2011 |
| CN | 201847899 | U | | 6/2011 |
| CN | 301664182 | S | | 9/2011 |
| CN | 202161539 | U | | 3/2012 |
| CN | 202637439 | U | | 1/2013 |
| CN | 103648320 | A | | 3/2014 |
| CN | 203598194 | U | | 5/2014 |
| CN | 104352341 | A | | 2/2015 |
| CN | 303250929 | S | | 5/2015 |
| CN | 303250924 | S | | 6/2015 |
| CN | 205163583 | U | | 4/2016 |
| CN | 104352341 | B | | 7/2016 |
| CN | 205390477 | | * | 7/2016 |
| CN | 205459750 | U | | 8/2016 |
| CN | 205494357 | U | | 8/2016 |
| CN | 205598186 | U | | 9/2016 |
| CN | 106074129 | A | | 11/2016 |
| CN | 106236528 | A | | 12/2016 |
| CN | 206081000 | U | | 4/2017 |
| CN | 106859949 | A | | 6/2017 |
| CN | 206923743 | U | | 1/2018 |
| CN | 304561844 | S | | 3/2018 |
| CN | 207286298 | U | | 5/2018 |
| CN | 207322794 | | | 5/2018 |
| CN | 207693048 | U | | 8/2018 |
| CN | 207855923 | U | | 9/2018 |
| CN | 109259995 | A | | 1/2019 |
| CN | 208405314 | U | | 1/2019 |
| CN | 208448086 | U | | 2/2019 |
| CN | 109528473 | A | | 3/2019 |
| CN | 209154392 | U | | 7/2019 |
| CN | 110868983 | A | | 3/2020 |
| CN | 106618998 | B | | 8/2020 |
| CN | 111616938 | A | | 9/2020 |
| CN | 111973419 | A | | 11/2020 |
| CN | 212088421 | | * | 12/2020 |
| CN | 113143721 | A | | 7/2021 |
| CN | 113509366 | A | | 10/2021 |
| DE | 3633888 | A1 | | 4/1988 |
| DE | 19905199 | A1 | | 7/2000 |
| DE | 102015102112 | A1 | | 8/2015 |
| DE | 202015005257 | U1 | | 10/2016 |
| EP | 0436719 | B1 | | 5/1994 |
| EP | 1728494 | A1 | | 12/2006 |
| EP | 2080500 | A1 | | 7/2009 |
| EP | 2328255 | A1 | | 6/2011 |
| EP | 1728494 | B1 | | 1/2013 |
| EP | 3537913 | B1 | | 12/2021 |
| GB | 2066081 | A | | 7/1981 |
| GB | 2262236 | A | | 6/1993 |
| JP | S5230553 | A | | 3/1977 |
| JP | S5428491 | A | | 3/1979 |
| JP | H0219157 | A | | 1/1990 |
| JP | H03218763 | A | | 9/1991 |
| JP | H048128 | B2 | | 2/1992 |
| JP | H0447440 | A | | 2/1992 |
| JP | H0447440 | U | | 4/1992 |
| JP | H0751393 | A | | 2/1995 |
| JP | 2000189525 | A | | 7/2000 |
| JP | 3077837 | U | | 6/2001 |
| JP | 2002282322 | A | | 10/2002 |
| JP | 2003077837 | A | | 3/2003 |
| JP | 2005204777 | A | | 8/2005 |
| JP | 2006034941 | A | | 2/2006 |
| JP | 2006212228 | A | | 8/2006 |
| JP | 2008510588 | A | | 4/2008 |
| JP | 2008289616 | A | | 12/2008 |
| JP | 2010534110 | A | | 11/2010 |
| JP | 2011502369 | A | | 1/2011 |
| JP | 5129032 | B2 | | 1/2013 |
| JP | 2013119018 | A | | 6/2013 |
| JP | 2014511240 | A | | 5/2014 |
| JP | 2015035844 | A | | 2/2015 |
| JP | 2015104422 | A | | 6/2015 |
| JP | 2018518347 | A | | 7/2018 |
| KR | 200313149 | Y1 | | 5/2003 |
| KR | 200435552 | Y1 | | 1/2007 |
| KR | 100752432 | B1 | | 8/2007 |
| KR | 20090119424 | A | | 11/2009 |
| KR | 2010005493 | U | * | 5/2010 |
| KR | 101123926 | B1 | | 4/2012 |
| KR | 101162978 | B1 | | 7/2012 |
| KR | 101406275 | B1 | | 6/2014 |
| KR | 20170108550 | A | | 9/2017 |
| KR | 20180031683 | A | | 3/2018 |
| KR | 20200051098 | A | | 5/2020 |
| RU | 2170567 | C1 | | 7/2001 |
| TW | I359657 | B | | 3/2012 |

(56) References Cited

FOREIGN PATENT DOCUMENTS

| | | | |
|---|---|---|---|
| TW | 201440753 | A | 11/2014 |
| WO | 0100269 | A1 | 1/2001 |
| WO | 0119316 | A2 | 3/2001 |
| WO | 2009014727 | A1 | 1/2009 |
| WO | 2009102279 | A1 | 8/2009 |
| WO | 2011159317 | A1 | 12/2011 |
| WO | 2013114084 | A1 | 8/2013 |
| WO | 2013145346 | A1 | 10/2013 |
| WO | 2014118596 | A1 | 8/2014 |
| WO | 2015038005 | A2 | 3/2015 |
| WO | 2018012105 | A1 | 1/2018 |
| WO | 2019186225 | A1 | 10/2019 |
| WO | 2021050861 | A1 | 3/2021 |
| WO | 2023172676 | A2 | 9/2023 |

OTHER PUBLICATIONS

Amazon: "OIVO Xbox One Controller Charger Dual Charging Station Updated Strap, Remote Charger Dock-2 Rechargeable Battery Packs Included," OIVO, Sep. 6, 2018, Especially annotated figures, Retrieved from Entire Document, 11 Pages.

Amazon: "PowerA Joy Con & Pro Controller Charging Dock Nintendo Switch," PowerA, Oct. 31, 2017, Especially annotated figures, Retrieved from Entire Document, 10 Pages.

Amazon: "RecoveryTherm Back—Hot Vibration Back and Core Wrap for Athletes—Advanced Hot Vibration for Back Pain Relief Wrap with Cryothermal Technology—One Size Fits All", Date First Available on Sep. 20, 2022, 02 Pages, Retrieved from URL: https://www.amazon.com/RecoveryTherm-Back-Vibration-Cryothermal-Technology/dp/B0B8GRL7LR/ref=cm_cr_arp_d_product_top?ie=UTF8.

Amazon: "RecoveryTherm Knee—Contrast Therapy Wrap—Hot & Cold Vibration Recovery Knee Wrap for Athletes—Advanced Contrast Therapy for Knee Pain Relief Wrap with Cryothermal Technology—One Size Fits All," Date First Available on Aug. 3, 2022, 03 Pages, Retrieved from URL: https://www.amazon.com/RecoveryTherm-Knee-Vibration-Cryothermal-Technology/dp/B0B8GCB/YF/ref=cm_cr_arp_d_product_topie=UTF8.

Amazon: "Theragun G3PRO Percussive Therapy Device, White, Handheld Deep Muscle, Treatment Massager & Muscle Stimulator for Pain Relief, Recovery, Enhance Performance & Energize The Body," Feb. 13, 2019, Shown on pp. 1, 2 Pages, Retrieved from URL: https://www.amazon.com/dp/B07MJ2MCT3/ref=nav_timeline_asin?_encoding=UTF8&psc=1.

Anthony Katz, "The Raptor: Helps Patients and Saves Your Most Valuable Tool . . . Your Hands," DC Aligned: MeyerDC, Dec. 9, 2015, available at: http://news.meyerdc.com/community/vendor-spotlight/the-raptor-helps-patients-saves-your-most-valuable-tool-your-hands/ (last visited Feb. 15, 2023); 5 pages.

Ball, P., "Stretchy Wires Form Bendy Circuits," Nature 93(1):1-3, (Mar. 2004).

Bardwell D., "Wahl's Massage Product—Meant for Life's Big Pains," DougBardwell.com, Apr. 6, 2016, 7 Pages, [Retrieved On Jun. 3, 2021] Retrieved from URL: https://dougbardwell.com/db/2016/04/06/wahls-massage-products-meant-for-lifes-big-pains/.

BriskHeat Corporation: "BriskHeat HSTAT XtremeFlex Heating Tapes," YouTube video, Nov. 1, 2012, 02 Pages Retrieved from URL: https://www.youtube.com/watch?v=tsPyiPJpdRw.

Collins D., "External Rotor Motor Basics: Design and Applications," Jun. 6, 2018, 03 Pages.

Collins D., "FAQ: What are Hall Effect Sensors and What Is Theirs Role In DC Motors?," Jan. 11, 2017, 03 Pages.

Defendant's Initial Invalidity Contentions, *Therabody, Inc.* v. *Tzumi Electronics LLC et al.*, Case No. SDNY-1-21-cv-07803 (PGG)(RWL), dated Aug. 17, 2022; 16 pages.

Description of Therabody GI Device, available at: https://www.therabody.com/us/en-us/faq/thearagun-devices/faq-devices-1.html?fdid=faq&csortb1=sortOrder&csortd1=1 (last visited Feb. 15, 2023).

Digi-Key's North American Editors: "How to Power and Control Brushless DC Motors," Dec. 7, 2016, 09 Pages.

Examination Report For Australian Patent Application No. 2016284030, dated May 7, 2018, 3 Pages.

Extended European Search Report for European Application No. 16815104.1, mailed Jan. 23, 2019, 08 Pages.

Extended European Search Report for European Application No. 18832213.5, mailed Jul. 21, 2021, 11 Pages.

Extended European Search Report for European Application No. 18832923.9, mailed Apr. 23, 2021, 7 Pages.

Extended European Search Report for European Application No. 20720323.3, mailed Sep. 9, 2021, 10 Pages.

Extended European Search Report for European Application No. 20802710.2, mailed May 10, 2022, 9 Pages.

Extended European Search Report for European Application No. 20802804.3, mailed Apr. 28, 2022, 8 Pages.

Extended European Search Report for European Application No. 21178300.6, mailed Oct. 19, 2021, 9 Pages.

Extended European Search Report for European Application No. 21178311.3, mailed Sep. 23, 2021, 5 Pages.

fsastore.com: "Battle Creek Embrace Relief Knee Wrap," Available at least as early as 2020, 2021, 19 Pages, Retrieved from URL: https://fsastore.com/battle-creek-embrace-relief-knee-wrap/29568.html.

Holly Riddle, "Theragun vs. Hyperice vs, Hydragun: Massage Gun Showdown [Buyer's Guide]," ChatterSource: Health & Wellness, Mar. 9, 2021, available at: https://www.chattersource.com/article/massage-gun/ (last visited Feb. 17, 2023); 14 pages.

Hotsnapz: "Back Belt Set with Free Extra Reusable Heat Pad," hotsnapz.com, Available at least as early as 2022, 11 Pages, Retrieved from URL: https://hotsnapz.com/products/hotsnapz-back-belt-set-with-free-extra-heat-pack.

hyperice.com: "Hyperice X," Available at least as early as Sep. 8, 2021, 10 Pages, Retrieved from URL: https://hyperice.com/products/hyperice-x//?wickedsource=google&wickedid=EAlalQ.obChMIo_D5z_-4-wIV9Y5bCh284gf8EAQ.YByABEgLiRvD_BwE&wickedid=&wcid=17299137048&wv=4&gclid=EAlalQobChMIo_D5z_-4-wIV9Y5bCh284gf8EAQ.YByABEgLiRvD_BwE.

International Preliminary Report on Patentability for International Application No. PCT/US2016/038326, mailed Jan. 4, 2018, 8 Pages.

International Preliminary Report on Patentability for International Application No. PCT/US2018/022426, mailed Sep. 26, 2019, 9 Pages.

International Preliminary Report on Patentability for International Application No. PCT/US2018/039599, mailed Jan. 23, 2020, 8 Pages.

International Preliminary Report on Patentability for International Application No. PCT/US2018/040795, mailed Jan. 23, 2020, 7 Pages.

International Preliminary Report on Patentability for International Application No. PCT/US2019/067624, mailed Jul. 8, 2021, 11 Pages.

International Preliminary Report on Patentability for International Application No. PCT/US2020/017645, mailed Aug. 26, 2021, 11 Pages.

International Preliminary Report on Patentability for International Application No. PCT/US2020/031339, mailed Nov. 18, 2021, 11 Pages.

International Preliminary Report on Patentability for International Application No. PCT/US2020/031936, mailed Nov. 18, 2021, 14 Pages.

International Preliminary Report on Patentability for International Application No. PCT/US2020/050385, mailed Mar. 24, 2022, 12 Pages.

International Preliminary Report on Patentability for International Application No. PCT/US2020/050399, mailed Jan. 13, 2022, 6 Pages.

International Preliminary Report on Patentability for International Application No. PCT/US2020/054773, mailed Apr. 21, 2022, 8 Pages.

(56) References Cited

OTHER PUBLICATIONS

International Preliminary Report on Patentability for International Application No. PCT/US2020/054842, mailed Apr. 21, 2022, 7 Pages.
International Preliminary Report on Patentability for International Application No. PCT/US2020/063426, mailed Jun. 16, 2022, 06 Pages.
International Preliminary Report on Patentability for International Application No. PCT/US2021/022500, mailed Oct. 6, 2022, 6 Pages.
International Preliminary Report on Patentability for International Application No. PCT/US2021/029900, mailed Nov. 10, 2022, 9 Pages.
International Preliminary Report on Patentability for International Application No. PCT/US2021/029903, mailed Nov. 10, 2022, 7 Pages.
International Preliminary Report on Patentability for International Application No. PCT/US2021/046651, mailed Mar. 2, 2023, 10 Pages.
International Search Report and Written Opinion for Application No. PCT/CN2024/108734, mailed on Nov. 12, 2024, 10 Pages.
International Search Report and Written Opinion for Application No. PCT/US2023/063004, mailed on Jun. 29, 2023, 10 pages.
International Search Report and Written Opinion for Application No. PCT/US2024/035629, mailed on Nov. 13, 2024, 17 Pages.
International Search Report and Written Opinion for International Application No. PCT/US2016/038326, mailed Sep. 1, 2016, 9 Pages.
International Search Report and Written Opinion for International Application No. PCT/US2018/022426, mailed May 31, 2018, 10 Pages.
International Search Report and Written Opinion for International Application No. PCT/US2018/039599, mailed Sep. 24, 2018, 9 Pages.
International Search Report and Written Opinion for International Application No. PCT/US2018/040795, mailed Sep. 24, 2018, 8 Pages.
International Search Report and Written Opinion for International Application No. PCT/US2019/067624, mailed Feb. 3, 2020, 13 Pages.
International Search Report and Written Opinion for International Application No. PCT/US2020/017645, mailed May 20, 2020, 13 Pages.
International Search Report and Written Opinion for International Application No. PCT/US2020/031339, mailed Jun. 10, 2020, 12 Pages.
International Search Report and Written Opinion for International Application No. PCT/US2020/031347, mailed Aug. 3, 2020, 9 Pages.
International Search Report and Written Opinion for International Application No. PCT/US2020/031936, mailed Sep. 11, 2020, 17 Pages.
International Search Report and Written Opinion for International Application No. PCT/US2020/050385, mailed Dec. 3, 2020, 13 Pages.
International Search Report and Written Opinion for International Application No. PCT/US2020/050399, mailed Feb. 4, 2021, 11 Pages.
International Search Report and Written Opinion for International Application No. PCT/US2020/054773, mailed Jan. 12, 2021, 9 Pages.
International Search Report and Written Opinion for International Application No. PCT/US2020/054842, mailed Jan. 11, 2021, 8 Pages.
International Search Report and Written Opinion for International Application No. PCT/US2020/063426, mailed Feb. 26, 2021, 09 Pages.
International Search Report and Written Opinion for International Application No. PCT/US2021/022500, mailed Apr. 20, 2021, 7 Pages.
International Search Report and Written Opinion for International Application No. PCT/US2021/029900, mailed Oct. 6, 2021, 12 Pages.
International Search Report and Written Opinion for International Application No. PCT/US2021/029903, mailed Jul. 28, 2021, 8 Pages.
International Search Report and Written Opinion for International Application No. PCT/US2021/046651, mailed Nov. 30, 2021, 11 Pages.
International Search Report and Written Opinion for International Application No. PCT/US2021/064027, mailed Mar. 10, 2022, 19 Pages.
International Search Report and Written Opinion for International Application No. PCT/US2021/064048, mailed Mar. 9, 2022, 9 Pages.
International Search Report and Written Opinion for International Application No. PCT/US2022/028309, mailed Sep. 8, 2022, 10 Pages.
International Search Report and Written Opinion for International Application No. PCT/US2022/075699, mailed Jan. 11, 2023, 8 Pages.
International Search Report and Written Opinion for International Application No. PCT/US2022/076238, mailed Jan. 23, 2023, 12 Pages.
International Search Report and Written Opinion for International Application No. PCT/US2024/033303, mailed Dec. 16, 2024, 16 Pages.
International Search Report and Written Opinion of the International Searching Authority directed to International Patent Application No. PCT/US2023/085190, mailed Jun. 12, 2024, 17 pages.
KT Tape: "KT Recovery+ Ice/Heat Wrap," kttape.com, Available at least as early as Jun. 21, 2021, 06 Pages, Retrieved from URL: https://www.kttape.com/products/kt-recovery-ice-heat-wrap.
Machine translation from Espacenet of written description and claims for CN106074129A, 9 pages (2016).
Machine translation from Espacenet of written description and claims for CN111616938A, 5 pages (2020).
Machine translation from Espacenet of written description and claims for CN111973419A, 7 pages (2020).
Machine Translation of Written Description and Claims for WO2013145346A1 (Year: 2013).
Massage Expert: "Nursal Deep Percussion Massager Review—6 Interchangeable Nodes," Jan. 4, 2021, 6 Pages, [Retrieved on Jun. 3, 2021] Retrieved from URL: https://www.massagexpert.net/nursal-deep-percussion-massager-review/.
McFarland M., "Segway Was Supposed to Change the World, Two Decades Later, It Just Might," CNN Wire Service, Oct. 30, 2018, 7 Pages.
Mueller Group: "Wire & Cable from the Future," Jan. 3, 2012, 01 Page, Retrieved from URL: https://muellergroup.wordpress.com/tag/stretchable-wire.
Partial Supplementary European Search Report for European Application No. 18832213.5, mailed Apr. 20, 2021, 12 Pages.
Rachel [no family name indicated], "Jigsaw Massager," Instructables, Apr. 18, 2010, 6 Pages, Retrieved from URL: https://web.archive.org/web/20100418041422/http://www.instructables.com/id/Jigsaw-Massager/.
Rockwell: "Trans4mer Operating Manual for Multi-purpose saw," Model RK2516/RK2516K, 2011, 32 Pages.
Supplementary European Search Report for European Application No. 19904459.5, mailed Apr. 15, 2021, 04 Pages.
testberichte.de: "Naipo Handheld Percussion Massager with Heating (MGPC 5000)," amazon.de, 7 Pages, [Retrieved on Jun. 3, 2021] Retrieved from URL: https://www.testberichte.de/p/naipo-tests/handheld-percussion-massager-with-heating-mgpc-5000-testbericht.html, See also a YouTube Review of this Device dated May 21, 2018 at https://www.youtube.com/watch?v=bi_QCJA3D9k.
Therabody RecoveryTherm Cube. Date: Aug. 24, 2023. [online]. [Site visited Mar. 4, 2024]. Available from Internet URL: https://www.amazon.com/dp/B0C91 DPXSV/ (Year: 2023).
Therabody: "RecoveryTherm Hot and Cold Vibration Knee," Accessed on Jan. 30, 2023, 03 Pages, Retrieved from URL: https://www.

(56) References Cited

OTHER PUBLICATIONS therabody.com/us/en-us/recoverytherm-knee-massager-compression.htmlcgid=therabody-recovery-devices#start=1.
Therabody: "RecoveryTherm Hot Vibration Back and Core Wrap for Athletes—Advanced Hot Vibration for Back Pain Relief Wrap with Cryothermal Technology—One Size Fits All," Accessed on Jan. 30, 2023, 02 Pages, Retrieved from URL: https://www.therabody.com/us/en-us/recoverytherm-core-lower-back-massager-compression.html?cgid=therabody-recovery-devices#start=1.
Therabody., "Therabody_RecoveryTherm Back", Earliest Review Date: Oct. 5, 2022. https://www.therabody.com/us/en-us/recoverytherm-core-lower-back-massager-compression.html?cgid=products#start=1 (Year: 2022).
Visual Description of Hyper Ice, Inc. Raptor Device, "Osteopatia Haidy Ortale—Raptor Massage," available at: https://www.youtube.com/watch?v=plyW8FBowVs (last visited Feb. 15, 2023); 1 page.
Visual Description of Hyper Ice, Inc. Raptor Device, "Raptor Solutions 1.3 Prone," available at: https://www.youtube.com/watch?v=6i1tRqdwPU8&t=156s (last visited Feb. 15, 2023); 1 page.
Worx Trans4mer "Safety and Operating Manual Original Instructions" for 12V Li-Ion Multipurpose saw, WX540, NX540.3, WX540.9, 16 pages (2013).
Youtube: "Therabody RecoveryTherm Knee Sleeve Review—Hot, Cold, Vibration," Published on Dec. 22, 2022, 01 Page, Retrieved from URL: https://www.youtube.com/watch?v=-dHbFc_LJfw.
Youtube: "Unboxing: Joy-Con & Pro Controller Charging Dock for Nintendo Switch," Crusherbad64, Especially demonstration 8:30-8:55, (This reference is Being Used to Show Greater Details of Product not Clearly Disclosed in 'PowerA'), Feb. 26, 2018, Retrieved from entire document, 1 Page.

* cited by examiner

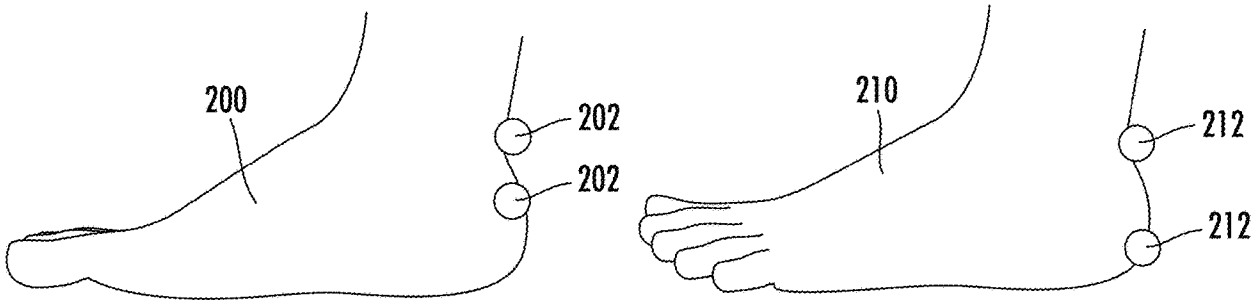
FIG. 6A
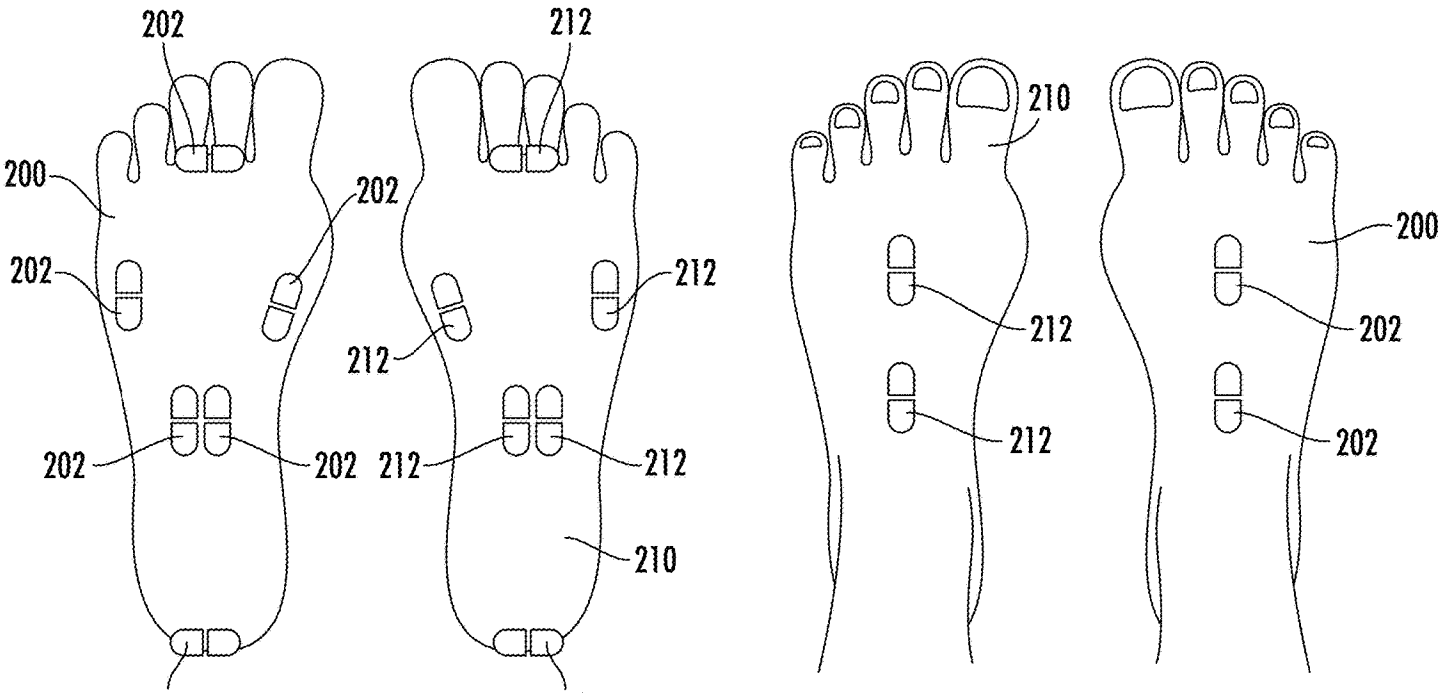
FIG. 6B
FIG. 6C

ARTICLES OF FOOTWEAR HAVING THERAPEUTIC ASSEMBLIES

RELATED APPLICATIONS

This application claims the benefit of U.S. provisional patent application 63/508,249, filed Jun. 14, 2023, titled "Articles of Footwear having a Vibration Assembly," the entirety of the disclosure of which is hereby incorporated herein by this reference.

TECHNICAL FIELD

This disclosure relates to articles of footwear, such as slides, that include one or more therapeutic assemblies, and more particularly to articles of footwear that provide targeted vibration and/or targeted light therapy to areas of a user's foot.

BACKGROUND

Athletes and other individuals sometimes desire to use massage and therapeutic devices to warm up their muscles before working out and/or to recover after working out. Generic massage and therapeutic devices may not be ideal for a particular body part or muscle. Moreover, it can be time consuming to use a massage and therapeutic device for multiple body parts or muscles.

SUMMARY

An article of footwear for warm-up, active recovery, and treatment of pain is provided according to some embodiments. The article of footwear may include a sole and a light therapy system coupled to the sole. In some embodiments, the light therapy system includes a plurality of LEDs. In some embodiments, the article of footwear includes a battery to power the light therapy system and control circuity configured to control the light therapy system.

In some embodiments, the article of footwear also includes a transparent layer disposed above the sole. In some embodiments, the plurality of LEDs is disposed between the transparent layer and the sole. In some embodiments, the article of footwear also includes a layer disposed above the sole. In some embodiments, the layer defines holes. In some embodiments, the article of footwear includes a transparent cover disposed in each hole. In some embodiments, each of the plurality of LEDs is aligned with one of the transparent covers. In some embodiments, the plurality of LEDS is arranged in a plurality of rows.

In some embodiments, the article of footwear also includes a mounting layer disposed above the sole and a plurality of vibrating motors coupled to the mounting layer. In some embodiments, the battery is configured to power the plurality of vibrating motors and the control circuitry is configured to control the plurality of vibrating motors. In some embodiments, the mounting layer includes pockets. In some embodiments, each pocket is configured to receive a motor and each of the plurality of motors is disposed in one of the pockets. In some embodiments, the plurality of LEDs is disposed between the mounting layer and the sole. In some embodiments, the mounting layer defines a plurality of holes. In some embodiments, each hole is aligned with one of the plurality of LEDs. In some embodiments, a bottom surface of the mounting layer defines a cavity configured to receive the plurality of LEDs.

In some embodiments, the article of footwear also includes a bracket disposed above the sole. In some embodiments, the bracket is configured to support the plurality of LEDs. In some embodiments, the bracket includes a longitudinal section and a plurality of transverse sections. In some embodiments, the battery is configured to be recharged with a wireless charging device.

An article of footwear for warm-up and active recovery is provided according to some embodiments. The article of footwear may include a sole, a vibration system coupled to the sole, a light therapy system coupled to the sole, a battery to power the vibration system and the light therapy system, and control circuity to control the vibration system and the light therapy system. In some embodiments, the vibration system includes a plurality of motors. In some embodiments, the light therapy system includes a plurality of LEDs.

In some embodiments, the article of footwear also includes a mounting layer disposed above the sole. In some embodiments, the mounting layer has pockets, and each pocket can receive a motor. In some embodiments, each of the plurality of motors is disposed in one of the pockets and is configured to vibrate. In some embodiments, the mounting layer defines a plurality of holes. In some embodiments, each hole is aligned with one of the plurality of LEDs. In some embodiments, the plurality of LEDs is disposed between the mounting layer and the sole. In some embodiments, a bottom surface of the mounting layer defines a cavity configured to receive the plurality of LEDs. In some embodiments, the battery and the control circuitry are part of a control assembly and are disposed in a protective housing. In some embodiments, a bottom surface of the mounting layer defines a cavity configured to receive at least a portion of the control assembly.

In some embodiments, the article of footwear also includes a bracket disposed above the sole and configured to support the plurality of LEDs. In some embodiments, the bracket includes a longitudinal section and a plurality of transverse sections. In some embodiments, the article of footwear also includes a plurality of transparent covers. In some embodiments, each transparent cover is disposed within one of the plurality of holes of the mounting layer. In some embodiments, the plurality of LEDs is disposed between the bracket and the plurality of transparent covers. In some embodiments, the battery is configured to be recharged with a wireless charging device. In some embodiments, the article of footwear is a slide. In some embodiments, the plurality of motors includes a first motor disposed in a forefoot region of the article of footwear. In some embodiments, the plurality of motors includes a second motor disposed in a midfoot region of the article of footwear. In some embodiments, the plurality of motors includes a third motor disposed between the midfoot region and a rearfoot region of the article of footwear.

An article of footwear is provided according to some embodiments. The article of footwear may include a sole, a mounting layer coupled with the sole, a plurality of motors, a protective housing coupled to the mounting layer that contains a battery and control circuitry, and a switch coupled to the control circuitry and configured to turn the motors on and off. In some embodiments, the mounting layer has pockets with each pocket being configured to receive a motor. In some embodiments, each motor is disposed in one of the pockets and is configured to vibrate. In some embodiments, the battery is configured to power the motors and the control circuitry is configured to control the motors.

In some embodiments, the article of footwear is a slide. In some embodiments, the article of footwear also includes one or more cables coupling the control circuitry and the plurality of motors. In some embodiments, the plurality of motors are eccentric rotating mass vibrating motors. In some embodiments, the plurality of motors includes five motors. In some embodiments, the plurality of motors includes at least one motor disposed in a forefoot region of the sole, at least two motors disposed in a midfoot region of the sole, and at least two motors disposed in a rearfoot region of the sole.

In some embodiments, the pockets are disposed on a bottom of the mounting layer. In some embodiments, the pockets include five pockets. In some embodiments, the mounting layer is silicone. In some embodiments, the switch includes a button. In some embodiments, the button is disposed on an interior of the article of footwear. In some embodiments, the button is disposed such that a user's foot can operate the switch while wearing the article of footwear.

In some embodiments, the switch is configured to transition between operating modes of the motors. In some embodiments, the operating modes includes different speeds of vibration. In some embodiments, the operating modes include different patterns of vibration. In some embodiments, the article of footwear also includes a charging port configured to receive a charger to charge the battery. In some embodiments, the protective housing is disposed in a foot arch section of the sole. In some embodiments, the battery is rechargeable. In some embodiments, the one or more cables includes three sets of cables. In some embodiments, the article of footwear also includes a strap coupled to the sole. In some embodiments, the strap extends from a lateral side of the sole to a medial side of the sole such that an area between the strap and the sole is configured to receive a wearer's foot. In some embodiments, the article of footwear is injection molded.

In some embodiments, a top surface of the sole comprises cavities. In some embodiments, the cavities include a cavity for each of the plurality of motors. In some embodiments, the cavities include a cavity for the protective housing.

An article of footwear for warm-up and active recovery is provided according to some embodiments. The article of footwear may include a sole and a vibration system coupled to the sole. In some embodiments, the vibration system includes a plurality of vibrating motors, a battery, control circuitry, and a switch. In some embodiments, the vibration system includes three vibration zones.

In some embodiments, the three vibration zones include a front vibration zone having at least one vibrating motor of the plurality of vibrating motors disposed in a forefoot region of the sole. In some embodiments, the three vibration zones include a middle vibration zone having at least two vibrating motors of the plurality of vibrating motors disposed in a midfoot region of the sole. In some embodiments, the three vibration zones include a back vibration zone having at least two vibrating motors of the plurality of vibrating motors disposed in a rearfoot region of the sole. In some embodiments, the plurality of vibrating motors is at least partially embedded within the sole. In some embodiments, the article of footwear also includes a mounting layer coupled to the sole. In some embodiments, the mounting layer includes a plurality of pockets. In some embodiments, each of the plurality of vibrating motors is disposed in one of the plurality of pockets.

A slide is provided according to some embodiments. The slide may include a sole, a strap coupled to the sole that extends from a lateral side of the sole to a medial side of the sole such that an area between the strap and the sole is configured to receive a wearer's foot, and a vibration system that is coupled to the sole. In some embodiments, the vibration system includes a plurality of vibrating motors, a battery, control circuitry, and a switch.

The foregoing and other aspects, features, and advantages will be apparent from the DESCRIPTION and DRAWINGS, and from the CLAIMS if any are included.

BRIEF DESCRIPTION OF THE DRAWINGS

Implementations will hereinafter be described in conjunction with the appended and/or included DRAWINGS.

FIGS. 6A-6C show potential areas of a user's foot that can be targeted for vibration therapy according to some embodiments.

DETAILED DESCRIPTION

Figure 1:
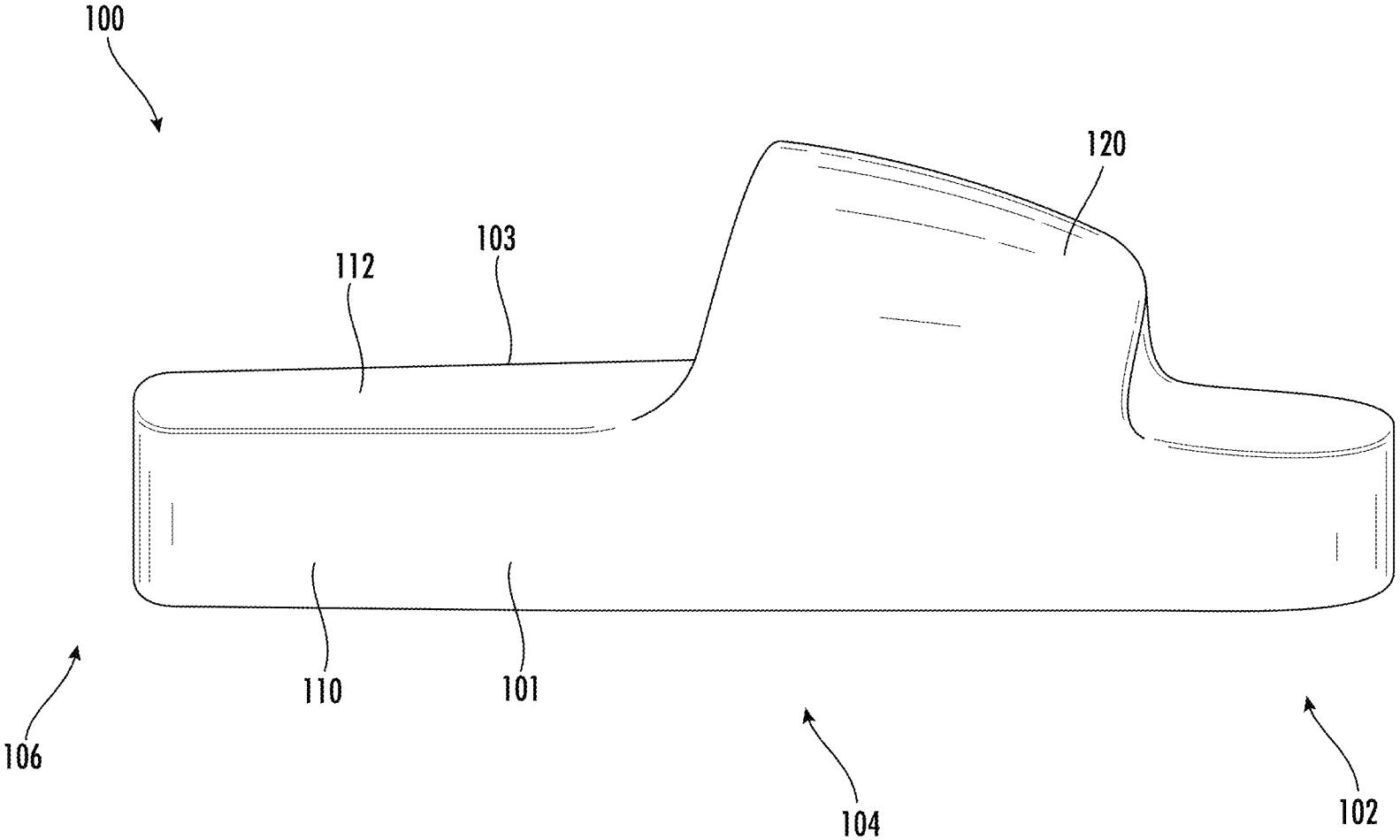
FIG. 1 shows a side perspective view of an article of footwear having a vibration assembly according to some embodiments.

Detailed aspects and applications of the disclosure are described below in the following drawings and detailed description of the technology. Unless specifically noted, it is intended that the words and phrases in the specification and the claims be given their plain, ordinary, and accustomed meaning to those of ordinary skill in the applicable arts.

In the following description, and for the purposes of explanation, numerous specific details are set forth in order to provide a thorough understanding of the various aspects of the disclosure. It will be understood, however, by those skilled in the relevant arts, that embodiments of the technology disclosed herein may be practiced without these specific details. It should be noted that there are many different and alternative configurations, devices, and technologies to which the disclosed technologies may be applied. The full scope of the technology disclosed herein is not limited to the examples that are described below.

The singular forms "a," "an," and "the" include plural referents unless the context clearly dictates otherwise. Thus, for example, reference to "a step" includes reference to one or more of such steps.

The word "exemplary," "example," or various forms thereof are used herein to mean serving as an example, instance, or illustration. Any aspect or design described herein as "exemplary" or as an "example" is not necessarily to be construed as preferred or advantageous over other aspects or designs. Furthermore, examples are provided solely for purposes of clarity and understanding and are not meant to limit or restrict the disclosed subject matter or relevant portions of this disclosure in any manner. It is to be appreciated that a myriad of additional or alternate examples of varying scope could have been presented, but have been omitted for purposes of brevity.

When a range of values is expressed, another embodiment includes from the one particular value and/or to the other particular value. Similarly, when values are expressed as approximations, by use of the antecedent "about," it will be understood that the particular value forms another embodiment. All ranges are inclusive and combinable. The term "plurality," as used herein, means more than one.

Throughout the description and claims of this specification, the words "comprise" and "contain" and variations of the words, for example "comprising" and "comprises," mean "including but not limited to," and are not intended to (and do not) exclude other components.

As required, detailed embodiments of the present disclosure are included herein. It is to be understood that the disclosed embodiments are merely exemplary of the invention that may be embodied in various forms. Therefore, specific structural and functional details disclosed herein are not to be interpreted as limits, but merely as a basis for teaching one skilled in the art to employ the present invention. The specific examples below will enable the disclosure to be better understood. However, they are given merely by way of guidance and do not imply any limitation.

The present disclosure may be understood more readily by reference to the following detailed description taken in connection with the accompanying figures and examples, which form a part of this disclosure. It is to be understood that this disclosure is not limited to the specific materials, devices, methods, applications, conditions, or parameters described and/or shown herein, and that the terminology used herein is for the purpose of describing particular embodiments by way of example only and is not intended to be limiting of the claimed inventions.

More specifically, this disclosure, its aspects and embodiments, are not limited to the specific material types, components, methods, or other examples disclosed herein. Many additional material types, components, methods, and procedures known in the art are contemplated for use with particular implementations from this disclosure. Accordingly, for example, although particular implementations are disclosed, such implementations and implementing components may comprise any components, models, types, materials, versions, quantities, and/or the like as is known in the art for such systems and implementing components, consistent with the intended operation.

The present disclosure relates to articles of footwear, such as slides, that include one or more therapeutic assemblies, and more particularly to articles of footwear that provide targeted vibration and/or targeted light therapy to areas of a user's foot. Athletes and other individuals sometimes desire to use massage and therapeutic devices to warm up their muscles before working out and/or to recover after working out. Generic massage and therapeutic devices may not be ideal for a particular body part or muscle. Moreover, it can be time consuming to use a massage and therapeutic device for multiple body parts or muscles. A massage and therapeutic device that is directed specifically to providing vibration therapy and/or light therapy to a user's foot is desirable, especially one that is incorporated into an article of footwear, such as slides.

In some embodiments, an article of footwear comprises one or more therapeutic assemblies. The one or more therapeutic assemblies may include a vibration assembly, a light therapy assembly, or both. The article of footwear may have any of the features described in U.S. Provisional Application No. 63/508,249, filed Jun. 14, 2023, which is hereby incorporated by reference in its entirety into the present disclosure. For example, the vibration assembly may include any of the features described in U.S. Provisional Application No. 63/508,249, filed Jun. 14, 2023. In some embodiments, the one or more therapeutic assemblies may share components (e.g., power source, control system, etc.).

In some embodiments, an article of footwear comprises a sole and a vibration assembly coupled to the sole. The vibration assembly may include one or more vibrating devices (e.g., vibrating motors), a battery, and control circuitry. The motors may be disposed in locations that facilitate targeted vibration to key areas of the foot, such as soft tissue structures, fascia, muscles, and regions of nerve innervation. In some embodiments, the article of footwear comprises a mounting layer for the motors, the battery, and/or the control circuitry. The mounting layer may be coupled with the sole. In some embodiments, the article of footwear comprises a switch. The switch may be configured to turn the vibrating motors on and off and/or to transition between different operating modes. In some embodiments, the article of footwear comprises a slide.

In some embodiments, an article of footwear comprises a sole and a light therapy assembly coupled to the sole. The light therapy assembly may include one or more light-emitting diodes (LEDs), a battery, and control circuitry. The LEDs may be disposed in locations that facilitate targeted light therapy to key areas of the foot, such as soft tissue structures, fascia, muscles, and regions of nerve innervation. In some embodiments, the article of footwear comprises a mounting layer (such as an insole and/or other supporting structure) for the LEDs, the battery, and/or the control circuitry. The mounting layer may be coupled with the sole. In some embodiments, the article of footwear comprises an insole configured to allow light from the LEDs to reach a wearer's foot (e.g., a transparent insole, an insole with holes aligned with the LEDs). In some embodiments, the article of footwear comprises a switch. The switch may be configured to turn the LEDs on and off and/or to transition between different operating modes. In some embodiments, the article of footwear comprises a slide.

In some embodiments, an article of footwear comprises both a vibration assembly (such as the one described above) and a light therapy assembly (such as the one described above). In some embodiments, the battery and the control circuitry may be used to control both therapeutic assemblies. In addition, the switch may be used to transition between various operating modes for both the vibration assembly and the light therapy assembly. In some embodiments, multiple switches may be used (e.g., one for each therapeutic assembly). Slides with vibration and/or light therapy and a built-in battery provide a portable, lightweight, and comfortable massage and therapeutic device that can provide targeted therapy to a wearer's feet. Such slides can be used for warm-up prior to working out and for active recovery after working out. Such slides can also be used for treatment of pain, inflammation, and joint stiffness.

In some embodiments, the sole is shaped to provide massage, myofascial release, and/or a rolling benefit to the wearer. In addition, the sole's shape, material, or density may provide energy absorption, cushioning, and/or pressure distribution that leads to a more comfortable article of footwear (e.g., resulting in less stress on a wearer's joints). Thus, the sole's shape, material, or density may contribute to the therapeutic nature of the article of footwear (e.g., therapeutic effects related to pain, stiffness, and recovery).

Embodiments of articles of footwear having one or more therapeutic assemblies are described below. Features that are discussed with respect to any embodiments below may also be used in conjunction with other embodiments, even if not expressly discussed with respect to other embodiments.

An article of footwear 100 according to some embodiments is shown, for example, in FIG. 1. Article of footwear 100 may have a forefoot region 102, a midfoot region 104, and a rearfoot region 106. Article of footwear 100 may have a lateral side 101 and a medial side 103. In some embodiments, article of footwear 100 comprises a sole 110. Article of footwear 100 may be a slide, as shown in FIG. 1. Thus, in addition to sole 110, article of footwear 100 may comprise a strap 120 coupled to sole 110. Strap 120 may be configured to extend from sole 110 at a lateral side 101 to sole 110 at a medial side 103 such that strap 120 and sole 110 together form an opening to receive a wearer's foot. In some embodiments, article of footwear 100 may be a different type of article of footwear, such as another type of sandal or a shoe with a sole and an upper section.

In some embodiments, article of footwear 100 comprises a vibration assembly. As shown, for example, in FIGS. 2-3, the vibration assembly may include one or more vibration devices 130 (e.g., motors 130) and a control assembly 140. The control assembly 140 may include a protective housing 150 containing a battery 160 and control circuitry 170 (see FIG. 3). In some embodiments, article of footwear 100 comprises a mounting layer 112 to hold one or more of the motors 130 and any of the components of the control assembly 140. These and other aspects of article of footwear 100 are discussed further below.

In some embodiments, motors 130 are vibrating motors. For example, the motors 130 may be eccentric rotating mass (ERM) vibrating motors. Other types of vibrating motors may also be used. The vibration of the motors 130 provides massage therapy to targeted areas of the wearer's foot. Local vibration has been shown to have both prophylactic and reactive benefits related to circulation, recovery, and pain. Furthermore, it has been associated with being able to help different medical conditions related to both circulatory and neurological disease states. The vibration devices 130 can include vibration frequencies of between 0-300 Hz and vibration amplitudes of between 0.5-12 mm.

In some embodiments, motors 130 are waterproof. In some embodiments, motors 130 are lightweight. For example, each motor 130 may be less than 10 grams. In some embodiments, each motor 130 may be less than 5 grams. Each motor 130 may be about 2 grams. In some embodiments, motors 130 may be designed to have minimum noise. In some embodiments, motors 130 may be pill-shaped motors. For example, motors 130 may have a diameter between 5 and 10 mm (e.g., 7 mm) and a length between 20 and 300 mm (e.g., 24.5 mm). In some embodiments, motors 130 with bigger dimensions may be used. Larger motors 130 may be beneficial in providing a stronger vibration. In some embodiments, motors 130 are coin-shaped instead of pill-shaped. Other shapes of motors 130 may also be used.

The number and placement of motors 130 may vary in different embodiments. In some embodiments, article of footwear 100 may include one to ten motors 130. For example, article of footwear 100 may include two, four, six, or eight motors. In some embodiments, article of footwear 100 includes more than ten motors 130. Motors 130 may be positioned under or adjacent to various key areas of the foot, such as soft tissue structures, fascia, muscles, and regions of nerve innervation. Target areas of the foot may include one or more of plantar fascia, lateral plantar fascia, flexor digitorum brevis tendons, flexor hallucis longus tendon, adductor hallucis, lumbricales, flexor hallucis brevis, flexor digiti minimi brevis, plantar interossei, flexor digitorum brevis, abductor hallucis, abductor digiti minimi, plantar aponeurosis, quadratus plantae, flexor digitorum longus tendons, deep peroneal nerve, superficial peroneal nerve, tibial nerve, sural nerve, medial plantar nerve, lateral plantar nerve, medial calcaneal nerve, saphenous nerve, or other structures.

Figure 2:
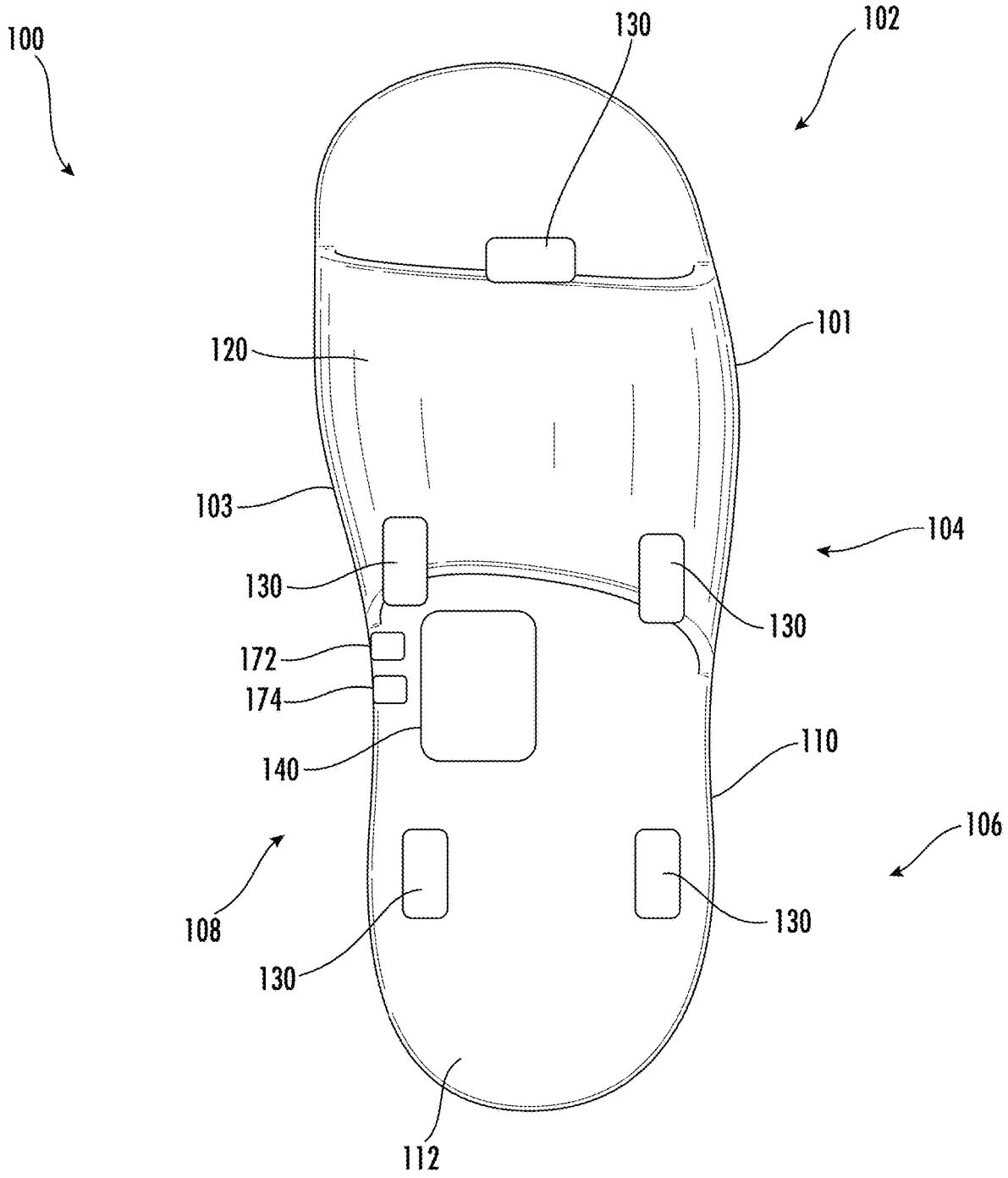
FIG. 2 shows a top schematic view of an article of footwear having a vibration assembly according to some embodiments.

As one example, FIG. 2 shows article of footwear 100 having five motors 130. FIG. 2 is drawn schematically to show approximate locations of motors 130 (and the other components of the vibration assembly) with respect to a plan view of article of footwear 100. Thus, these components would typically not be visible from a top view of article of footwear 100 but would instead be located underneath mounting layer 112 as discussed further below or otherwise embedded within sole 110. Motors 130 may include a motor 130 disposed in the forefoot region 102, two motors disposed in the midfoot region 104, and two motors 130 disposed in the rearfoot region 106.

Motors 130 may include a motor 130 disposed in the forefoot region 102, as shown in FIG. 2. For example, a motor 130 may be disposed in the forefoot region 102 such that it would be disposed underneath the ball of a wearer's foot when article of footwear 100 is worn. In some embodiments, this forefoot motor 130 may be disposed centrally between lateral side 101 and medial side 103. In some embodiments, this forefoot motor 130 may be disposed partially or entirely underneath strap 120. For example, FIG. 2 shows the forefoot motor 130 located such that a portion of the forefoot motor 130 is underneath strap 120 and a portion of the forefoot motor 130 extends past strap 120 towards a front of article of footwear 100. This forefoot motor 130 may be configured to provide massage therapy to the plantar fascia in the wearer's forefoot, superficial tendons and muscle in the forefoot (e.g., tendons of flexor digitorum brevis, flexor hallucis brevis), deep tendons and muscle in the forefoot (e.g., tendons of flexor digitorum longus, lumbricals, plantar interossei), and/or nerves in the forefoot (e.g., medial plantar nerve). Other locations of a forefoot motor 130 are also possible (e.g., to target a specific tendon, muscle, nerve, or other tissue structure). In some embodiments, multiple motors 130 may be disposed in forefoot region 102.

Motors 130 may include two motors 130 disposed in the midfoot region 104, as shown in FIG. 2. For example, a motor 130 may be disposed at a lateral side 101 of article of footwear 100 in the midfoot region 104 and another motor 130 may be disposed at a medial side 103 of article of footwear 100 in the midfoot region 104. The medial side motor 130 in the midfoot region 104 may be disposed such that it would be disposed underneath and/or adjacent to the arch of a wearer's foot when article of footwear 100 is worn. Motors 130 in the midfoot region 104 may be aligned with each other such that their positions in a longitudinal direction are lined up or they may be offset from each other. In some embodiments, the midfoot motors 130 may be disposed partially or entirely underneath strap 120. For example, FIG. 2 shows the midfoot motors 130 located such that a portion of the midfoot motors 130 are underneath strap 120 and a portion of the midfoot motors 130 extends past strap 120 towards a back of article of footwear 100. The medial midfoot motor 130 may be configured to provide massage therapy to the plantar fascia in the wearer's medial midfoot, superficial tendons and muscle in the medial midfoot (e.g., flexor hallucis brevis, abductor hallucis), deep tendons and muscle in the medial midfoot (e.g., tendons of tibialis posterior and flexor hallucis longus, flexor hallucis brevis), and/or nerves in the medial midfoot (e.g., medial plantar nerve, saphenous nerve). The lateral midfoot motor 130 may be configured to provide massage therapy to the plantar fascia in the wearer's lateral midfoot, superficial tendons and muscle in the lateral midfoot (e.g., flexor digiti minimi brevis, abductor digiti minimi), deep tendons and muscle in the lateral midfoot (e.g., tendons of fibularis brevis and fibularis longus), and/or nerves in the lateral midfoot (e.g., lateral plantar nerve, sural nerve). Other locations of midfoot motors 130 are also possible (e.g., to target a specific tendon, muscle, nerve, or other tissue structure). In some embodiments, a different number of motors 130 may be disposed in midfoot region 104 (such as only one motor 130 or more than two).

Motors 130 may include two motors 130 disposed in the rearfoot region 106, as shown in FIG. 2. For example, a motor 130 may be disposed at a lateral side 101 of article of footwear 100 in the rearfoot region 106 and another motor 130 may be disposed at a medial side 103 of article of footwear 100 in the rearfoot region 106. The medial side motor 130 in the rearfoot region 106 may be disposed such that it would be disposed underneath and/or adjacent to the heel of a wearer's foot when article of footwear 100 is worn. Motors 130 in the rearfoot region 106 may be aligned with each other such that their positions in a longitudinal direction are lined up or they may be offset from each other. The medial rearfoot motor 130 may be configured to provide massage therapy to the plantar fascia in the wearer's medial rearfoot, superficial tendons and muscle in the medial rearfoot (e.g., flexor hallucis brevis, abductor hallucis), deep tendons and muscle in the medial rearfoot (e.g., tendons of tibialis posterior and flexor hallucis longus, flexor hallucis brevis, quadrates plantae), and/or nerves in the medial rearfoot (e.g., tibial nerve, saphenous nerve). The lateral rearfoot motor 130 may be configured to provide massage therapy to the plantar fascia in the wearer's lateral rearfoot, superficial tendons and muscle in the lateral rearfoot (e.g., flexor digiti minimi brevis, abductor digiti minimi, plantar aponeurosis), deep tendons and muscle in the lateral rearfoot (e.g., tendons of fibularis brevis and fibularis longus), and/or nerves in the lateral rearfoot (e.g., tibial nerve, sural nerve). Other locations of rearfoot motors 130 are also possible (e.g., to target a specific tendon, muscle, nerve, or other tissue structure). In some embodiments, a different number of motors 130 may be disposed in rearfoot region 106 (such as only one motor 130 or more than two).

As already noted above, article of footwear 100 may have a different number of motors 130 and may use different locations for motors 130 other than those discussed above and shown in FIG. 2. In some embodiments, motors 130 may be placed to have different vibration zones. For example, the vibration assembly may provide two or more vibration zones. In some embodiments, the vibration zones may include a front vibration zone (e.g., a vibration zone provided by motor(s) 130 in forefoot region 102), a middle vibration zone (e.g., a vibration zone provided by motor(s) 130 in midfoot region 104), and a back vibration zone (e.g., a vibration zone provided by motor(s) 130 in rearfoot region 106). In some embodiments, control assembly 140 may be configured to allow each vibration zone to be turned on individually or together with one or more of the other vibration zones.

Figure 3:
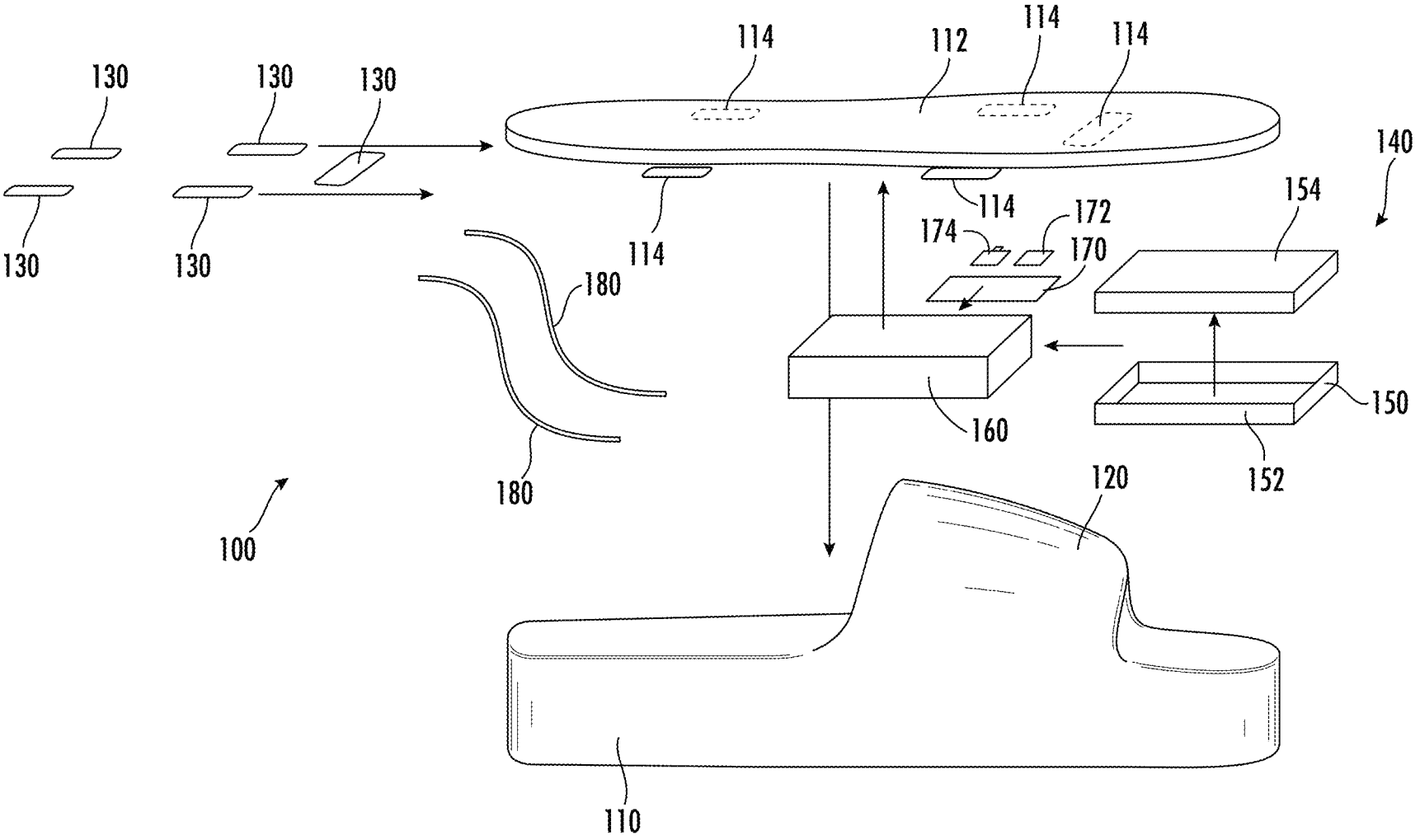
FIG. 3 shows a schematic of disassembled components of an article of footwear having a vibration assembly according to some embodiments.

In some embodiments, motors 130 are coupled to mounting layer 112, as shown, for example, in FIG. 3. Mounting layer 112 may include one or more pockets 114. Each pocket 114 may be configured to receive a motor 130. Thus, the number of pockets 114 on mounting layer 112 may be the same as the number of motors 130 discussed above. For example, mounting layer 112 may include five pockets 114. In addition, the location of pockets 114 on mounting layer 112 and with respect to the rest of article of footwear 100 may be the same as the locations of motors 130 discussed above. In some embodiments, pockets 114 are disposed on a bottom of mounting layer 112. Other components of the vibration assembly may also be coupled to mounting layer 112. In some embodiments, the other components of the vibration assembly may be disposed underneath mounting layer 112 (e.g., embedded in a material of sole 110 or disposed in a cavity of sole 110 without any bonding connection to mounting layer 112).

Mounting layer 112 may be rigid enough to be durable but flexible to minimize noise of motors 130. Various thicknesses of mounting layer 112 may be used (e.g., depending on the material of mounting layer 112). Mounting layer 112 may be thin enough such that the vibration of motors 130 is felt by a wearer (so that the massage therapy is effective), while being thick enough to provide a reliable mounting structure for motors 130. In some embodiments, mounting layer 112 is made of silicone. Other materials may also be used for mounting layer 112 (e.g., rubber, foam, etc.). In some embodiments, mounting layer 112 provides a soft material to be in contact with the wearer's foot (e.g., silicone, rubber, foam, etc.). In some embodiments, mounting layer 112 may be a plastic structure to support motors 130 with a soft material covering a top of mounting layer 112 to provide a soft surface to be in contact with the wearer's foot. In some embodiments, mounting layer 112 is coupled to sole 110. The connection of mounting layer 112 to sole 110 may be any flexible, reliable, and waterproof connection. In some embodiments, mounting layer 112 is coupled to sole 110 using contact cement. In some embodiments, mounting layer 112 is glued to sole 110. In some embodiments, mounting layer 112 is stitched to sole 110. In some embodiments, mounting layer 112 is an additional layer that is added to sole 110. For example, sole 110 may provide a hollow center surrounded by external surfaces forming sole 110, and mounting layer 112 may be attached to sole 110 in the hollow center. In some embodiments, mounting layer 112 may be covered either from a top or bottom to enclose mounting layer 112 within sole 110.

In some embodiments, a top surface of mounting layer 112 forms a top surface of sole 110 on which a wearer's foot may rest. In some embodiments, a different material is disposed above mounting layer 112 to form a top surface of sole 110. In some embodiments, article of footwear 100 does not include a mounting layer 112. For example, the components of the vibration assembly (e.g., motors 130 and components of control assembly 140, etc.) may be embedded within a material of sole 110 without using a mounting layer 112.

Control assembly 140 is configured to power and control motors 130 to provide massage therapy. In some embodiments, control assembly 140 may be disposed in an arch region 108 of article of footwear 100 (i.e., a region that corresponds to an arch of the wearer's foot when article of footwear 100 is worn), as shown in FIG. 2. Control assembly 140 may include protective housing 150 containing a battery 160 and control circuitry 170 (see FIG. 3). Control assembly 140 may also include cabling 180 coupling control circuitry 170 to motors 130.

In some embodiments, control circuitry 170 is configured to control operation of motors 130. For example, control circuitry 170 may control the voltage provided to motors 130 to turn the motors on and off and/or to transition between different operating modes (vibration speeds, vibration patterns (e.g., vibration frequencies, intensities, or durations) vibration zones, etc.). In some embodiments, control circuitry 170 may also control the charging of battery 160. In some embodiments, control circuitry 170 may comprise a printed circuit board. Control circuitry 170 may be contained within protective housing 150.

In some embodiments, a charging port 172 is coupled to control circuitry 170. Charging port 172 may be configured to receive a charger to charge battery 160. In some embodiments, charging port 172 is a USB-C port. Other types of ports may also be used for charging port 172. Charging port 172 may be accessible from an exterior of article of footwear 100. For example, charging port 172 may be disposed on an exterior wall of medial side 103 of sole 110, such as at arch region 108 (see FIG. 2). In some embodiments, charging port 172 is supported and/or contained by protective housing 150.

In some embodiments, a switch 174 is coupled to control circuitry 170. Switch 174 is configured to turn motors 130 on and off. For example, a wearer may use switch 174 to turn motors 130 on and off. In some embodiments, switch 174 is also configured to transition between operating modes of motors 130. The operating modes may be different speeds of vibration, different patterns of vibration, or both. In some embodiments, the operating modes may include three different speeds. As one example, a first operation of the switch 174 may turn motors 130 on at a high speed, a second operation of switch 174 may change the motors to a medium speed, a third operation of switch 174 may change the motors to a low speed, and a fourth operation of switch 174 may turn the motors off. In addition, the operating modes may include different vibration zones. As one example, a user may first operate switch 174 to turn all motors 130 on, then to turn only a front vibration zone on (with the others off), then to turn only a middle vibration zone on (with the others off), then to turn only a back vibration zone on (with the others off), and then to turn all motors 130 off. Any other operating modes may also be used with the switch 174 allowing for a user to transition between any such operating modes. In some embodiments, multiple switches 174 may be included.

In some embodiments, switch 174 may be a button 174 (e.g., a button that is pushed to operate). In some embodiments, button 174 is disposed on an interior of article of footwear. For example, button 174 may be disposed such that a user's foot can operate button 174 while wearing article of footwear 100. Switch 174 may be located at medial side 103 in arch region 108 (see FIG. 2). Other locations may also be used. In some embodiments, switch 174 is supported and/or contained by protective housing 150. In some embodiments, switch 174 may include multiple buttons 174 located in different areas of the article of footwear 100.

In some embodiments, battery 160 is configured to power motors 130. In some embodiments, battery 160 is a rechargeable battery. For example, battery 160 may be a lithium-ion battery, such as a lithium-polymer battery. In some embodiments, battery 160 is configured to operate on a single charge for a run time of between one and six hours (e.g., two hours).

In some embodiments, protective housing 150 contains battery 160 and control circuitry 170. In some embodiments, protective housing 150 also contains charging port 172 and switch 174. Protective housing 150 may be made of plastic, such as polycarbonate, acrylonitrile butadiene styrene, polyamide, or some other plastic material. Any other waterproof material may also be used. In some embodiments, protective housing 150 comprises a lower section 152 and an upper section 154. Lower section 152 and upper section 154 may be joined together such that protective housing 150 is waterproof. For example, lower section 152 and upper section 154 may be joined using ultrasonic welding. In some embodiments, protective housing 150 may comprise connection points for cabling 180 to allow cabling 180 to electrically couple to control circuitry 170 inside protective housing 150.

In some embodiments, cabling 180 comprises one or more cables that couple the motors 130 to control circuitry 170 (and thus battery 160). In some embodiments, cabling 180 is waterproof. Cabling 180 may be connected to motors 130 and to control circuity 170 by being soldered.

Figure 4:
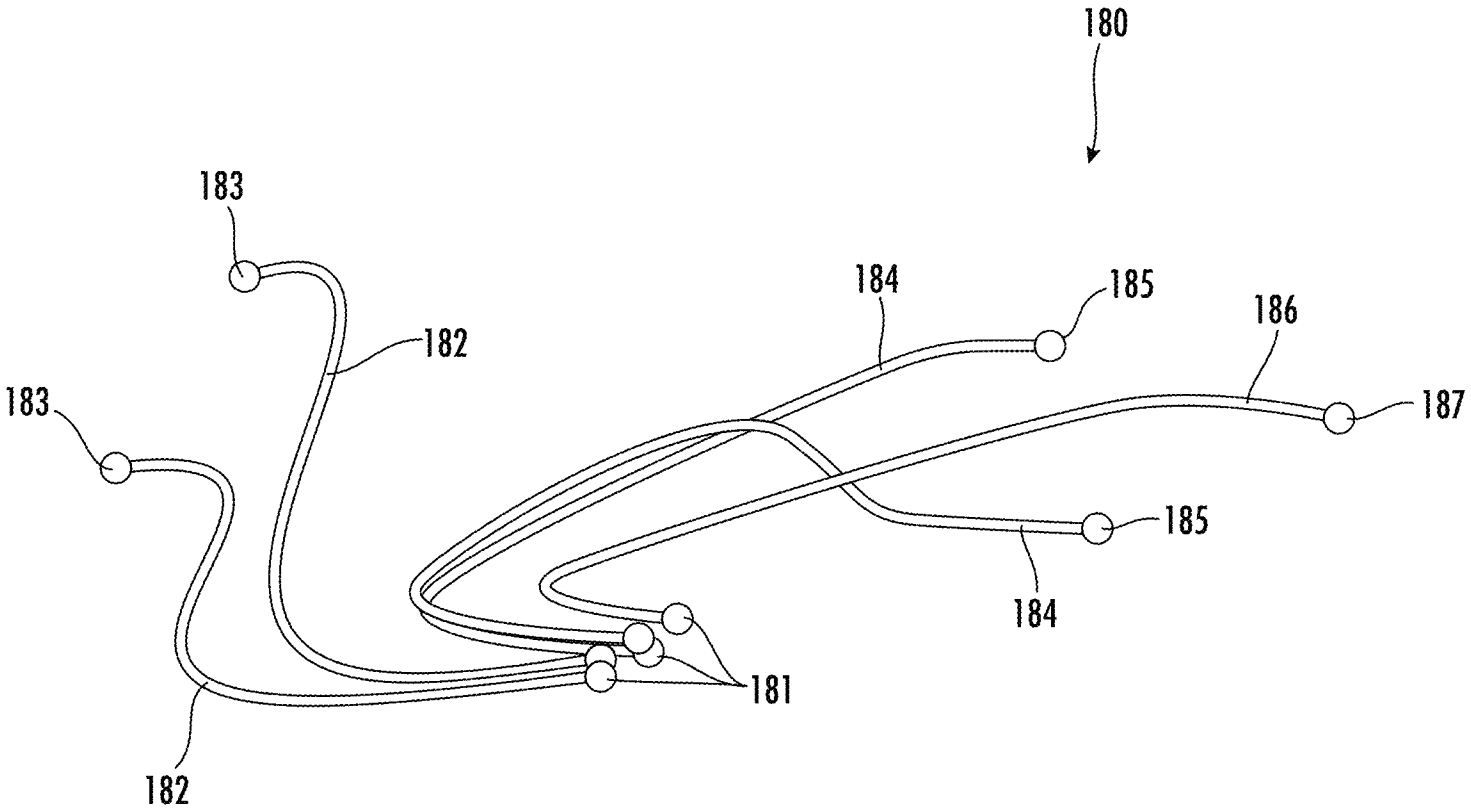
FIG. 4 shows a schematic of cabling for an article of footwear having a vibration assembly according to some embodiments.

Cabling 180 may include three sets of cables, as shown, for example, in FIG. 4. The different sets of cables may correspond to vibration zones. Thus, a different number of sets of cables may also be used. In FIG. 4, the three sets of cables comprise a first set of two cables 182, a second set of two cables 184, and a third set of cables (having only one cable 186). Each cable 182, 184, 186 extends from connection points 181 at protective housing 150 and/or control circuitry 170 to respective connection points at motors 130. In some embodiments, the first set of cables 182 may correspond to a back vibration zone and thus be connected to rearfoot motors 130 at connection points 183. In some embodiments, the second set of cables 184 may correspond to a middle vibration zone and thus be connected to midfoot motors 130 at connection points 185. In some embodiments, cable 186 may correspond to a front vibration zone and thus be connected to forefoot motor 130 at connection point 187.

Sole 110 may provide the main structure for article of footwear 100. In some embodiments, the shape of sole 110 contributes to article of footwear 100 being a therapeutic device. For example, sole 110 may be shaped to provide massage to a wearer's foot while article of footwear 100 is being worn. Sole 110 may be shaped to facilitate myofascial release while a wearer is walking in article of footwear 100. For example, sole 110 may provide a rolling benefit. In some embodiments, a shape of an external surface of mounting layer 112 (e.g., the surface facing the wearer's foot) may be shaped to provide massage, myofascial release, and/or rolling benefits. The shape of the external surface of mounting layer 112 may also be shaped to provide support for different areas of a wearer's foot.

In some embodiments, sole 110 is configured to provide energy absorption, cushioning, and pressure distribution that increases the comfort for the wearer while using article of footwear 100. For example, a shape, material, and/or density of sole 110 may be selected that lead to better energy absorption, cushioning, and pressure distribution, thus leading to a more comfortable experience. In some embodiments, for example, sole 110 may provide additional support under the wearer's foot arch.

In some embodiments, sole 110 may be made of polyurethane or ethyl-vinyl acetate. In some embodiments, sole 110 may be made of a foam material. Strap 120 may be made of the same material as sole 110. Sole 110 may be made using a variety of manufacturing methods. In some embodiments, sole 110 is injection molded. In some embodiments, strap 120 and sole 110 are molded with a single injection. In some embodiments, strap 120 is manufactured separately from sole 110 and then the two may be joined together. In some embodiments, sole 110 and/or strap 120 are 3D printed. In some embodiments, sole 110 (or the external-facing side of mounting layer 112) may include a conductive material that is electrically grounded (e.g., by a wired connection to ground in control circuitry 170) to provide a grounding or earthing effect to the wearer of the article of footwear 100 when the wearer's foot is in contact with the conductive material. In some embodiments, the grounding effect provided by the conductive material may provide therapeutic benefits to the wearer, such as reducing inflammation and pain and promoting wound healing. In some embodiments, the conductive material may be located in any region of article of footwear 100, such as forefoot region 102, a midfoot region 104, and/or a rearfoot region 106.

Figure 5:
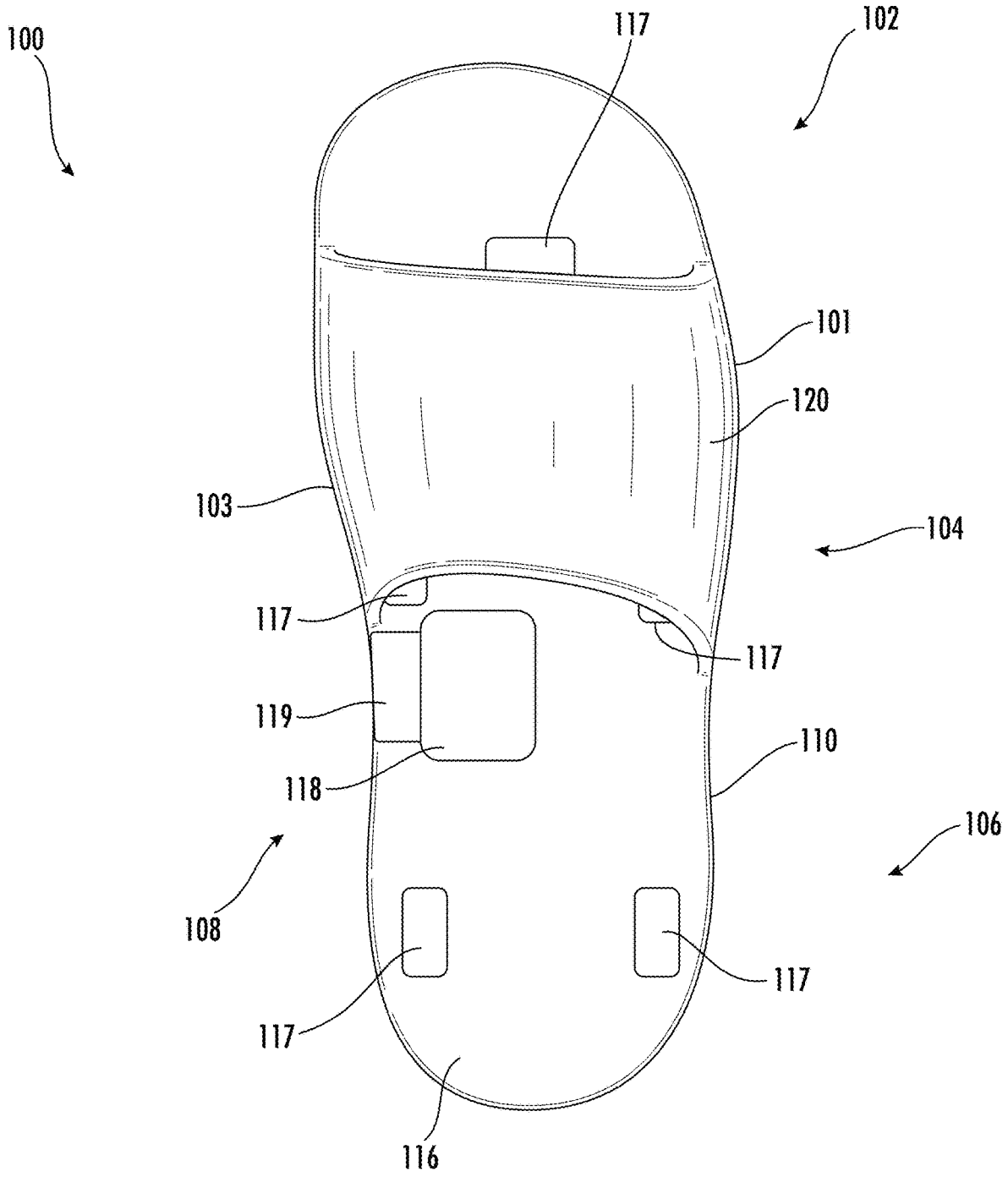
FIG. 5 shows a top view of an article of footwear (with the vibration assembly removed) according to some embodiments.

In some embodiments, sole 110 may be configured to accommodate components of the vibration system. For example, sole 110 may comprise a surface 116 (as shown in FIG. 5) that defines a plurality of cavities sized and shaped to receive components of the vibration system. Surface 116 may be a top surface of the material that makes up sole 110. Thus, the cavities may be formed during the injection molding process. In some embodiments, surface 116 defines motor cavities 117 configured to receive motors 130. For example, motors 130 may be disposed within pockets 114 of mounting layer 112 and the pockets 114 and motors 130 may be fully or partially disposed within motor cavities 117. Thus, the number of motor cavities in surface 116 of sole 110 may be the same as the number of motors 130 discussed above. For example, surface 116 may define five motor cavities 117. In addition, the location of motor cavities 117 on surface 116 may be the same as the locations of motors 130 discussed above.

In some embodiments, surface 116 defines protective housing cavity 118. Protective housing cavity 118 may be disposed in arch region 108 of sole 110. Protective housing cavity 118 is configured to receive protective housing 150. In some embodiments, surface 116 defines a cavity 119 configured to receive charging port 172 and switch 174. Cavity 119 may be disposed in arch region 108 of sole 110. For example, cavity 119 may be disposed adjacent to protective housing cavity 118.

Many additional implementations are possible. For example, although FIGS. 1-3 and 5 show article of footwear 100 as a slide, other articles of footwear may also be used. In addition, although FIGS. 1-3 and 5 show particular number and locations of motors 130, other variations may be used. For example, FIGS. 6A-6C illustrate other potential areas of a wearer's feet that may be targeted with vibrating motors for massage therapy using slides or other articles of footwear. FIG. 6A shows target areas 202 on a right foot 200 of a wearer and target areas 212 on a left foot of a wearer in a side view. FIG. 6B shows target areas 202 on a right foot 200 of a wearer and target areas 212 on a left foot of a wearer in a bottom or plantar view. FIG. 6C shows target areas 202 on a right foot 200 of a wearer and target areas 212 on a left foot of a wearer in a top or dorsal view.

Figure 7C:
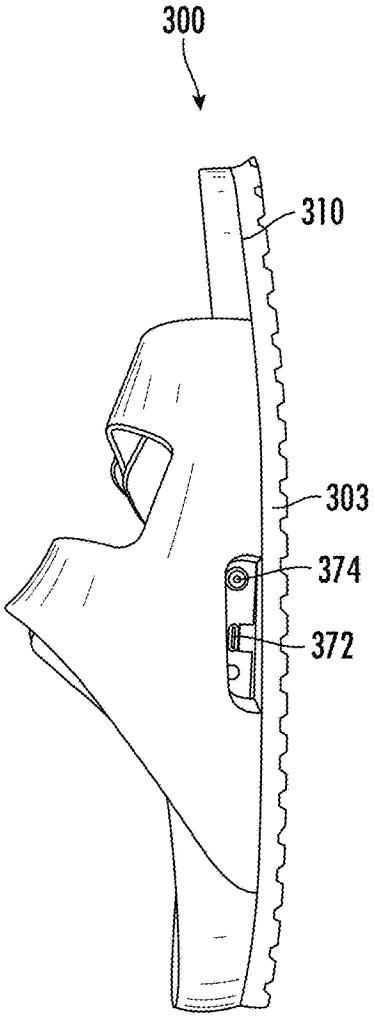
FIG. 7C shows a side view of an article of footwear having therapeutic assemblies according to some embodiments.
Figure 7B:
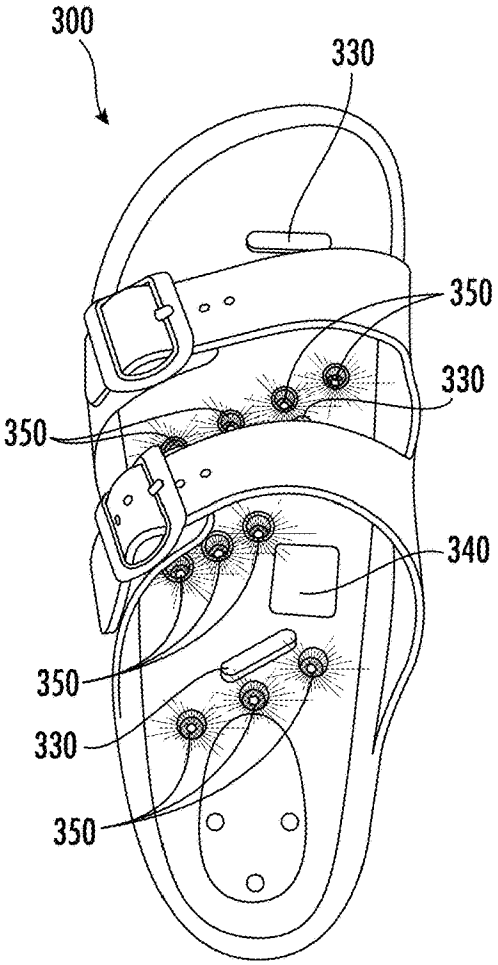
FIG. 7B shows a top view of an article of footwear having therapeutic assemblies according to some embodiments.
Figure 7A:
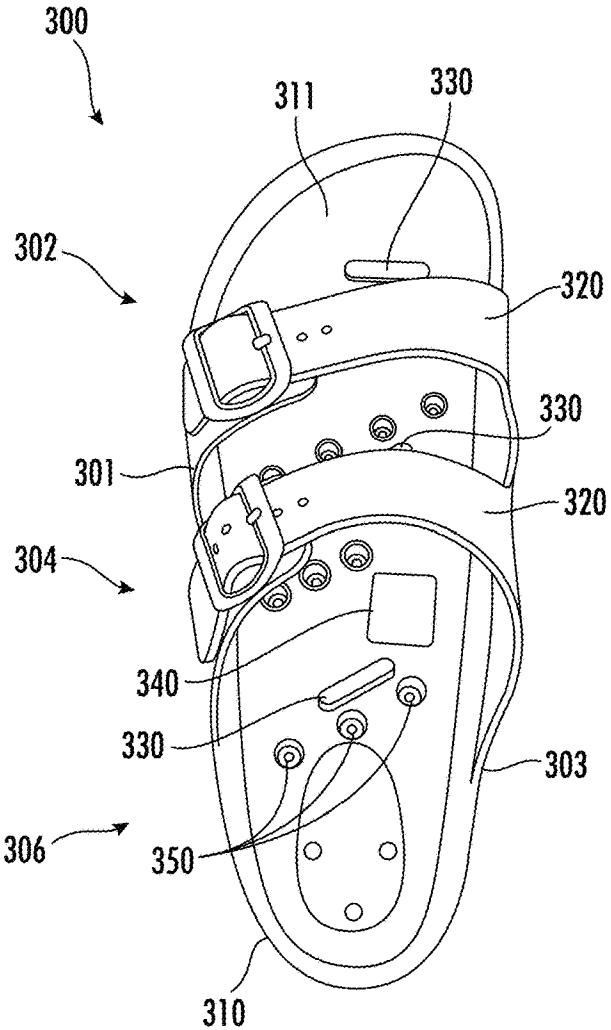
FIG. 7A shows a top view of an article of footwear having therapeutic assemblies according to some embodiments.

In some embodiments, an article of footwear may include a light therapy assembly in addition to or instead of a vibration assembly. For example, an article of footwear 300 according to some embodiments is shown in FIGS. 7A-7C having both a light therapy assembly and a vibration assembly. Features discussed with respect to article of footwear 100 above may also be implemented as part of article of footwear 300. Similarly, features discussed with respect to article of footwear 300 below may also be implemented as part of article of footwear 100. In addition, while article of footwear 300 comprises both a light therapy assembly and a vibration assembly, in some embodiments, an article of footwear comprises a light therapy assembly (such as the one discussed with respect to article of footwear 300) and does not include a vibration assembly.

Article of footwear 300 may have a forefoot region 302, a midfoot region 304, and a rearfoot region 306. Article of footwear 300 may have a lateral side 301 and a medial side 303. In some embodiments, article of footwear 300 comprises a sole 310. Article of footwear 300 may be a slide, as shown in FIGS. 7A-7C. Thus, in addition to sole 310, article of footwear 300 may comprise a strap 320 coupled to sole 310. In some embodiments, article of footwear 300 may include multiple straps 320 (e.g., two straps 320). Strap(s) 320 may be configured to extend from sole 310 at lateral side 301 to sole 310 at medial side 303 such that strap(s) 320 and sole 310 together form an opening to receive a wearer's foot. In some embodiments, each strap 320 may comprise two parts, one extending from lateral side 301 of sole 310 and one extending from medial side 303 of sole 310. The two parts may fasten together to form strap 320. For example, the two parts may fasten with a buckle system (see FIGS. 7A-7B), a hook and loop system, a button system, a snap system, or other fastening systems. In some embodiments, article of footwear 300 may be a different type of article of footwear, such as another type of sandal or a shoe with a sole and an upper section. In some embodiments, the article of footwear 300 may include a fastening system and/or fastening mechanism that allows the footwear to be secured onto a wearer's foot. In some embodiments, the shoe's fastening mechanism may allow the footwear 300 to be adjusted or tightened properly to ensure a better fit for the wearer's foot, and to ensure an efficient delivery of the therapeutic treatment (e.g., light therapy and/or vibration therapy) to the wearer's foot.

In some embodiments, article of footwear 300 comprises a vibration assembly, which may have the features discussed above with respect to article of footwear 100, and a light therapy assembly. FIG. 7A shows article of footwear 300 with light therapy assembly turned off while FIG. 7B shows article of footwear 300 with light therapy assembly turned on. In some embodiments, a top layer 311 of article of footwear 300 is transparent. For example, top layer 311 may be made of a transparent material (e.g., transparent silicone). Configuring top layer 311 to be transparent facilitates light therapy for a wearer's foot from devices within article of footwear 300, such as LEDs.

Referring again to FIG. 7A, article of footwear 300 comprises a control assembly 340. Control assembly 340 is disposed below top layer 311 (e.g., coupled to a mounting layer as discussed above). In some embodiments, control assembly 340 is visible through transparent top layer 311, as shown in FIGS. 7A and 7B. Control assembly 340 is configured to power and control the vibration assembly and the light therapy assembly, and control assembly 340 may include any of the features discussed above for control assembly 140. For example, control assembly 340 may be disposed in an arch region of article of footwear 300 (i.e., a region that corresponds to an arch of the wearer's foot when article of footwear 300 is worn).

In some embodiments, article of footwear 300 comprises one or more vibration devices 330 (e.g., motors 330). Motors 330 are disposed below top layer 311 (e.g., within a mounting layer as discussed above). In some embodiments, motors 330 are visible through transparent top layer 311, as shown in FIGS. 7A and 7B. In some embodiments, motors 330 may have any of the features discussed above for motors 130. In some embodiments, motors 330 have a diameter between 5 and 10 mm (e.g., 8 mm).

The number and placement of motors 330 may vary in different embodiments. In some embodiments, article of footwear comprises three motors 330. Motors 330 may include a first motor 330 in forefoot region 302 (which is shown just in front of forward strap 320 in FIGS. 7A and 7B), a second motor 330 in midfoot region 304 (which is partially shown just in front of the rearward strap 320 in FIGS. 7A and 7B), and a third motor 330 between midfoot region 304 and rearfoot region 306 (e.g., adjacent to and located rearward of control assembly 340). Each of motors 330 may be disposed anywhere between medial side 303 and lateral side 301 of article of footwear 300 (e.g., centrally, closer to medial side 303, or closer to lateral side 301). Motors 330 may be positioned to provide targeted vibration therapy to certain portions of the wearer's foot (as discussed above).

In some embodiments, article of footwear 300 comprises one or more light therapy devices 350 (e.g., light-emitting diodes (LEDs) 350). In some embodiments, article of footwear comprises between two and thirty LEDs 350, between ten and twenty LEDs 350, or between twelve and sixteen LEDs 350 (e.g., 14 LEDs 350). Different amounts of LEDs 350 (e.g., more than 30) may be used in some embodiments. The number and placement of LEDs 350 may vary in different embodiments.

LEDs 350 may provide light therapy to help heal, increase circulation, stimulate metabolic processes, regenerate muscles, tendons, bones, joints, and other tissue, thus contributing to recovery after exercise and the treatment of both acute and chronic conditions associated with pain and inflammation. Red LEDs with visible red light in the spectrum of 620-700 nm and infrared LEDs producing near infrared (NIR) of wavelengths 700-2500 nm can be used to provide specific therapeutic fluence (dose in $J/cm^2$). The therapeutic fluence is the product of a power density and treatment time that is both safe and effective in producing the physiological and neurological responses that produce the therapeutic benefit. In some embodiments, the power density of visible red light will be $<300\ mW/cm^2$ with the power density of NIR $<750\ mW/cm^2$. In some embodiments, the fluence provided to the tissues will range between 20-1000 $J/cm^2$ depending on purpose of use and intended outcomes. Visible red light can be used for therapeutic benefits and as visual feedback to the user (e.g., wearer of the article of footwear 300) to show that the device is working and producing light. LEDs 350 may be disposed in an array across article of footwear 300. In some embodiments, LEDs 350 are arranged in a number of rows (e.g., one to six rows, two to four rows, six to ten rows, etc.), with each row having two to eight LEDs 350 (e.g., three to four LEDs). Each row of LEDs 350 may span across the width of article of footwear 300. In some embodiments, LEDs 350 of each row are spaced equally apart from each other.

In some embodiments, LEDs 350 are arranged in four rows. The foremost row (e.g., the row disposed in or closest to forefoot region 302) may be disposed below forward strap 320 (similar to what is shown in FIG. 13A). The foremost row may include four LEDs 350. In some embodiments, the foremost row of LEDs 350 is disposed at an angle relative to the transverse axis of article of footwear 300. For example, LED 350 of the foremost row that is closest to lateral side 301 may be disposed rearwardly (i.e., closer to rearfoot portion 306) of LED 350 of the foremost row that is closest to medial side 303. In some embodiments, the foremost row is disposed rearwardly of motor 330 in forefoot region 302.

In some embodiments, a second row disposed adjacent to the foremost row comprises four LEDs 350, as shown in FIG. 7B. The second row of LEDs 350 may be disposed between two straps 320. The second row of LEDs 350 may be disposed in forefoot region 302, midfoot region 304, or spanning across forefoot region 302 and midfoot region 304. In some embodiments, no motors 330 are disposed between the foremost row and the second row of LEDs 350. In some embodiments, the second row of LEDs 350 is disposed at an angle relative to the transverse axis of article of footwear 300. For example, LED 350 of the second row that is closest to lateral side 301 may be disposed rearwardly (i.e., closer to rearfoot portion 306) of LED 350 of the second row that is closest to medial side 303. In some embodiments, the second row is disposed forwardly of motor 330 in midfoot region 304.

In some embodiments, a third row disposed adjacent to the second row comprises three LEDs 350, as shown in FIG. 7B. The third row of LEDs 350 may be disposed below or just behind a rearward strap 320. The third row of LEDs 350 may be disposed in midfoot region 304. In some embodiments, motor 330 in midfoot region is disposed between the second row and the third row of LEDs 350. In some embodiments, the third row of LEDs 350 is disposed at an angle relative to the transverse axis of article of footwear 300. For example, LED 350 of the third row that is closest to lateral side 301 may be disposed rearwardly (i.e., closer to rearfoot portion 306) of LED 350 of the third row that is closest to medial side 303. In some embodiments, the second row is disposed forwardly of motor 330 in midfoot region 304.

In some embodiments, a fourth (or rearmost) row disposed adjacent to the third row comprises three LEDs 350, as shown in FIG. 7B. The rearmost row of LEDs 350 may be disposed in midfoot region 304, in rearfoot region 306 or spanning across midfoot region 306 and rearfoot region 306. In some embodiments, motor 330 between midfoot region 304 and rearfoot region 306 region is disposed between the third row and the rearmost row of LEDs 350. For example, motor 330 between midfoot region 304 and rearfoot region 306 may be disposed immediately forward of rearmost row of LEDs 350. In some embodiments, the rearmost row of LEDs 350 is disposed at an angle relative to the transverse axis of article of footwear 300. For example, LED 350 of the rearmost row that is closest to lateral side 301 may be disposed rearwardly (i.e., closer to rearfoot portion 306) of LED 350 of the rearmost row that is closest to medial side 303.

Other arrangements of LEDs 350 may also be used. LEDs may be positioned to provide targeted light therapy to certain portions of the wearer's foot (similar to the vibration targets discussed above).

In addition to or alternatively to the LEDs 350, in some embodiments, article of footwear 300 may incorporate one or more materials for energy sources, such as graphene, carbon fiber, ceramics, or the like, to generate far infrared radiation (FIR) through heating for similar therapeutic benefits as discussed above. In some embodiments, materials such as graphene, carbon fiber, and/or ceramics may provide additional structural support to bear the weight of the wearer of the article of footwear 300. In some embodiments, the support structure 455 may include one or more FIR-generating materials and/or heating elements for therapeutic purposes. Heat may provide a thermal-based therapeutic benefit to help with pain, joint stiffness and tension, reducing muscle spasms and muscle tone and improving blood flow. The aforementioned benefits fall under the umbrella of recovery from physical activity and the treatment of both acute and chronic conditions associated with pain and inflammation. Thermotherapy applied between the temperatures of 37 and 43 degrees Celsius can elicit the desired therapeutic effects while still being safe to users as they fall below the 44 degrees Celsius, which is the generally accepted maximum temperature before the user starts to experience adverse effects and pain.

Materials producing far infrared radiation (FIR) in article of footwear 300 may provide therapeutic benefits to the user, including but not limited to reduced chronic muscle and joint pain and fatigue, wound healing, enhanced peripheral blood flow, and muscle tissue oxygenation. FIR is a band (50 to 1000 μm) in the infrared (IR) spectrum of electromagnetic radiation; the therapeutic fluence of FIR depends on the treatment duration as well as the two possible form factors of the device. The first being an electronically operated device which elicits greater FIR power densities in the tens of mW/cm2 range by heating up a piece of graphene or ceramic material. The second form factor, utilizing textiles infused with germanium or similar materials, relies on energy produced by the body. This second form factor generates much lower power densities, being in the 0.1-5 mW/cm2 range.

In some embodiments, as shown, for example in FIG. 7C, article of footwear comprises a charging port 372. Charging port 372 is coupled to control assembly 340 and may be configured to receive a charger to charge a battery of control assembly 340. In some embodiments, charging port 372 is a USB-C port. Other types of ports may also be used for charging port 372. For example, charging port 372 may be a USB-A port, a DC jack connector, or other type of cable connector. Charging port 372 may be accessible from an exterior of article of footwear 300. For example, charging port 372 may be disposed on an exterior wall of medial side 303 of sole 310.

In some embodiments, a switch 374 is coupled to control assembly 340 and configured to turn motors 330 and LEDs 350 on and off. In some embodiments, switch 374 is disposed on an exterior wall of medial side 303 of sole 310. Similar to switch 174, switch 374 may be used to transition between operating modes in addition to turning therapeutic assemblies on and off. The operating modes may include any combination of characteristics (e.g., light therapy only, vibration therapy only, turning on all or a subset of motors 330, turning on all or a subset of LEDs 350, switching between different intensities, speeds, or patterns of vibration for motors 330, switching between different intensities of LEDs 350, a combination of the foregoing, etc.). In some embodiments, multiple switches 374 may be included. Switch 374 may have other characteristics of switch 174 described above. For example, switch 374 may be a button 374 (e.g., a button that is pushed to operate).

Figure 8:
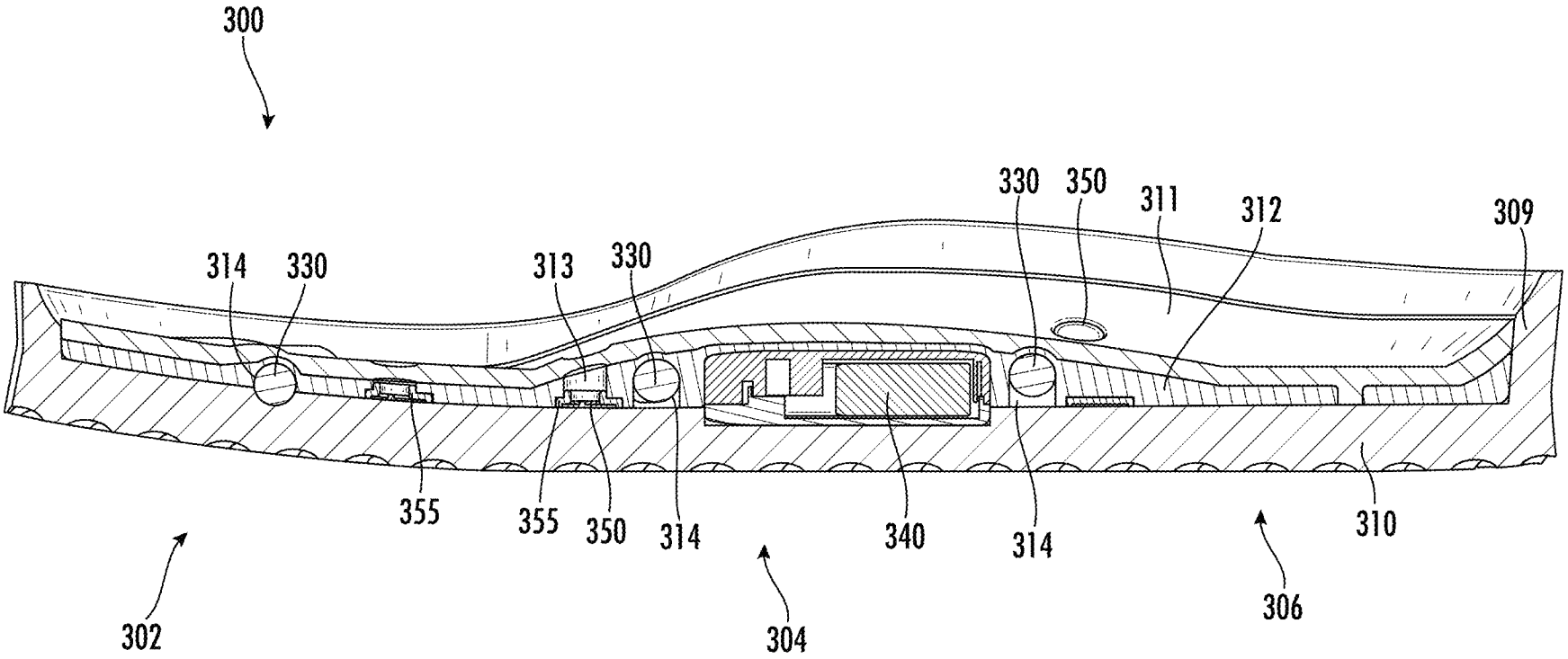
FIG. 8 shows a cross-section schematic view of an article of footwear having therapeutic assemblies according to some embodiments.
Figure 9:
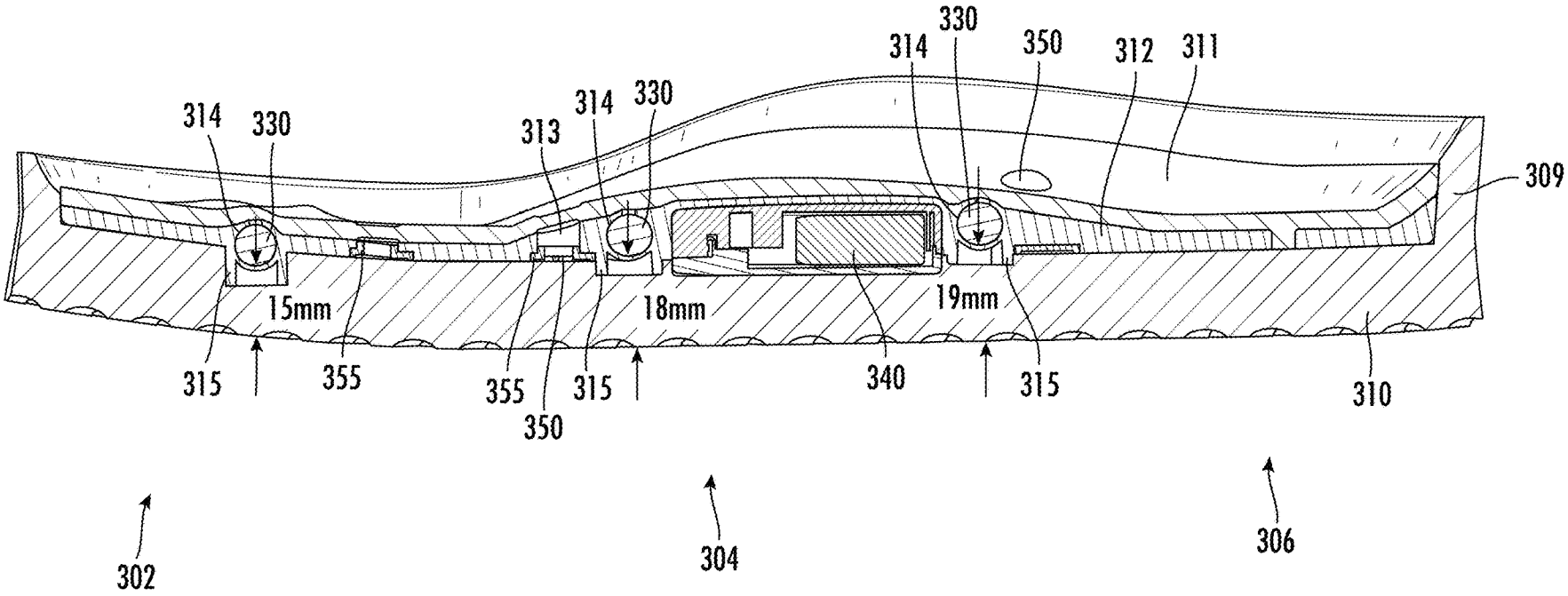
FIG. 9 shows a cross-section schematic view of an article of footwear having therapeutic assemblies according to some embodiments.
Figure 10:
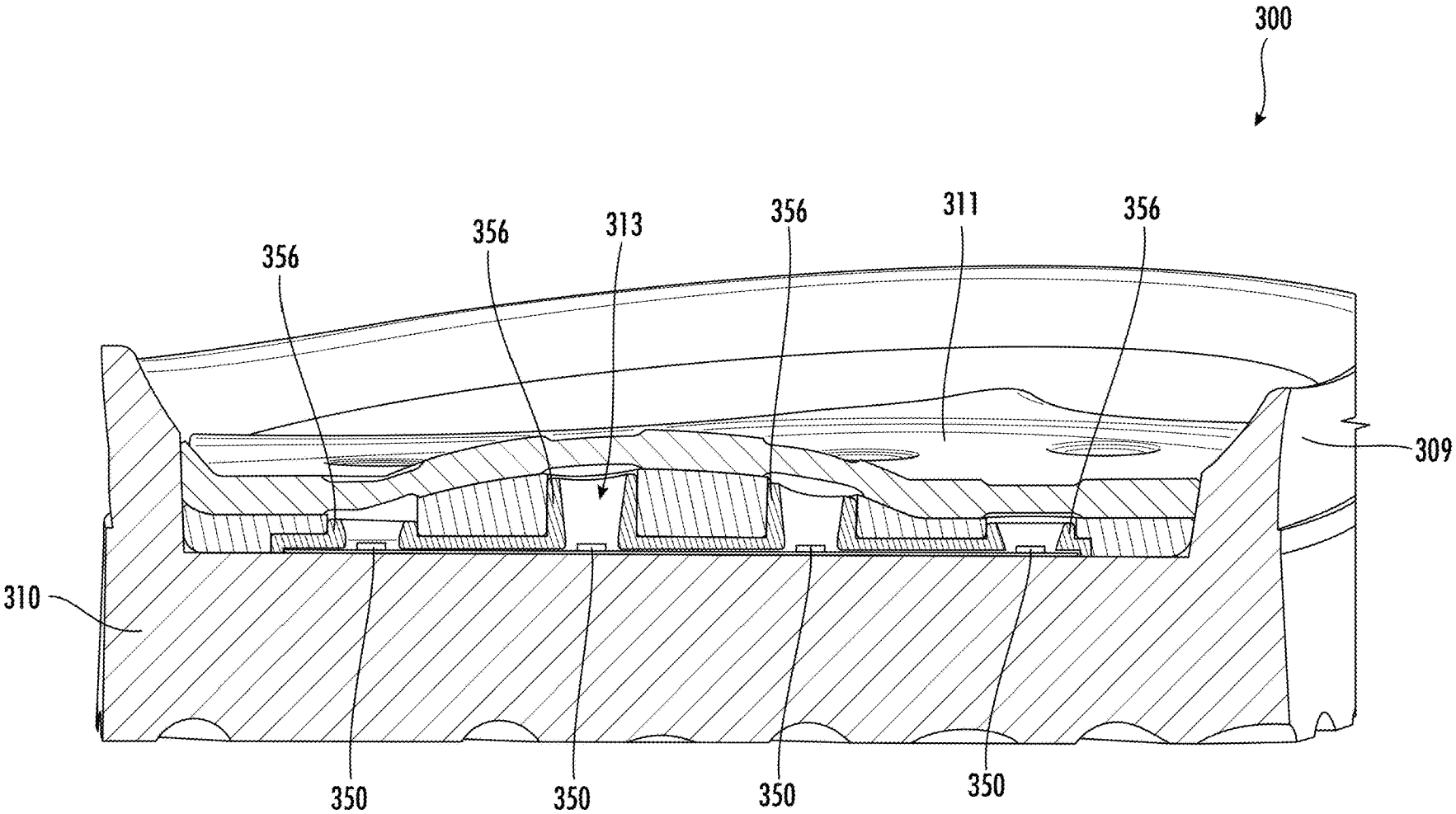
FIG. 10 shows a cross-section schematic view of an article of footwear having therapeutic assemblies according to some embodiments.

Additional details of the inner arrangement of article of footwear 300 (e.g., motors 330 and LEDs 350) are illustrated with reference to FIGS. 8-10. FIG. 8 shows a cross section of article of footwear 300 (without including straps 320). Sole 310 provides a bottom layer of article of footwear 300 (e.g., a layer configured to contact the ground). Sole 310 is disposed beneath motors 330 and LEDs 350. In some embodiments, sole 310 is concave such that it receives other components of article of footwear 300 (e.g., control assembly 340, motors 330, LEDs 350, top layer 311, etc.). For example, sole 310 may include sidewalls 309 that extend from a base of sole 310 above other components of article of footwear 300. In some embodiments, sole 310 may be made of ethyl-vinyl acetate (EVA) or other material suitable for shoe/slide soles.

The thickness of sole 310 may be different in various embodiments. A greater thickness of sole 310 may strengthen sole 310, particularly when a wearer is standing or putting weight on article of footwear 300. In some embodiments, a greater thickness helps facilitate vibration of motors 330, even when a wearer is standing. In some embodiments. as shown, for example, in FIG. 9, a thickness of sole 110 may be provided such that a distance between a bottom of motor 330 in forefoot region 302 and a base of sole 310 is between 12 mm and 20 mm (e.g., 15 mm). In some embodiments, a thickness of sole 110 may be provided such that a distance between a bottom of motor 330 in midfoot region 304 and a base of sole 310 is between 15 mm and 22 mm (e.g., 18 mm). In some embodiments, a thickness of sole 110 may be provided such that a distance between a bottom of motor 330 (disposed between midfoot region 304 and rearfoot region 306) and a base of sole 310 is between 15 mm and 22 mm (e.g., 19 mm). Other thicknesses may also be used.

Referring again to FIG. 8, in some embodiments, article of footwear 300 comprises a mounting layer 312 disposed between top layer 311 and sole 310. In some embodiments, mounting layer 312 is made of EVA. Motors 330 may be coupled to mounting layer 312. For example, in some embodiments, mounting layer 312 includes pockets 314 for each motor 330, as shown in FIG. 8. In some embodiments, as shown in FIG. 9, pockets 314 include a spacer 315. Spacer 315 may be a protrusion of mounting layer 312 that extends below motor 330. In some embodiments, spacer 315 provides additional space for motor 330 to vibrate, even when article of footwear is being compressed (e.g., from the weight of a wearer).

Referring again to FIG. 8, in some embodiments, mounting layer 312 includes holes 313 aligned with each LED 350, allowing light from LED 350 to reach (and shine through) transparent top layer 311. In some embodiments, each LED 350 may be disposed within hole 313 of mounting layer 312. In some embodiments, article of footwear 300 comprises a support structure 355 (such as a bracket 355) for LEDs 350. Bracket 355 may be configured to protect LEDs 350. In some embodiments, each row of LEDs 350 may have its own bracket 355. In some embodiments, each LED 350 may have its own bracket 355. In some embodiments, bracket 355 is one piece shaped to protect the entire array of LEDs 350.

In some embodiments, bracket 355 may provide a base on which LED 350 may rest. In some embodiments, LEDs 350 rest on sole 310 and bracket 355 is disposed to surround LEDs 350 (e.g., around the sides of LEDs). In either of these situations, bracket 355 may extend around portions of LED 350, for example, to guide light from LED 350 up through hole 313 of mounting layer 312. In some embodiments, as shown, for example, in FIG. 10, bracket 355 comprises a hollow guide 356 that protrudes up through hole 313. In some embodiments, an internal portion of guide 356 may have a larger diameter towards the top of hole 313 than at a bottom of hole 313. This arrangement may provide an increased angle of light that can emanate from LED 350 through guide 356 (than if the inner diameter was constant), which may provide a higher intensity of LED light reaching a wearer, thus improving the light therapy.

Bracket 355 may be coupled to mounting layer 312, sole 310, or both (e.g., with an adhesive). In some embodiments, bracket 355 is simply placed in location (e.g., in holes 313 of mounting layer 312 and/or above sole 310) without a direct coupling mechanism. In some embodiments, bracket 355 is made of a plastic material, such as polycarbonate. In some embodiments, bracket 355 is white to reduce the amount of light from LED 350 that is absorbed. Using a white bracket 355 may help improve the light therapy by increasing the intensity of LED light reaching a wearer.

In some embodiments, control assembly 340 is disposed between mounting layer 312 and sole 310. Sole 310 and/or mounting layer 312 may include cavities or depressions to make space for control assembly 340. Control assembly 340 may be coupled to mounting layer 312, sole 310, or both. In some embodiments, control assembly 340 is simply placed in location (e.g., between mounting layer 312 sole 310) without a direct coupling mechanism.

Figure 11:
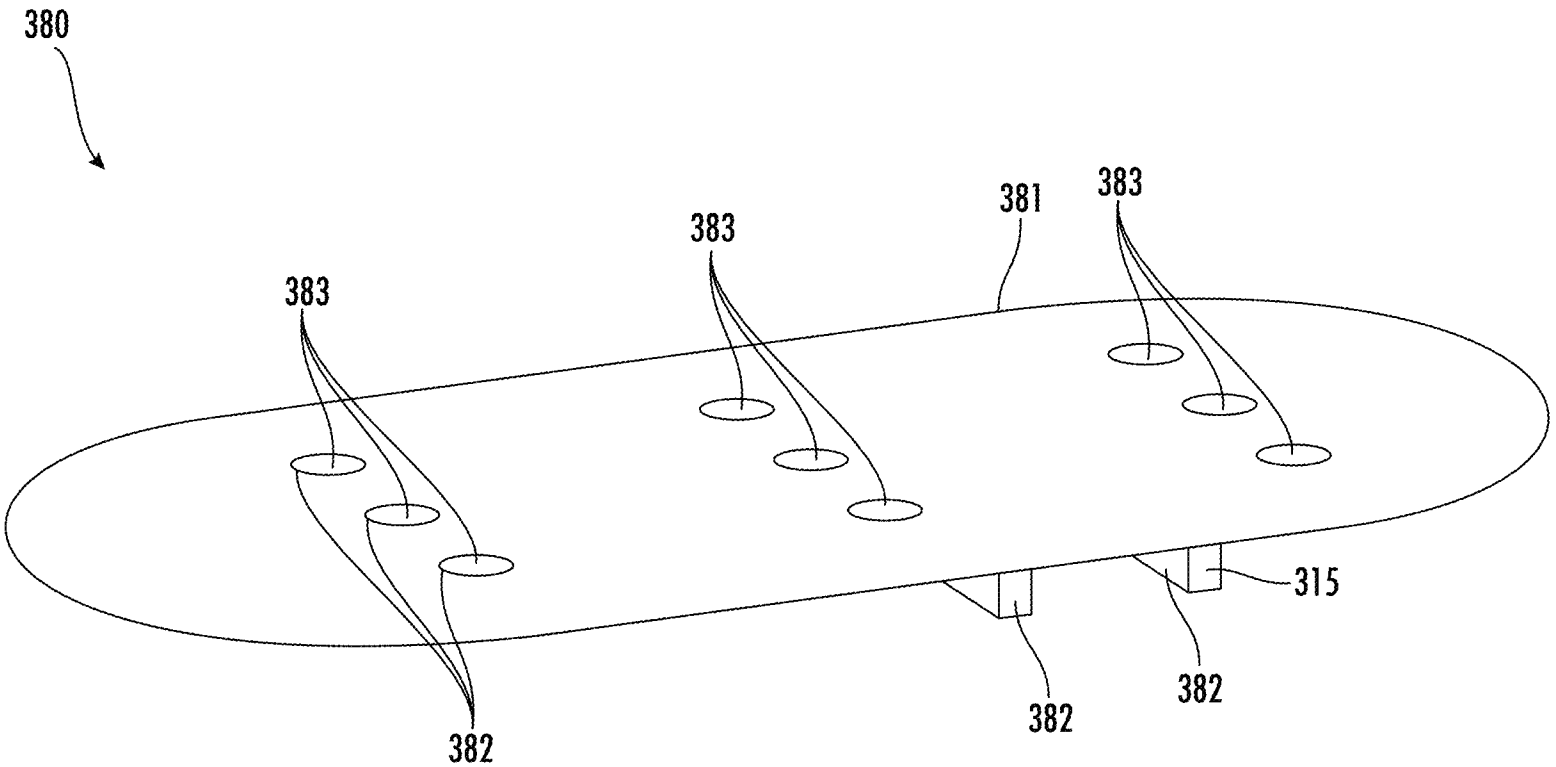
FIG. 11 shows a perspective schematic view of a mounting layer for an article of footwear having therapeutic assemblies according to some embodiments.
Figure 12:
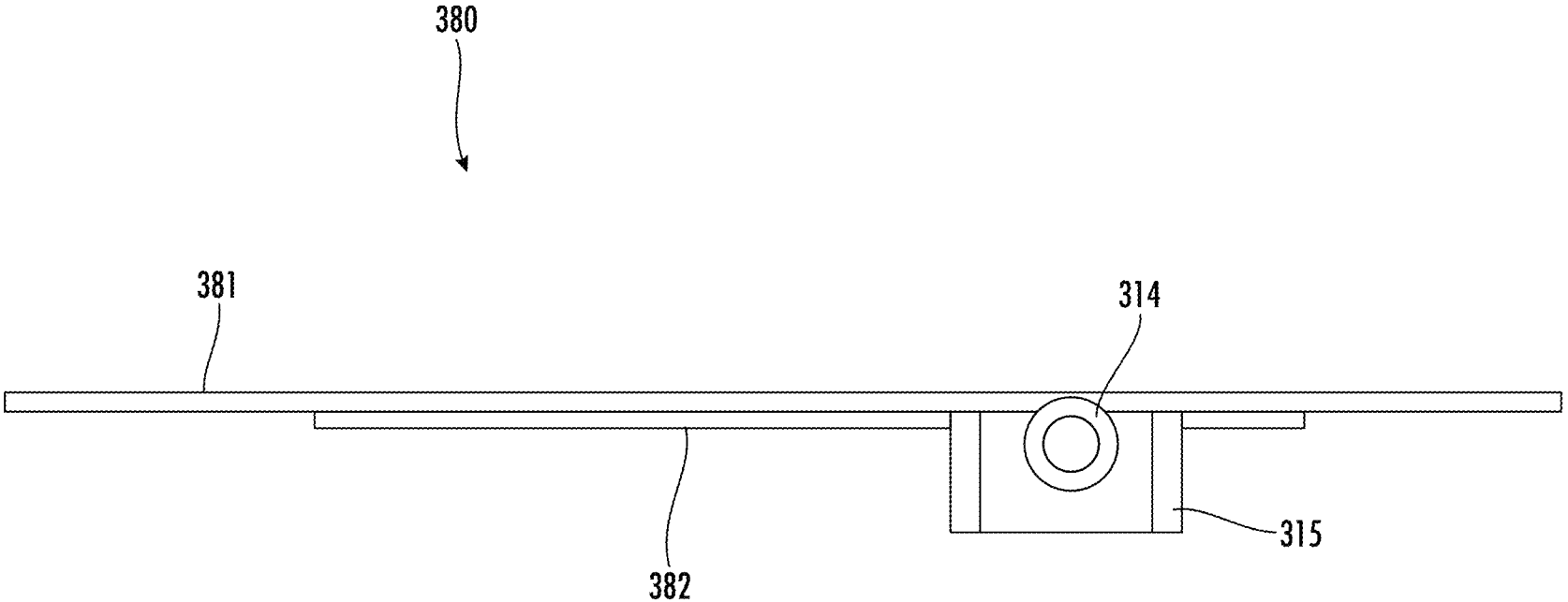
FIG. 12 shows a side schematic view of a mounting layer for an article of footwear having therapeutic assemblies according to some embodiments.

In some embodiments, rather than a transparent top layer 311 (e.g., made of silicone) and a separate mounting layer 312 (e.g., made of EVA), article of footwear 300 may include a single part made of polyurethane (e.g., thermoplastic polyurethane (TPU)) and a transparent polycarbonate. For example, as shown in FIGS. 11 and 12, a single part 380 may be made that provides a soft layer 381 as a top surface. Layer 381 may be made of a TPU material and may be soft to provide for the wearer's comfort. In some embodiments, the same material that is used for layer 381 may be used to form pockets 314 (see FIG. 12).

In some embodiments, single part 380 may be additionally made of a second material 382 that is transparent (e.g., transparent polycarbonate). Second material 382 may be disposed in locations within layer 381 as transparent covers 383 to fill holes in layer 381 that align with LEDs 350 (see FIG. 11). Thus, while layer 381 is not transparent, transparent covers 383 allow LED light to pass through to provide light therapy to a wearer's feet. In some embodiments, second material 382 may also be used to provide structure underneath layer 381 that provides structural support to protect LEDs 350. In some embodiments, second material 382 is used to form spacers 315 to create support and empty space around motors 330 to facilitate their vibration (even when a wearer's weight is on article of footwear 300) and also to reduce noise.

Figure 13B:
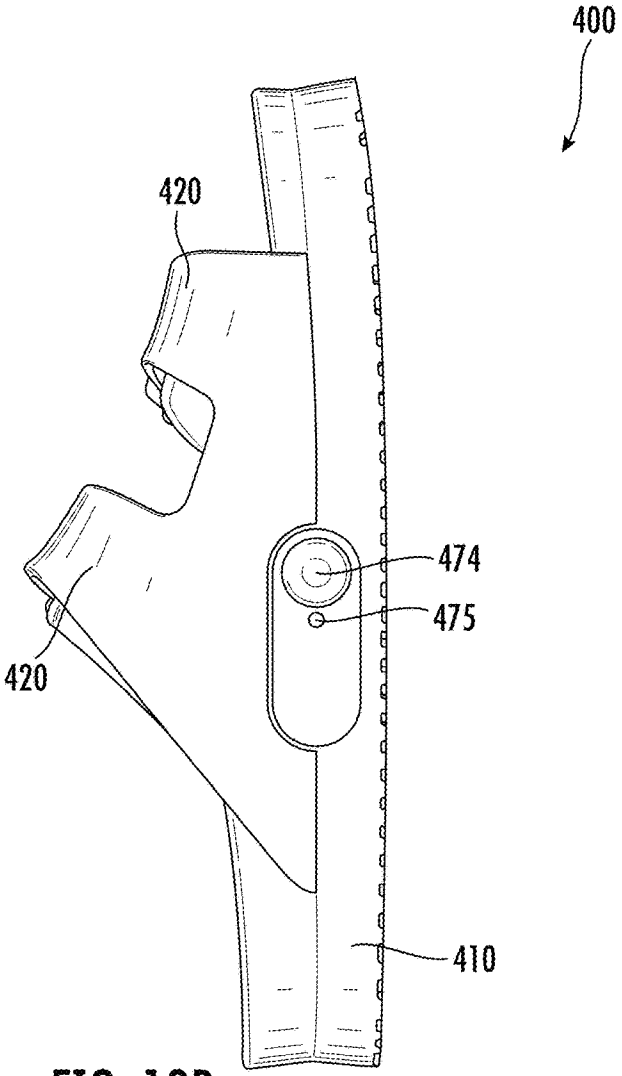
FIG. 13B shows a side view of an article of footwear having therapeutic assemblies according to some embodiments.
Figure 13A:
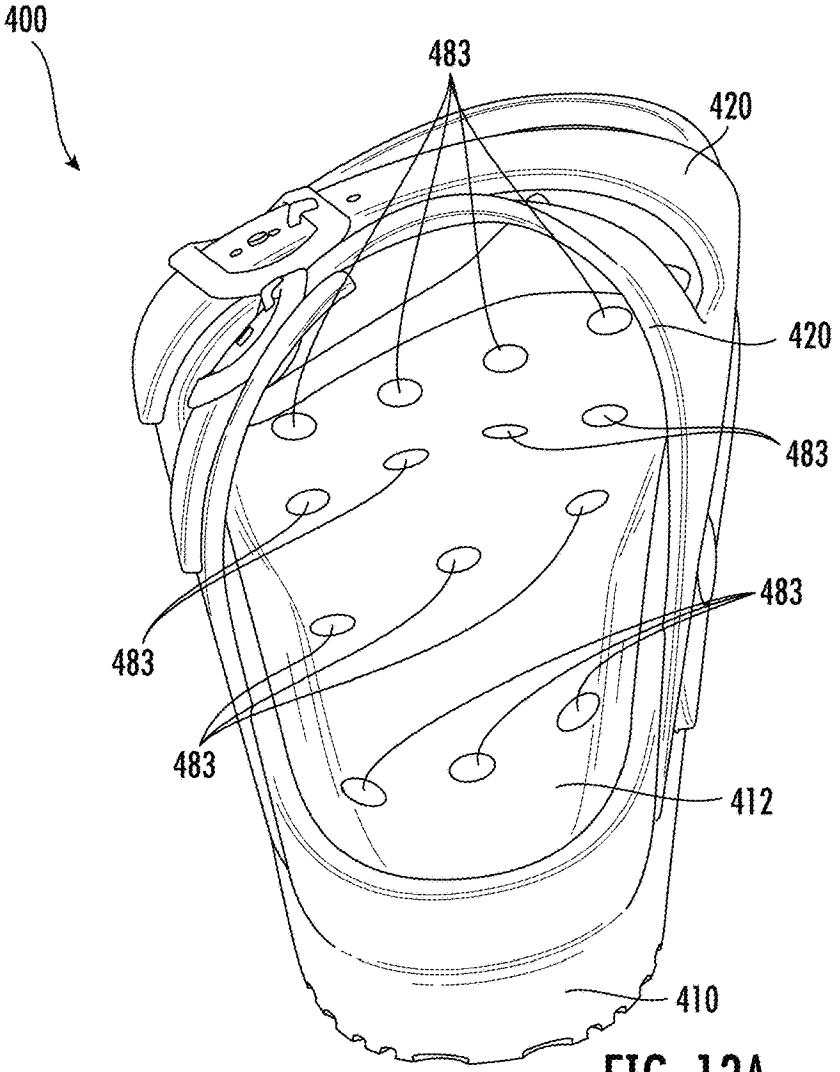
FIG. 13A shows a top perspective view of an article of footwear having therapeutic assemblies according to some embodiments.

An article of footwear 400 according to some embodiments is shown in FIGS. 13A-13B having both a light therapy assembly and a vibration assembly. Features discussed with respect to article of footwears 100 and/or 300 above may also be implemented as part of article of footwear 400. Similarly, features discussed with respect to article of footwear 400 below may also be implemented as part of article of footwears 100 and/or 300. In addition, while article of footwear 400 comprises both a light therapy assembly and a vibration assembly, in some embodiments, an article of footwear comprises a light therapy assembly (such as the one discussed with respect to article of footwear 400) and does not include a vibration assembly.

As shown in FIG. 13A, article of footwear 400 may have a sole 410 and one or more straps 420. In some embodiments, article of footwear 400 comprises a vibration assembly, which may have the features discussed above with respect to article of footwear 100 or article of footwear 300, and a light therapy assembly, which may have the features discussed above with respect to article of footwear 300. In some embodiments, article of footwear comprises a mounting layer 412. Mounting layer 412 may have some or all of the features of single part 380, and some or all of the features of mounting layer 112, or a combination of single part 380 and mounting layer 112. For example, mounting layer 412 may comprise holes 413 (see FIG. 16) and transparent cover(s) 483 (see FIG. 13A) may be disposed in holes 413 at locations that are aligned with LEDs to allow for light therapy to be applied to a wearer's foot.

Figure 14:
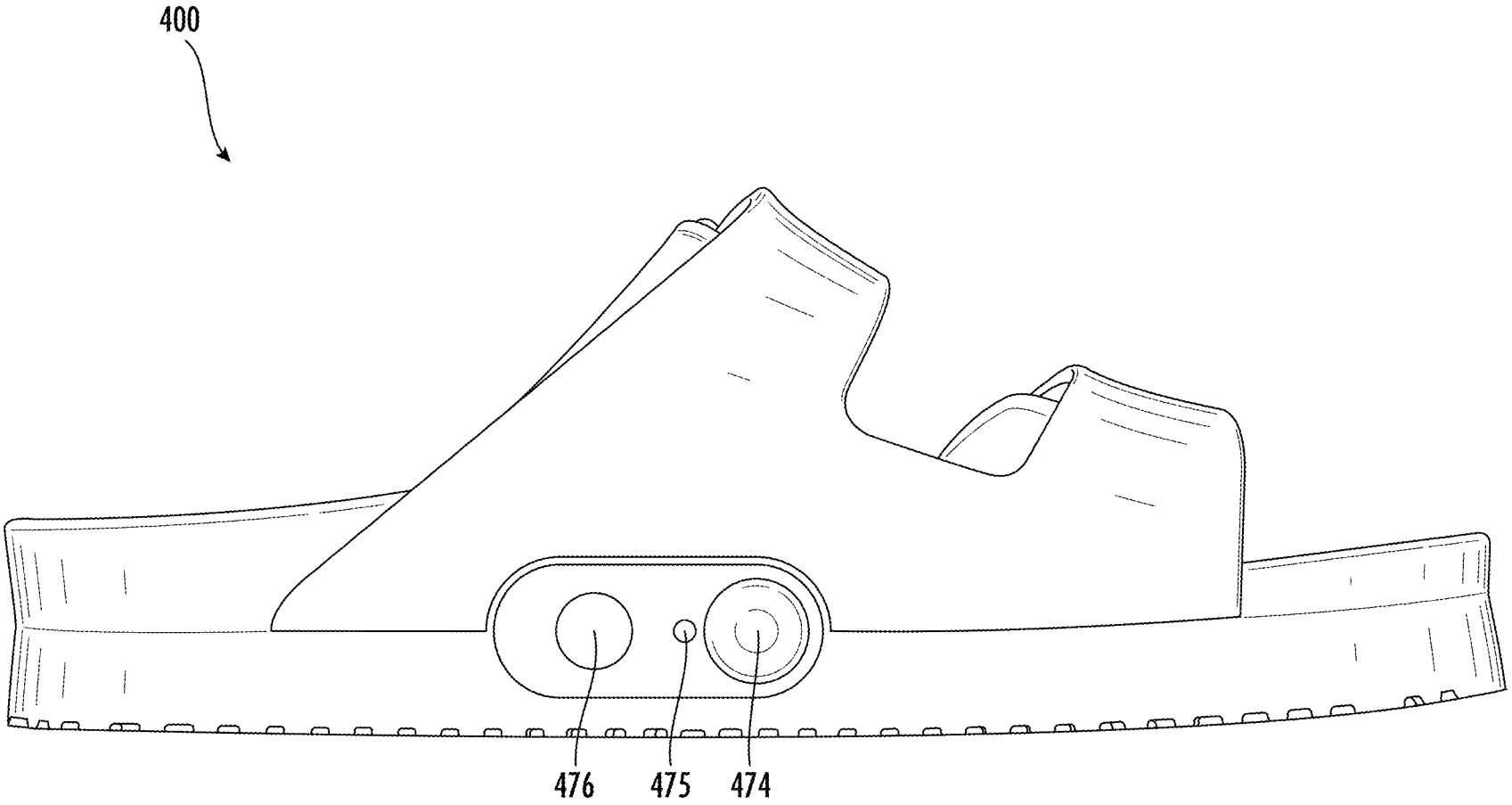
FIG. 14 shows a side view of an article of footwear having therapeutic assemblies according to some embodiments.

In some embodiments, as shown in FIG. 13B, a switch 474 may be disposed on an exterior wall of sole 410. Switch 474 may have the characteristics of switch 174 or 374. Unlike article of footwear 300, article of footwear 400 may use wireless charging (as discussed below) instead of having a charging port. In some embodiments, article of footwear 400 comprises a status light 475 disposed adjacent to switch 474. Status light 475 may provide information to a user (e.g., low battery, fully charged, turned on, modes of operation, etc.) based on a color and/or a pattern of status light 475. In some embodiments, as shown, for example, in FIG. 14, article of footwear 400 may include two switches, a switch 474 for the vibration assembly and a switch 476 for the light therapy assembly. Thus, switch 474 may be used to turn vibration motors on and off (and switch between various modes of operation), and switch 476 may be used to turn LEDs on and off (and switch between various modes of operation).

Figure 15:
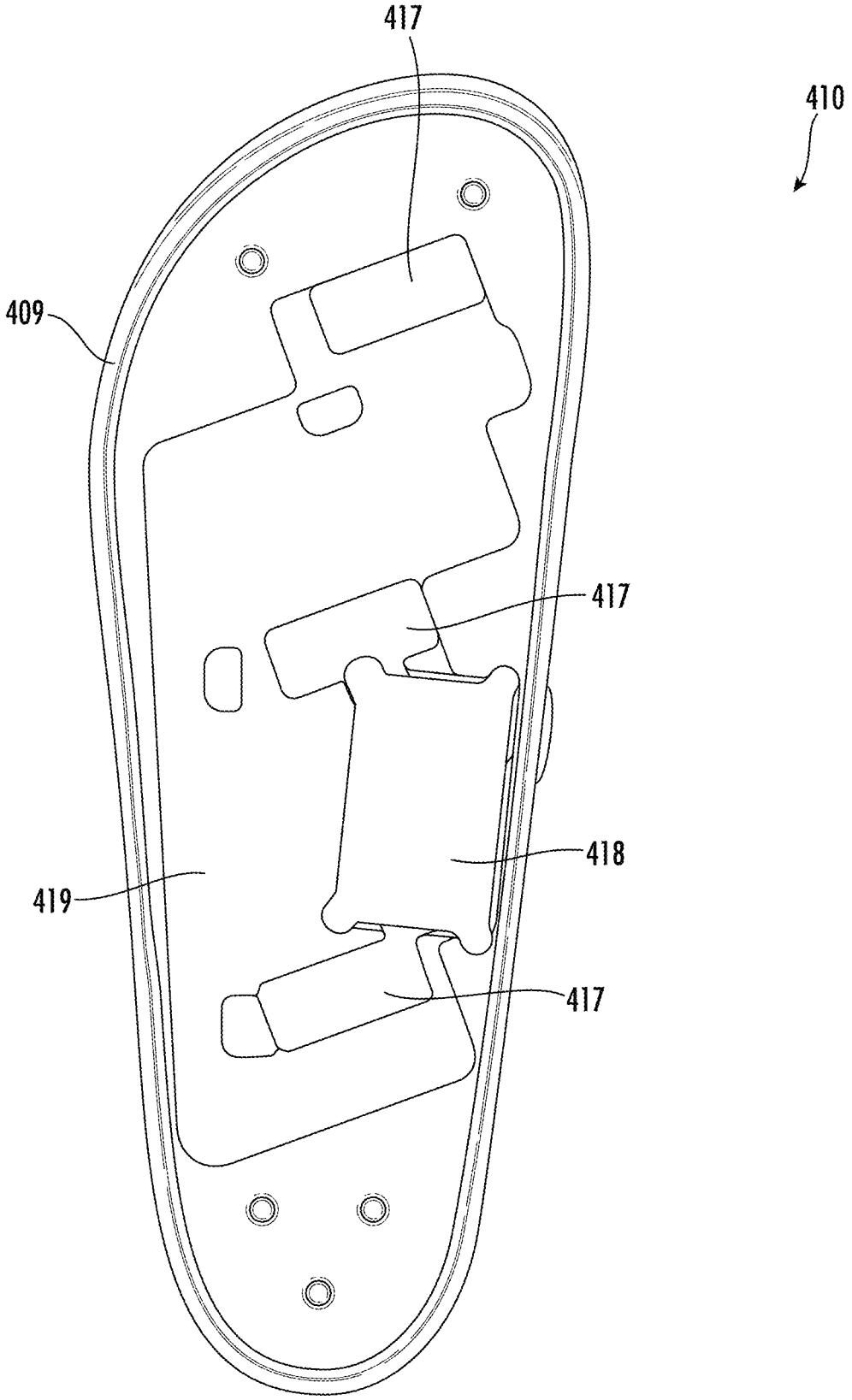
FIG. 15 shows a top view of a sole for an article of footwear having therapeutic assemblies according to some embodiments.

Additional details of sole 410 are shown, for example, in FIG. 15. In some embodiments, sole 410 comprises a sidewall 409. Sidewall 409 may be a raised edge around sole 410. Sidewall 409 may extend above other components of article of footwear 400 (e.g., mounting layer 412). In some embodiments, a top surface of sole 410 may define one or more cavities configured to receive other portions of article of footwear 400. For example, top surface of sole 410 may define a cavity 417 for each motor in the vibration assembly of article of footwear 400. In FIG. 15, sole 410 defines three cavities 417 for motors. In some embodiments, top surface of sole 410 defines a cavity 418 configured to receive all or a portion of a control assembly for the vibration assembly and light therapy assembly of article of footwear 400. In some embodiments, top surface of sole 410 defines a cavity 419 for the LEDs (and associated structure) of the light therapy assembly of article of footwear 400. In some embodiments, cavities 417, 418, and 419 may overlap or be nested within each other. For example, cavity 418 may be the deepest cavity and may partially overlap with one or more cavities 417 and with cavity 419. Cavities 417 may be deeper than cavity 419 and may partially or entirely overlap with cavity 419. In some embodiments, a portion of cavities 417 is configured to provide extra space to allow motors to vibrate, even when article of footwear 400 is being compressed.

Figure 16:
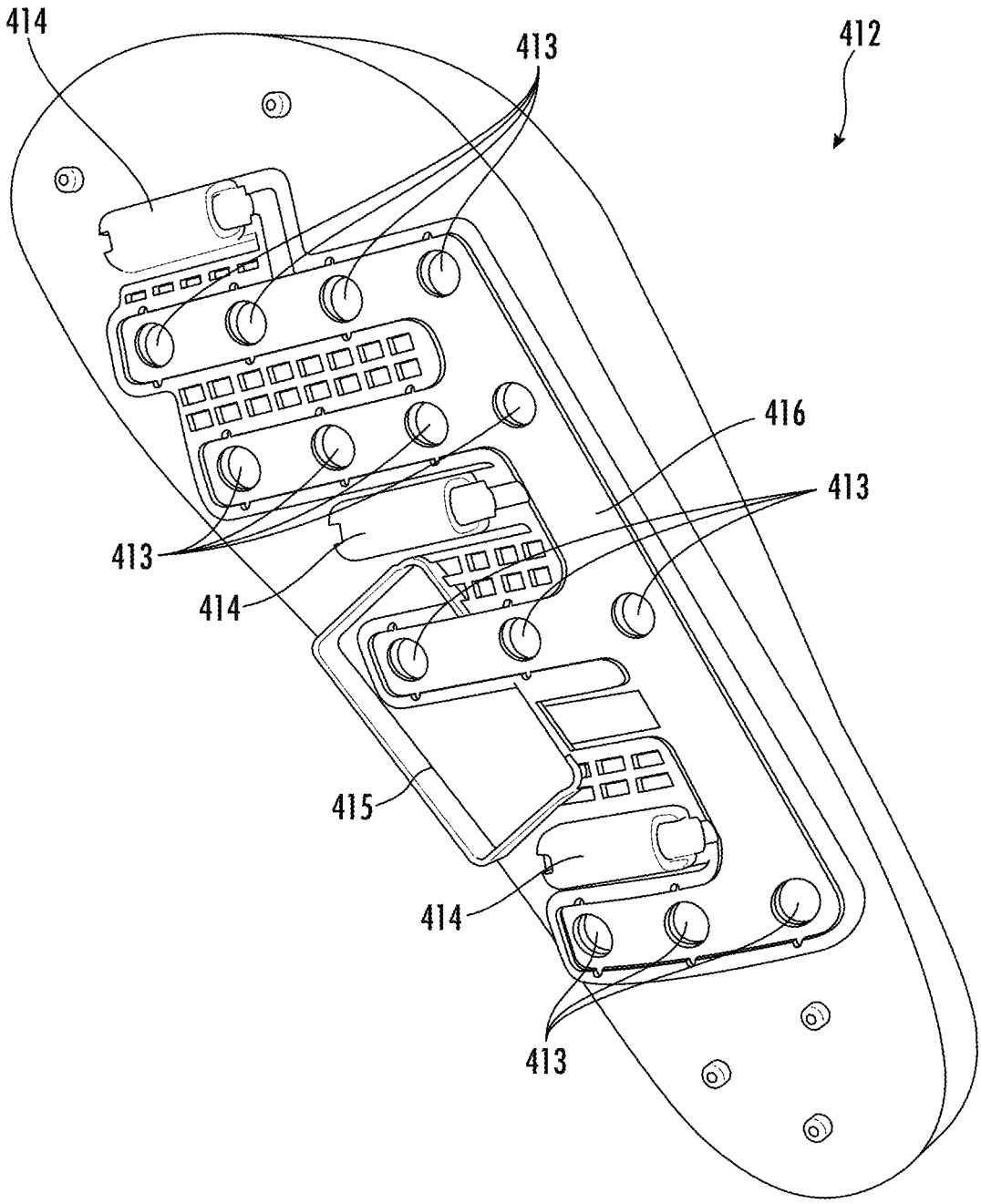
FIG. 16 shows a bottom perspective view of a mounting layer for an article of footwear having therapeutic assemblies according to some embodiments.

Additional details of mounting layer 412 are shown, for example, in FIG. 16. In some embodiments, mounting layer 412 defines holes 413 therethrough. Holes 413 may be positioned to align with LEDs of the light therapy assembly of article of footwear 400. In some embodiments, mounting layer 412 comprises pockets 414 configured to hold motors of the vibration assembly of article of footwear 400. Pockets 414 may be disposed on a bottom of mounting layer 412. In FIG. 16, mounting layer 412 comprises three pockets 414 for motors. In some embodiments, a bottom surface of mounting layer 412 defines a cavity 415 configured to receive all or a portion of a control assembly for the vibration assembly and light therapy assembly of article of footwear 400. In some embodiments, a bottom surface of mounting layer 412 defines a cavity 416 for the LEDs (and associated structure) of the light therapy assembly of article of footwear 400.

Figure 17:
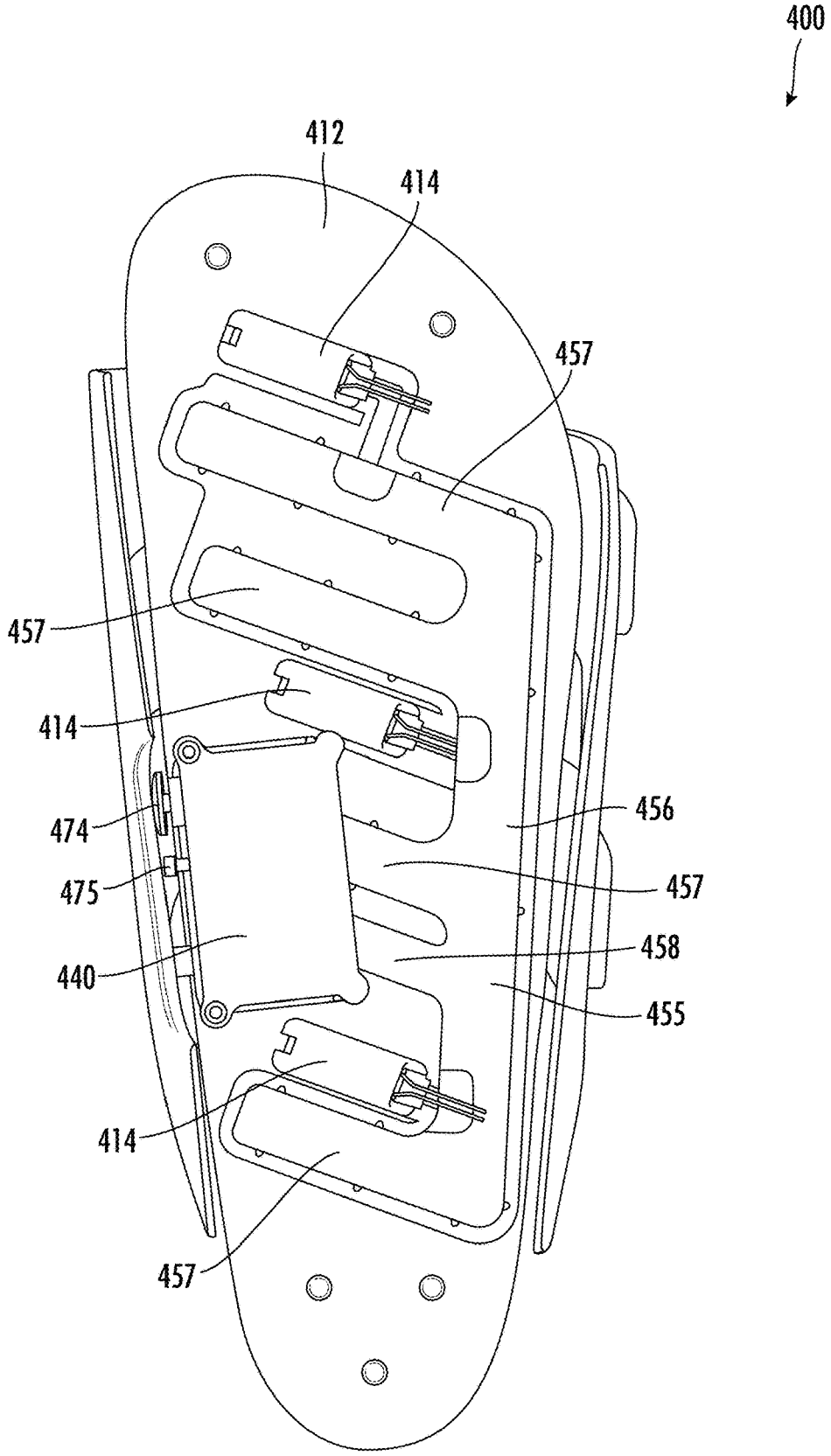
FIG. 17 shows a bottom view of an article of footwear having therapeutic assemblies (with the sole removed) according to some embodiments.
Figure 18:
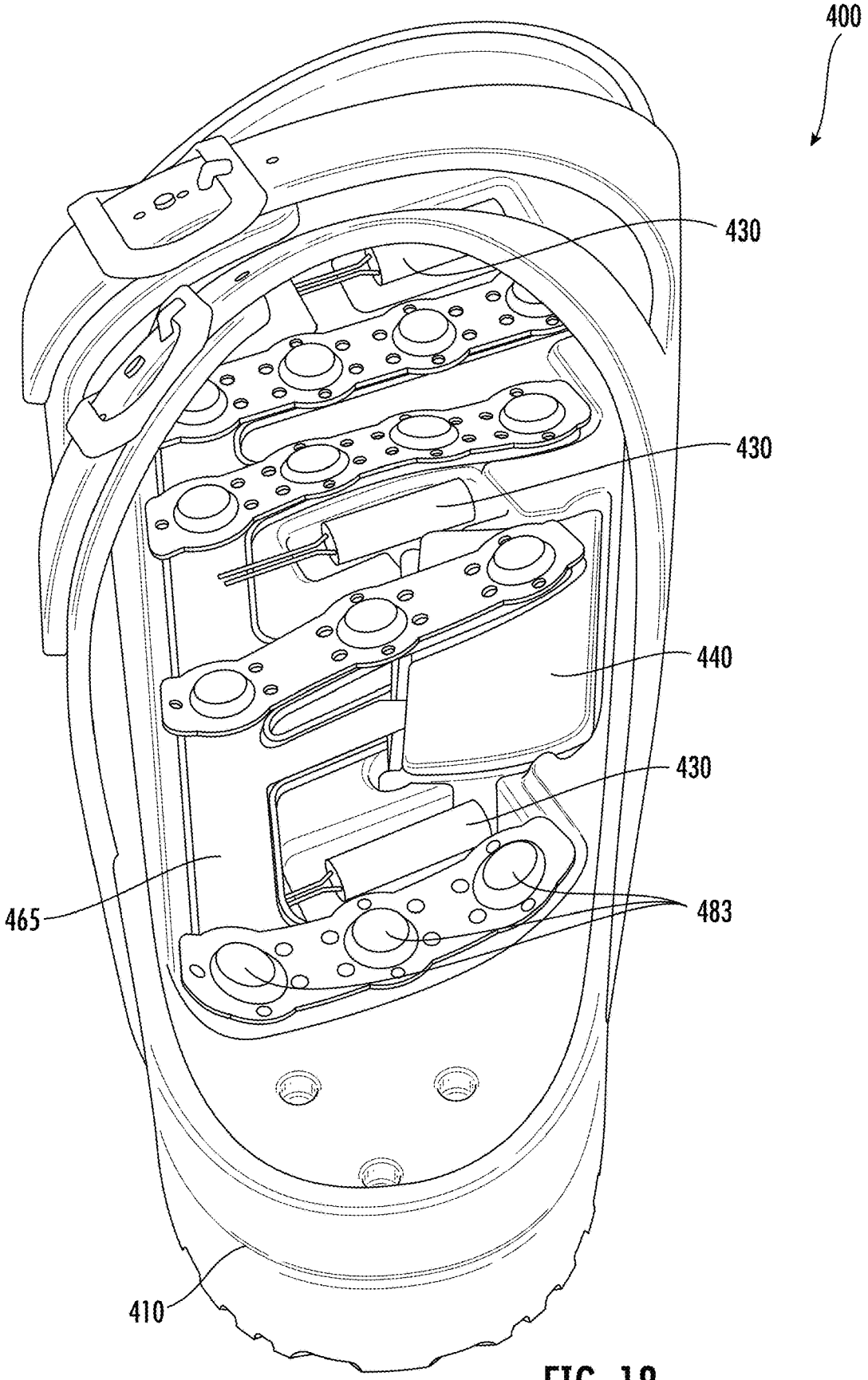
FIG. 18 shows a top perspective view of an article of footwear having therapeutic assemblies (with a mounting layer removed) according to some embodiments.
Figure 19:
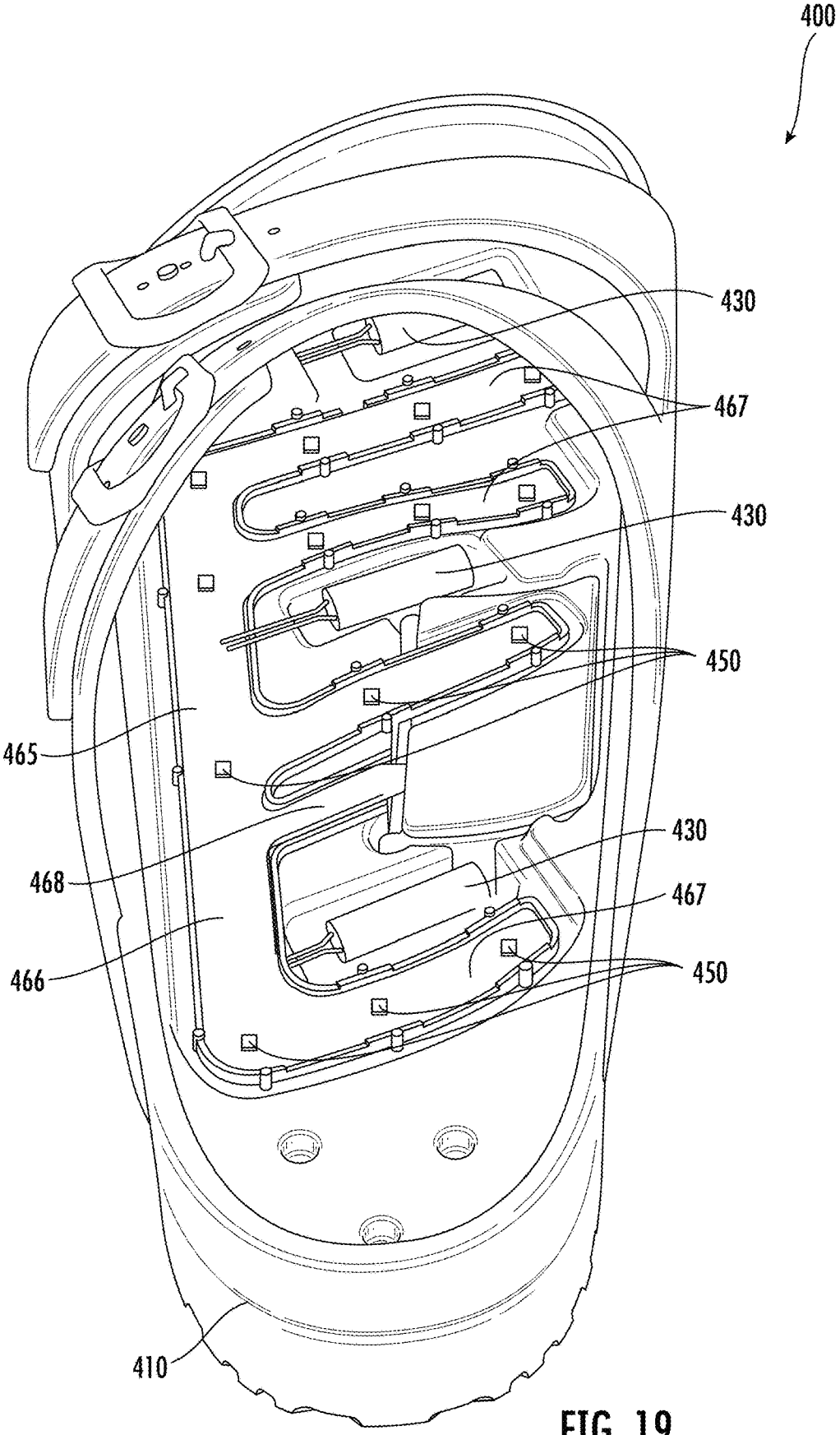
FIG. 19 shows a top perspective view of an article of footwear having therapeutic assemblies (with a mounting layer and LED covers removed) according to some embodiments.

Additional details relating to the light therapy assembly is shown, for example, in FIGS. 17-19. FIG. 17 shows a bottom view of article of footwear 400 with sole 410 removed. Portions of mounting layer 412 are visible, including pockets 414 with cabling of the motors extending out of the pockets 414. Other portions of mounting layer 412 are covered by a control assembly 440 and support structure 455. In some embodiments, control assembly 440 is disposed to be aligned with cavity 415 (see FIG. 16). Control assembly 440 may be operably connected with switch 474 and status light 475.

In some embodiments, support structure 455 comprises structure (e.g., bracket 455) to contain LEDs. In some embodiments, bracket 455 comprises a longitudinal section 456 that extends longitudinally along a side of article of footwear 400. For example, longitudinal section 456 may extend from a rearfoot portion of article of footwear 400 to a forefoot portion of article of footwear 400. Branching from longitudinal section 456 is a series of transverse sections 457 extending transversely across article of footwear 400. Each transverse section 457 may be associated with a row of LEDs. Thus, the number of transverse sections 457 may be equal to the number of rows of LEDs in article of footwear 400. In some embodiments, a control assembly section 458 also extends transversely from longitudinal section 456 to control assembly 440. An electrical connection from control assembly 440 to LEDs may be contained within bracket 455. In some embodiments, an electrical connection from control assembly 440 to motors of article of footwear 400 may also be contained within bracket 455. For example, the cabling extending from pockets 414 may extend into bracket 455. In some embodiments, bracket 455 is U-shaped to be disposed below and to the sides of LEDs when article of footwear 400 is worn.

FIG. 18 shows a top view of article of footwear 400 with mounting layer 412 removed. In some embodiments, transparent covers 483 (which are configured to fill holes 413 in mounting layer 412) are disposed over bracket 455. In some embodiments, transparent cover 483 is configured to mate with bracket 455 so as to enclose LEDs within bracket 455 and transparent cover 483. In some embodiments, a row of transparent covers 483 may be one piece, as shown in FIG. 18. Each row of transparent covers 483 may correspond to a row of LEDs, a row of holes 413, and a transverse section 457 of bracket 455. In some embodiments, transparent covers 483 comprise lenses for LEDs.

FIG. 19 shows a similar view as FIG. 18, but transparent covers 483 are also removed to reveal LEDs 450 and LED support 465. LED support 465 may provide a physical and electrical connection between each LED 450 and control assembly 440. In some embodiments, LED support 465 is shaped to fit within bracket 455. LEDs 450 may rest on top of LED support 465. In some embodiments, LED support 465 comprises a longitudinal section 466 that extends longitudinally along a side of article of footwear 400. For example, longitudinal section 466 may extend from a rearfoot portion of article of footwear 400 to a forefoot portion of article of footwear 400. Branching from longitudinal section 466 is a series of transverse sections 467 extending transversely across article of footwear 400. Each transverse section 467 may be associated with a row of LEDs 450. Thus, the number of transverse sections 467 may be equal to the number of rows of LEDs 450 in article of footwear 400. In some embodiments, portions of longitudinal section 466 disposed between transverse sections 467 may be softer than other portions of LED support 465. This may help make electrical connections between LEDs 450 more reliable, particularly while a wearer is walking in article of footwear 400, and thus improve reliability of LEDs 450 themselves in providing light therapy.

In some embodiments, a control assembly section 468 also extends transversely from longitudinal section 466 to control assembly 440. LED support 465 may provide an electrical connection from control assembly 440 to LEDs 450. In some embodiments, LED support 465 may also provide a portion of an electrical connection from control assembly 440 to motors 430 of article of footwear 400. For example, cabling of motors 430 may electrically connect to LED support 465.

Figure 20:
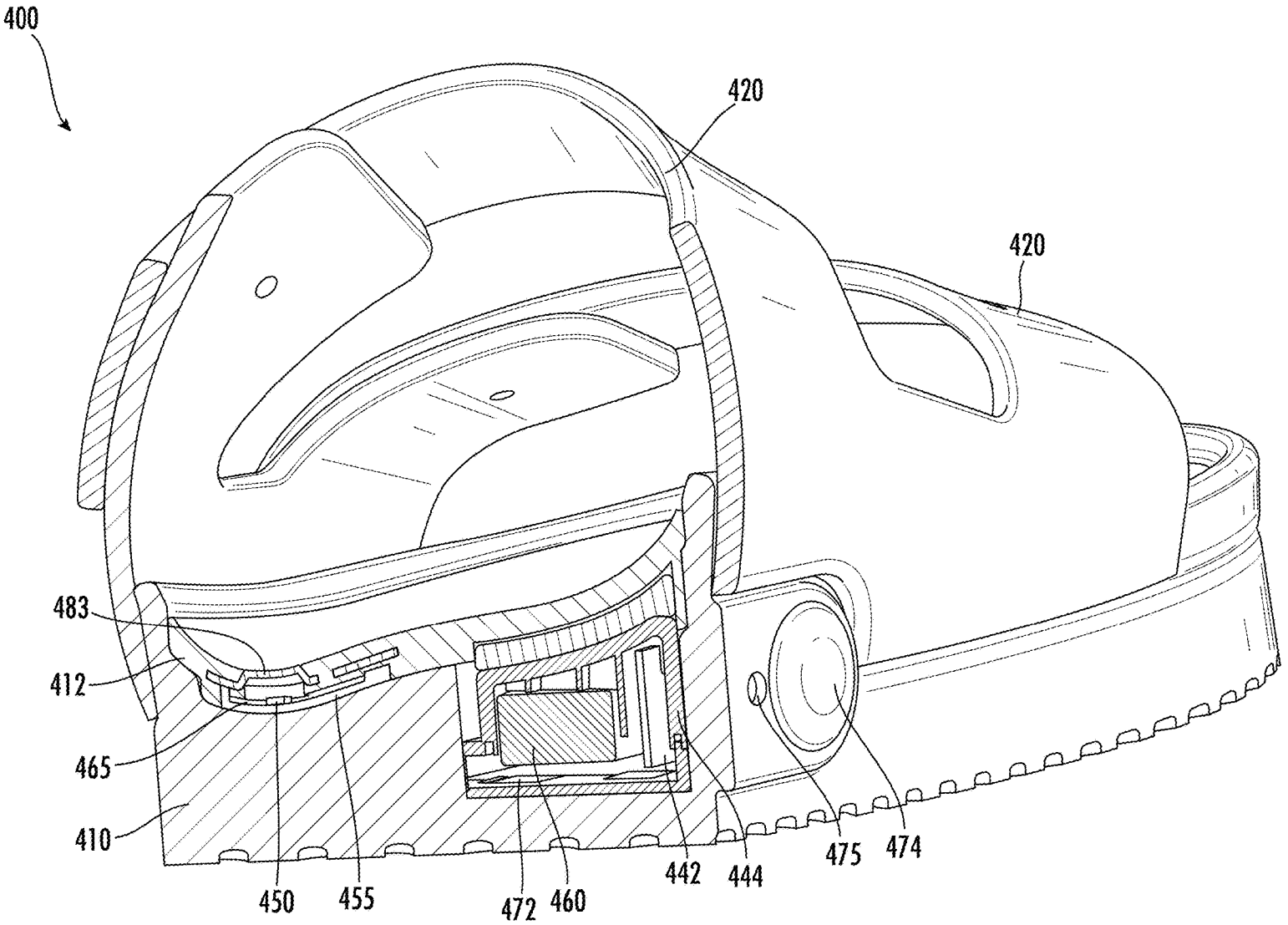
FIG. 20 shows a cross section view of an article of footwear having therapeutic assemblies according to some embodiments.

The cross-section view shown in FIG. 20 shows various components of the light therapy assembly of article of footwear 400 assembled together (including transparent cover 483, mounting layer 412, LED 450, LED support 465, bracket 455, sole 410, and control assembly 440). Control assembly 440 may include a protective housing 444, control circuitry 442 (e.g., a printed circuit board (PCB)), and a battery 460 (which may have the features discussed above for protective housing 150, battery 160, and control circuitry 170, while also powering and controlling operation of light therapy assembly). In some embodiments, control circuitry 442 may include a wireless communication module (e.g., for Bluetooth connection, near-field communication (NFC), Wi-FI connection, or the like). In some embodiments, each shoe in a pair of articles of footwear 400 may connect or pair with each other and work in tandem via a connection through the wireless communication module in control circuitry 442. In some embodiments, the wireless communication module may allow for the article of footwear 400 to connect to and communicate with an external device (e.g., a mobile device, tablet, computing device, or the like), via Bluetooth, NFC, Wi-Fi, or other networks. In some embodiments, a wearer of the article of footwear 400 may control operation of the article of footwear 400 (e.g., powering on/off the footwear, powering on/off the vibration and/or light therapies, adjusting the levels of vibration and/or light therapies, etc.) through the external device that is connected to the article of footwear 400. In some embodiments, the wearer of the article of footwear 400 may program or select a schedule of treatment for the vibration and/or light therapies in the footwear 400 using the interface of the connected external device. In some embodiments, the schedule of treatment may include a combination of time intervals and/or varying durations for treatment, such as for example, vibration and/or light therapy for a duration of 10 minutes every hour for 5 hours.

Figure 21:
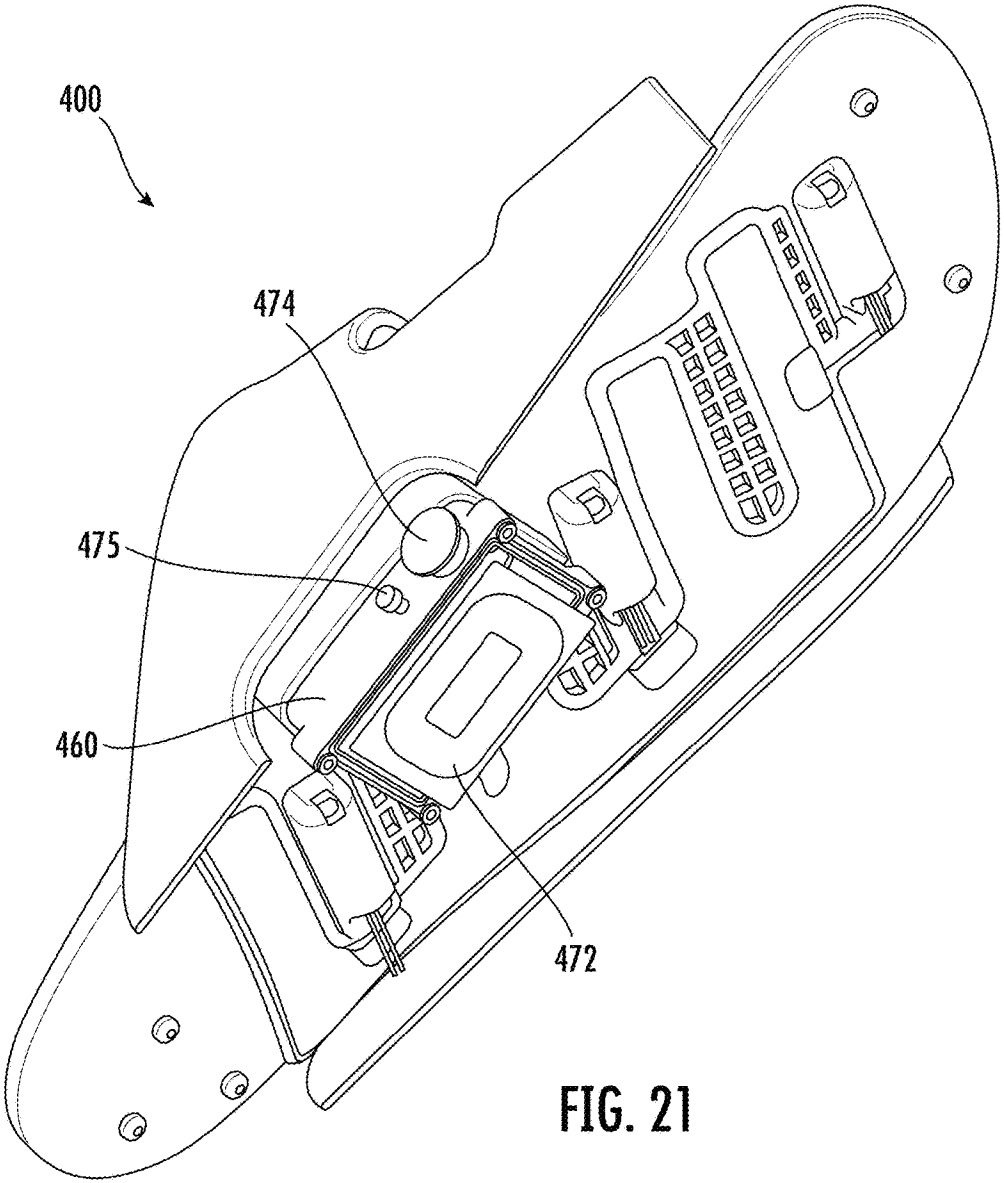
FIG. 21 shows a bottom perspective view of an article of footwear having therapeutic assemblies (with the sole and cover of a control assembly removed) according to some embodiments.
Figure 22B:
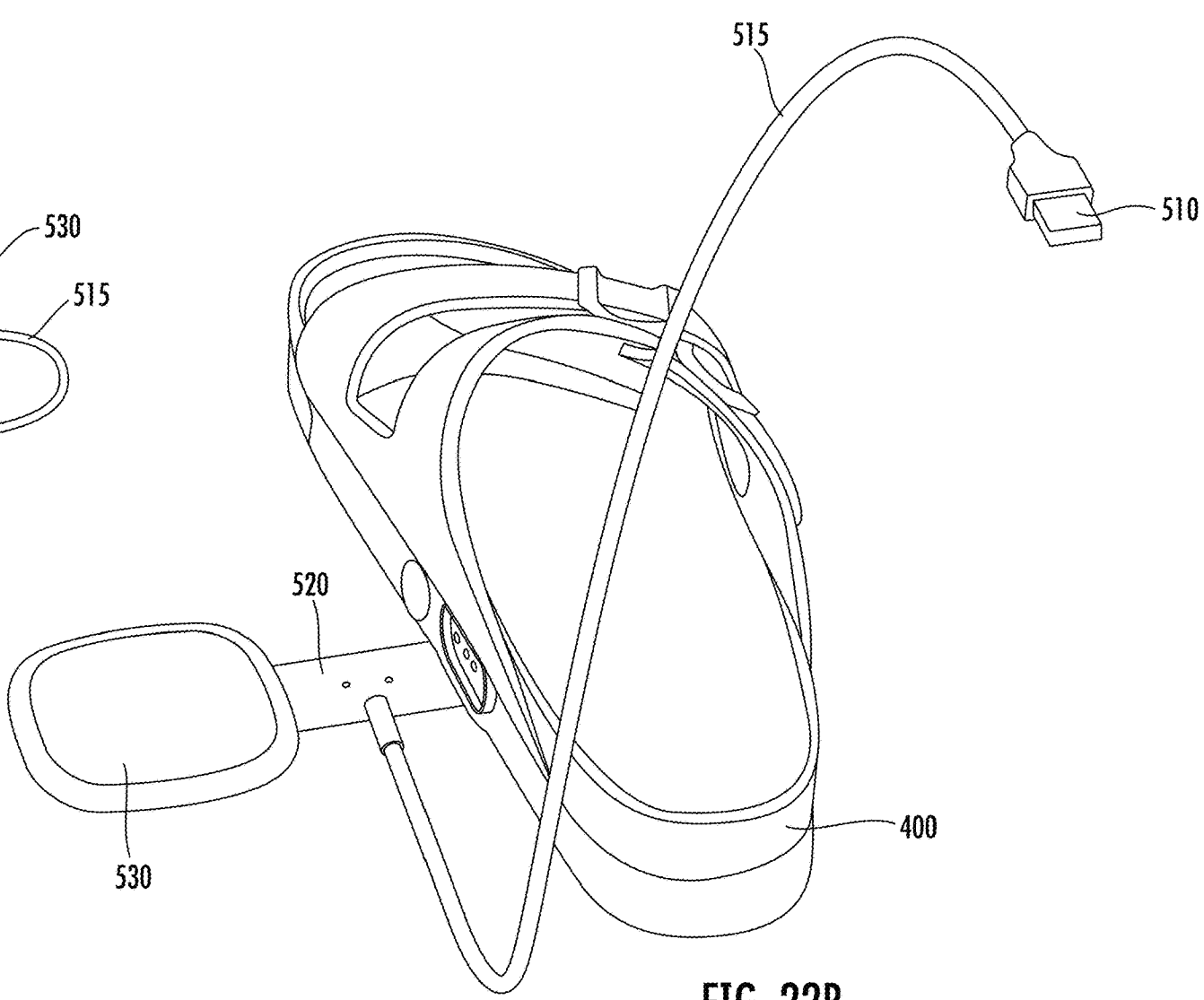
FIG. 22B shows a charging system with an article of footwear having therapeutic assemblies according to some embodiments.
Figure 22A:
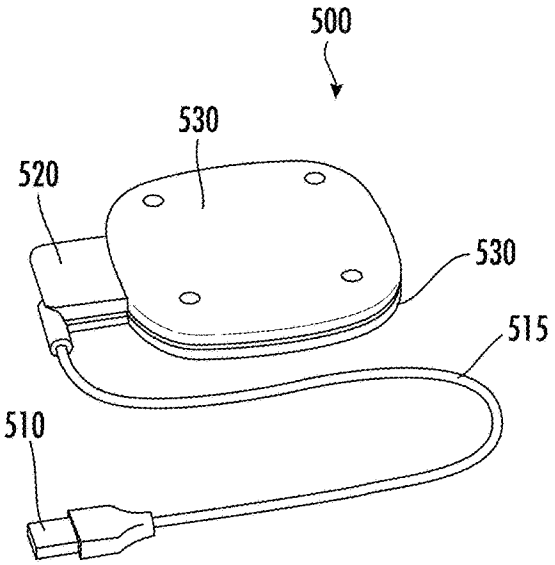
FIG. 22A shows a charging system for an article of footwear having therapeutic assemblies according to some embodiments.

In some embodiments, a wireless charging module 472 (as shown in FIGS. 20 and 21) is disposed underneath battery 460. Wireless charging module 472 is configured to charge battery 460 when paired with a charging device 500 (see FIGS. 22A and 22B). In some embodiments, charging device 500 comprises a connector 510, a cable 515, a flexible portion 520, and one or more charging pads 530. In some embodiments, connector 510 may be configured to plug into a power source (e.g., a power outlet, a USB port, etc.). In some embodiments, connector 510 comprises a USB connector. In some embodiments, cable 515 extends from connector 510 to flexible portion 520. Flexible portion 520 may be disposed between two charging pads 530, allowing for charging device 500 to fold into a more compact configuration (see FIG. 22A). Having two charging pads 530 allows for a pair of articles of footwear 400 to be charged simultaneously. Each article of footwear 400 is placed on a charging pad 530 such that charging pad 530 is aligned with charging module 472 is aligned with charging pad 530 (see FIG. 22B). Thus, article of footwear 400 may be charged wirelessly (instead of with a charging port). In some embodiments, wireless charging of article footwear 400 may allow for the device's electronics to be sealed and waterproof.

Figure 23:
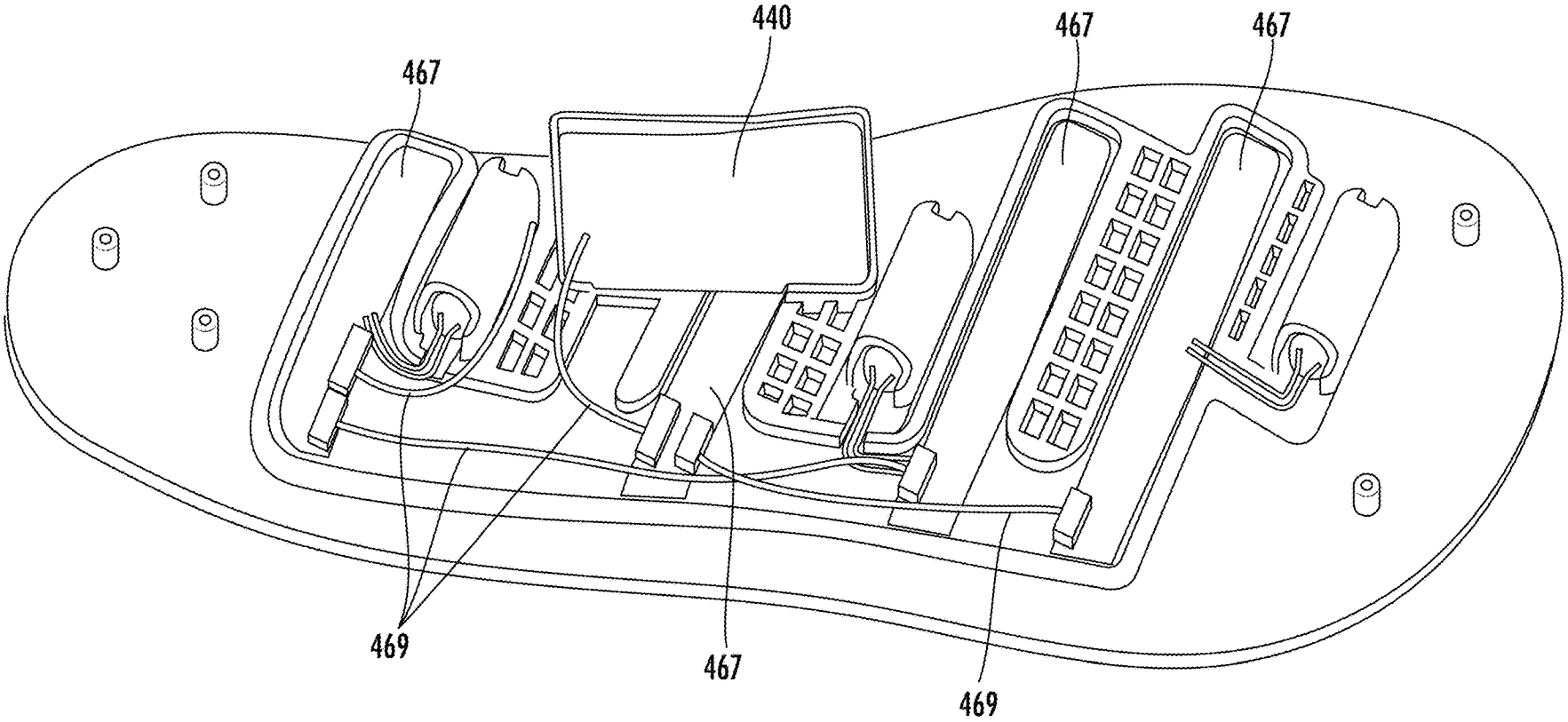
FIG. 23 shows a bottom perspective view of an internal portion of an article of footwear having therapeutic assemblies according to some embodiments.

Variations to article of footwear 400 are also possible. For example, instead of having a single LED support 465 with a longitudinal section 466, each transverse section 467 may be its own LED support, as shown, for example, in FIG. 23. In place of longitudinal section 466 and control assembly section 468, an electrical connection from control assembly 440 may be provided with cables 469 to connect each transverse section 467. This configuration may also make the electrical connections between LEDs 450 more reliable, particularly while a wearer is walking in article of footwear 400, and thus improve reliability of LEDs 450 themselves in providing light therapy.

Further implementations are within the CLAIMS. It will be understood that implementations of articles of footwear having one or more therapeutic assemblies include but are not limited to the specific components disclosed herein, as virtually any components consistent with the intended operation of various articles of footwear having one or more therapeutic assemblies may be utilized. Accordingly, for example, it should be understood that, while the drawings and accompanying text show and describe particular implementations of articles of footwear having one or more therapeutic assemblies, any such implementation may comprise any shape, size, style, type, model, version, class, grade, measurement, concentration, material, weight, quantity, and/or the like consistent with the intended operation of articles of footwear having one or more therapeutic assemblies.

The concepts disclosed herein are not limited to the specific articles of footwear having one or more therapeutic assemblies shown herein. For example, it is specifically contemplated that the components included in particular articles of footwear having one or more therapeutic assemblies may be formed of any of many different types of materials or combinations that can readily be formed into shaped objects and that are consistent with the intended operation of the articles of footwear having one or more therapeutic assemblies. For example, the components may be formed of: rubbers (synthetic and/or natural) and/or other like materials; glasses (such as fiberglass), carbon-fiber, aramid-fiber, any combination therefore, and/or other like materials; elastomers and/or other like materials; polymers such as thermoplastics (such as ABS, fluoropolymers, polyacetal, polyamide, polycarbonate, polyethylene, polysulfone, and/or the like, thermosets (such as epoxy, phenolic resin, polyimide, polyurethane, and/or the like), and/or other like materials; plastics and/or other like materials; composites and/or other like materials; metals, such as zinc, magnesium, titanium, copper, iron, steel, carbon steel, alloy steel, tool steel, stainless steel, spring steel, aluminum, and/or other like materials; and/or any combination of the foregoing.

Furthermore, articles of footwear having one or more therapeutic assemblies may be manufactured separately and then assembled together, or any or all of the components may be manufactured simultaneously and integrally joined with one another. Manufacture of these components separately or simultaneously, as understood by those of ordinary skill in the art, may involve 3-D printing, extrusion, pultrusion, vacuum forming, injection molding, blow molding, resin transfer molding, casting, forging, cold rolling, milling, drilling, reaming, turning, grinding, stamping, cutting, bending, welding, soldering, hardening, riveting, punching, plating, and/or the like. If any of the components are manufactured separately, they may then be coupled or removably coupled with one another in any manner, such as with adhesive, a weld, a fastener, any combination thereof, and/or the like for example, depending on, among other considerations, the particular material(s) forming the components.

In places where the description above refers to particular implementations of articles of footwear having one or more therapeutic assemblies, it should be readily apparent that a number of modifications may be made without departing from the spirit thereof and that these implementations may be applied to other implementations disclosed or undisclosed. The presently disclosed articles of footwear having one or more therapeutic assemblies are, therefore, to be considered in all respects as illustrative and not restrictive.

We claim:

1. An article of footwear for warm-up and active recovery, the article of footwear comprising:

a sole;

a light therapy system coupled to the sole, the light therapy system comprising a plurality of LEDs;

a bracket disposed above the sole and configured to support the plurality of LEDs;

a mounting layer disposed above the sole, wherein the plurality of LEDs is disposed between the mounting layer and the sole, and wherein the mounting layer defines a plurality of holes, each hole aligned with one of the plurality of LEDs;

a plurality of vibrating motors coupled to the mounting layer;

a battery configured to power the light therapy system and the plurality of vibrating motors; and control circuitry configured to control the light therapy system and the plurality of vibrating motors.

2. The article of footwear of claim 1, further comprising a transparent layer disposed above the sole, wherein the plurality of LEDs is disposed between the transparent layer and the sole.

3. The article of footwear of claim 1, further comprising:

a transparent cover disposed in each hole, wherein each of the plurality of LEDs is aligned with one of the transparent covers.

4. The article of footwear of claim 1, wherein the plurality of LEDS is arranged in a plurality of rows.

5. The article of footwear of claim 1, wherein the mounting layer comprises pockets, each pocket configured to receive a motor, and wherein each of the plurality of motors is disposed in one of the pockets.

6. The article of footwear of claim 1, wherein a bottom surface of the mounting layer defines a cavity configured to receive the plurality of LEDs.

7. The article of footwear of claim 1, wherein the bracket comprises a longitudinal section and a plurality of transverse sections.

8. The article of footwear of claim 1, wherein the battery is configured to be recharged with a wireless charging device.

9. The article of footwear of claim 1, further comprising one or more materials configured to generate at least one of far-infrared radiation (FIR) and heat.

10. An article of footwear for warm-up and active recovery, the article of footwear comprising:

a sole;

a vibration system coupled to the sole, the vibration system comprising a plurality of motors;

a mounting layer disposed above the sole, the mounting layer having pockets, each pocket configured to receive a motor, wherein each of the plurality of motors is disposed in one of the pockets and configured to vibrate;

a light therapy system coupled to the sole, the light therapy system comprising a plurality of LEDs, wherein the plurality of LEDs is disposed between the mounting layer and the sole, and wherein the mounting layer defines a plurality of holes, each hole aligned with one of the plurality of LEDs;

a battery configured to power the vibration system and the light therapy system; and control circuitry configured to control the vibration system and the light therapy system.

11. The article of footwear of claim 10, wherein a bottom surface of the mounting layer defines a cavity configured to receive the plurality of LEDs.

12. The article of footwear of claim 10, wherein the battery and the control circuitry are part of a control assembly and are disposed in a protective housing.

13. The article of footwear of claim 12, wherein a bottom surface of the mounting layer defines a cavity configured to receive at least a portion of the control assembly.

14. The article of footwear of claim 10, further comprising a bracket disposed above the sole and configured to support the plurality of LEDs, wherein the bracket comprises a longitudinal section and a plurality of transverse sections.

15. The article of footwear of claim 14, further comprising a plurality of transparent covers, each transparent cover disposed within one of the plurality of holes of the mounting layer, wherein the plurality of LEDs is disposed between the bracket and the plurality of transparent covers.

16. The article of footwear of claim 10, wherein the battery is configured to be recharged with a wireless charging device.

17. The article of footwear of claim 10, wherein the article of footwear comprises a slide.

18. The article of footwear of claim 10, wherein the plurality of motors comprises a first motor disposed in a forefoot region of the article of footwear, a second motor disposed in a midfoot region of the article of footwear, and a third motor disposed between the midfoot region and a rearfoot region of the article of footwear.

19. An article of footwear for warm-up and active recovery, the article of footwear comprising:

a sole;

a light therapy system coupled to the sole, the light therapy system comprising a plurality of LEDs;

a bracket disposed above the sole and configured to support the plurality of LEDs;

a mounting layer disposed above the sole, wherein the mounting layer comprises a plurality of holes and a transparent cover disposed in each hole, wherein each one of the plurality of LEDs is aligned with the transparent cover disposed in each hole;

a plurality of vibrating motors coupled to the mounting layer;

a battery configured to power the light therapy system and the plurality of vibrating motors; and control circuitry configured to control the light therapy system and the plurality of vibrating motors.

* * * * *